US007625097B2

(12) United States Patent
Endo et al.

(10) Patent No.: US 7,625,097 B2
(45) Date of Patent: Dec. 1, 2009

(54) ILLUMINATED ELEVATOR INCLUDING COLD-CATHODE FLOURESCENT LAMP

(75) Inventors: Masahiko Endo, Tokyo (JP); Kyoichi Ikeda, Tokyo (JP); Kenichi Okada, Tokyo (JP); Hiroyuki Ogawa, Tokyo (JP)

(73) Assignee: Toshiba Elevator Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/491,443

(22) PCT Filed: Sep. 4, 2003

(86) PCT No.: PCT/JP03/11316

§ 371 (c)(1),
(2), (4) Date: Apr. 14, 2004

(87) PCT Pub. No.: WO2004/022470

PCT Pub. Date: Mar. 18, 2004

(65) Prior Publication Data

US 2004/0257807 A1 Dec. 23, 2004

(30) Foreign Application Priority Data

| | | |
|---|---|---|
| Sep. 6, 2002 | (JP) | 2002-261756 |
| Oct. 11, 2002 | (JP) | 2002-299480 |
| Oct. 25, 2002 | (JP) | 2002-310608 |
| Oct. 28, 2002 | (JP) | 2002-312833 |
| Oct. 31, 2002 | (JP) | 2002-317957 |
| Oct. 31, 2002 | (JP) | 2002-318864 |
| Jan. 28, 2003 | (JP) | 2003-019194 |
| Jan. 28, 2003 | (JP) | 2003-019199 |
| Jan. 28, 2003 | (JP) | 2003-019201 |
| Mar. 27, 2003 | (JP) | 2003-087575 |

(51) Int. Cl.
*F21V 7/20* (2006.01)
*F21V 29/00* (2006.01)

(52) U.S. Cl. ..... 362/218; 362/221; 362/222; 313/485

(58) Field of Classification Search ..... 362/218, 362/221, 222; 313/485
See application file for complete search history.

(56) References Cited

U.S. PATENT DOCUMENTS 3,192,502 A 6/1965 Stutz et al.

(Continued)

FOREIGN PATENT DOCUMENTS

CN 86 1 03908 A 1/1987

(Continued)

OTHER PUBLICATIONS

Katsuhiko Ogata, SYSTEM DYNAMICS, 1992, Prentice Hall, Second Edition, Section 7-2, pp. 381-383.*
U.S. Appl. No. 11/377,378, filed Mar. 17, 2006, Endo.

*Primary Examiner*—Ismael Negron
(74) *Attorney, Agent, or Firm*—Oblon, Spivak, McClelland, Maier & Neustadt, L.L.P.

(57) ABSTRACT

An illuminated elevator lighting system including an elevator cage, a plurality of cold-cathode fluorescent lamps disposed on a ceiling surface of the cage and arrayed in parallel, a reflection plate which reflects an illumination light from the cold-cathode fluorescent lamp, and a stabilizer which lights the cold-cathode fluorescent lamp.

9 Claims, 27 Drawing Sheets

U.S. PATENT DOCUMENTS

| | | | | | |
|---|---|---|---|---|---|
| 4,126,210 | A | * | 11/1978 | Martin | 362/459 |
| 4,164,011 | A | * | 8/1979 | Sherwood | 362/148 |
| 4,425,603 | A | * | 1/1984 | Courson | 362/222 |
| 4,709,308 | A | * | 11/1987 | Makino | 362/148 |
| 4,749,061 | A | * | 6/1988 | Orndorff et al. | 362/150 |
| 5,145,247 | A | * | 9/1992 | Mandy | 362/148 |
| 5,228,769 | A | * | 7/1993 | Sommerrock et al. | 362/148 |
| 5,412,542 | A | | 5/1995 | Mandy | |
| 6,135,620 | A | * | 10/2000 | Marsh | 362/377 |
| 6,936,968 | B2 | * | 8/2005 | Cross et al. | 315/74 |

FOREIGN PATENT DOCUMENTS

| | | | |
|---|---|---|---|
| CN | 2141022 | Y | 8/1993 |
| CN | 2389417 | Y | 7/2000 |
| EP | 0570142 | | 11/1993 |
| EP | 1031527 | | 8/2000 |
| JP | 54-65171 | | 10/1977 |
| JP | 56-28839 | | 7/1981 |
| JP | 56-30313 | | 7/1981 |
| JP | 61-8676 | | 1/1986 |
| JP | 63-174376 | | 11/1988 |
| JP | 1-76877 | | 5/1989 |
| JP | 03211178 | | 9/1991 |
| JP | 3-72555 | | 11/1991 |
| JP | 4-41381 | | 2/1992 |
| JP | 4-121388 | | 4/1992 |
| JP | 04235886 | | 8/1992 |
| JP | 4-327476 | | 11/1992 |
| JP | 4-333479 | | 11/1992 |
| JP | 05162954 | | 6/1993 |
| JP | 5-254762 | | 10/1993 |
| JP | 5-319742 | | 12/1993 |
| JP | 6-6147 | | 2/1994 |
| JP | 6-290351 | | 10/1994 |
| JP | 7-99006 | | 4/1995 |
| JP | 7-112884 | | 5/1995 |
| JP | 7-55784 | | 6/1995 |
| JP | 7-74870 | | 8/1995 |
| JP | 7-228434 | | 8/1995 |
| JP | 7-245012 | | 9/1995 |
| JP | 8-17401 | | 1/1996 |
| JP | 8-171812 | | 7/1996 |
| JP | 9-12238 | | 1/1997 |
| JP | 2605569 | | 2/1997 |
| JP | 9-147802 | | 6/1997 |
| JP | 9-203582 | | 8/1997 |
| JP | 10-64685 | | 3/1998 |
| JP | 10-67479 | | 3/1998 |
| JP | 10-104623 | | 4/1998 |
| JP | 3051120 | | 5/1998 |
| JP | 11-11836 | | 1/1999 |
| JP | 11-193193 | | 7/1999 |
| JP | 11349259 | | 12/1999 |
| JP | 2000-238982 | | 9/2000 |
| JP | 2000-318935 | | 11/2000 |
| JP | 2000318935 | | 11/2000 |
| JP | 2001-14904 | | 1/2001 |
| JP | 2001-163538 | | 6/2001 |
| JP | 2001-272936 | | 10/2001 |
| JP | 2001-328786 | | 11/2001 |
| JP | 3084857 | | 12/2001 |
| JP | 2002-132193 | | 5/2002 |
| JP | 2002-220175 | | 8/2002 |
| JP | 2002-231486 | | 8/2002 |
| JP | 2002220175 | | 8/2002 |
| JP | 3346990 | | 9/2002 |
| KR | 1998-018645 | | 6/1998 |

* cited by examiner

ILLUMINATED ELEVATOR INCLUDING COLD-CATHODE FLOURESCENT LAMP

TECHNICAL FIELD

The present invention relates to a lighting system of an elevator.

The present invention relates to a hall lantern of an elevator which is disposed at, for example, a landing hall of the elevator to display a running situation such as a car arrival to a user of the elevator.

The present invention relates to a threshold structure of each of an elevator landing and a cage.

Additionally, the present invention relates to a lighting system in an elevator car.

Further, the present invention relates to a car exterior lighting system of an elevator.

The present invention relates to a lighting system of an elevator cage.

Furthermore, the present invention relates to a blackout lamp device of an elevator which is lit at the time of a blackout to illuminate the inside of a cage.

BACKGROUND ART

<Lighting System of Elevator>

Conventionally, a general fluorescent lamp (hot cathode-ray tube) for home use has been used for a lighting system installed on the ceiling of an elevator. This fluorescent lamp has characteristics that a life is shortened by repeated turning ON/OFF of the lighting system. It is because an excessive current is necessary at the starting time of the fluorescent lamp, and this excessive current damages a cathode.

Therefore, the fluorescent lamp starts to go off or flicker, which necessitates replacement.

When replacement is necessary, a maintenance engineer goes to the elevator, stops the elevator for a predetermined time to carry out maintenance work, and replaces the fluorescent lamp from the outside of the ceiling of the cage of the elevator. Incidentally, a life of the fluorescent lamp is about 6000 hours.

During such maintenance work, the entire elevator must be stopped, and it is very inconvenient for elevator users because the elevator cannot be used.

From the standpoint of safety, the maintenance engineer must carry out the maintenance work, and much time and labor are required even for only the replacement of the fluorescent lamp.

In the conventional hot-cathode fluorescent lamp, use of a starter generates a time lag between voltage application and lamp lighting. Thus, in order to prevent such a time lag, control is executed to open a front door a little while after the elevator moves to a floor from which it receives a call or the like.

As the lighting system, there is a cold-cathode fluorescent lamp as a compact fluorescent lamp used for a backlight of a personal computer or the like.

<Hall Lantern of Elevator>

Next, a conventional hall lantern of an elevator will be described.

FIG. 48 shows a landing hall of the elevator, a three-way frame 103 which comprises an elevator entrance 102 is installed on a wall body 101 of the landing hall, and a door device 104 is disposed on the entrance 102 to open/close the same. Then, for example, a hall lantern 105 is disposed on the upper side of the wall body 101 of the landing hall to be adjacent to the side of the three-way frame 103.

FIG. 49 is a sectional view of the hall lantern 105 cut along the line A-A of FIG. 48. This hall lantern 105 comprises a box 109 attached through a bracket 108 to the backside of the wall body 101. The box 109 is made of a metal such as a steel plate, and formed in a box shape having an opening 109*a* on one side face.

The box 109 is attached so that the opening 109*a* can be opposed to a through-hole 101*a* formed in the wall body 101. In the box 109, a phosphor 111 constituted of an incandescent lamp is disposed through a socket 110.

An illuminant 115 and a face plate 116 which are exposed to the landing hall are attached through a spring member 117 to the surface of the wall body 101 oppositely to the through-hole 101*a*. The illuminant 15 is made of a translucent synthetic resin such as an acrylic resin, and the face plate 116 is made of a stainless metal or the like. The face plate 116 is fitted to the outer periphery of the illuminant 115.

The spring member 117 is fixed to the face plate 116 by soldering or the like, inserted into the box 109, and press-fitted to the inner wall surface thereof. By this press-fitting force, the illuminant 115 and the face plate 116 are fixed to the surface of the wall body 101.

Before the elevator car arrives at the landing hall, the hall lantern 105 receives a signal from an elevator control panel (not shown) to emit a light from the phosphor 111, illuminates the illuminant 115 by the light, and notifies information thereof to passengers who wait for the arrival of the car at the landing hall.

However, in such a conventional hall lantern 105, the incandescent lamp is used as the phosphor 111. Consequently, its outside dimension is large, and the box 109 which houses the phosphor 111 is also large.

Since the phosphor 111 is an incandescent lamp, a large amount of heat is generated during its lighting, and luminance is high. Thus, a sufficiently large distance must be secured between the illuminant 115 and the phosphor 111 in order to prevent deformation or melting of the illuminant 115 caused by the heat or generation of an uneven light at the illuminant 115. The box 109 which houses the phosphor 111 must inevitably be enlarged, and it is difficult to make the box 109 compact and thin.

Therefore, when the box 109 is attached to the backside of the wall body 101, a beam structure of a building must be planned and designed minutely in detail in order to prevent mechanical interferences between a beam material (not shown) of the building at the backside and the box 109. Consequently, much time and labor are required.

In recent years, a tendency has been strengthened to desire white as an illumination color of the hall lantern 105. In this case, as the phosphor 111, use of a general white fluorescent lamp may normally be considered.

However, the general fluorescent lamp cannot be lit immediately because irregular flickering occurs during lighting. Generally, the hall lantern 105 notifies information to the passengers who wait for the arrival of the car at the landing hall by light flickering. Thus, in the general fluorescent lamp which irregularly flickers during lighting, it is impossible to employ a form of displaying information by regular flickering. This lamp cannot therefore be used as a phosphor of the hall lantern 105.

<Elevator Threshold>

In general elevator facilities, as shown in FIG. 50A, a hoist 1043 operated by a control panel 1042 is disposed on the uppermost portion of a hoistway 1041 which penetrates a plurality of floors of a building. Inside the hoistway 1041, a cage 1045 attached to a main rope 1044 which is suspended from the hoist 1043 to move, and a counter weight 1046 are disposed. By operating a call button disposed at each of floor landings 1047*a* to 1047*d*, or a destination floor specification button disposed in the cage 1045, the hoist 1043 is run and actuated through the control panel 1042 to transport passengers in the cage to upper and lower floors.

In such running of the elevator, as shown in FIG. 50B, there is a gap 1058 between a car threshold 1054 which is disposed at a car floor 1051 of the cage 1045 and which has a car groove 1053 to guide a car door 1052, and a landing threshold 1056 which is disposed at a landing 1047 and which has a landing groove 1057 to guide a landing door 1055, and a running state is changed by an increase/decrease in the number of passengers entering the cage or the number of floors to which the car moves during one traveling. Thus, the car threshold 1054 may be shifted from the landing threshold 1056 to cause landing of the cage 104 in a step generated state.

When the passengers enter/go out of the cage 1045, crutches, umbrella ferrules, high heels of shoes, etc., may get stuck in the gap 1058 between the car threshold 1054 and the landing threshold 1046, or the passengers may stumble on the step. Thus, there is a method for warning the passengers by illumination between the car threshold and the landing threshold.

Conventional light sources 1059*a*, 1059*b* for illumination between the car threshold and the landing threshold have been provided by arranging general fluorescent lamps, incandescent lamps or an array thereof.

In the conventional case of the general fluorescent lamp which is disposed to cause the passengers to recognize the gap or the generated step between the car threshold and the landing threshold by illumination between the car threshold and the landing threshold, a diameter of even a standard product is large, i.e., 34 mm, and remodeling and construction of car floor and landing floors become large in scale. In the general fluorescent lamp, an average life is short, i.e., 6000 hours, and not only maintenance and replacement require time and labor but also safety measures cannot be taken for the passengers when the lamp is unlit. Thus, there is a need to secure a maintenance system.

Furthermore, in the illumination by the array of incandescent lamps, the illumination is provided by the light sources arranged at random, and design is inferior. Thus, there is a problem in adoption.

<Lighting System in Elevator Car>

Next, description will be made of a conventional lighting system in an elevator car.

In the elevator, as shown in FIG. 51, an elevator car 1152 is arranged to be vertically moved in a hoistway 1151. This elevator car 1152 comprises a car floor 1153, a side plate 1154, a top plate 1155, a front door 1156, an end rail 1157 arranged between the upper portion of the front door 1156 and the top plate 1155, and a base 1158 attached between the car floor 1153 and the side plate 1154.

The elevator car 1152 is supported by an upright frame 1159 which is attached nearly in the center longitudinal direction of both side plates 1154 corresponding to left and right surface sides of the front door 56 side, a lower beam 1160 which is horizontally laid between the lower ends of both upright frames 1159, and an upper beam 1161 which is horizontally laid between the upper ends of both upright frames 1159, and suspended by a rope 1162.

In the elevator car 1152, a lighting system 1163 is attached to the top plate 1155 or the like in order to illuminate the inside of the elevator car. As shown in FIG. 52, the lighting system 1163 comprises a fluorescent lamp (hot cathode-ray tube) 1164 for general home use, a lamp box 1165 disposed to surround the fluorescent lamp 1164 except in a light irradiation direction, and an illumination plate 1166 arranged on the light irradiation direction side to transmit a light.

Incidentally, the aforementioned lighting system 1163 is generally attached to the top plate 1155. However, from the standpoint of securing various illumination effects, attaching of the lighting system to places other than the top plate 1155 in the elevator car is requested. In this case, however, the following problems arise.

(1) The fluorescent lamp (hot cathode-ray tube) 1164 for general home use becomes large overall including a stabilizer to light the fluorescent lamp 1164 because not only the fluorescent lamp itself is large but also an excessive current is necessary at the starting time of the fluorescent lamp. As a result, space of about 120 mm or higher is necessary in a depth direction of the lighting system 1163. However, when it is attached to a place other than the top plate 1155 as described above, e.g., to the side plate 1154 on the elevator backside, the attachment of the lighting system 1163 may be impossible if a gap W between the backside side plate 1154 and a wall of the hoistway 1151 is 120 mm or lower. An influence is large especially when the installed elevator car is renewed.

(2) The fluorescent lamp 1164 has characteristics that a life is shortened each time the lighting system 1163 is repeatedly turned ON/OFF. It is because the excessive current is necessary at the starting time of the fluorescent lamp as described above, and the excessive current damages a cathode. As a result, the fluorescent lamp 1164 for general home use is burned out about once every year. Each time, the maintenance engineer goes to the elevator, stops the elevator for a predetermined time to carry out maintenance work, and replaces the fluorescent lamp 1164.

Normally, however, when the lighting system 1163 is attached to the place other than the top plate 1155, since no maintenance space is secured, and replacement work of the fluorescent lamp 1164 takes a long time, the elevator must be stopped for a long time.

(3) For the lighting system, the cold-cathode fluorescent lamp is used as a compact fluorescent lamp for the backlight of a personal computer or the like. However, its attachment to the elevator car has not been devised yet.

Therefore, as described above, in the lighting system 1163 which uses the fluorescent lamp 1164, if it is attached to the place other than the top plate 1155 in the elevator car, the attachment may be impossible because of insufficient space. Even if it is attached, since maintenance space cannot be secured, the replacement work of the fluorescent lamp 1164 becomes difficult, which causes inconvenience that the elevator is stopped for a long time.

<Car Exterior Lighting System of Elevator>

Next, a conventional car exterior lighting system will be described.

Conventionally, as shown in FIG. 53, the car exterior lighting system of the elevator is constituted in such a manner that on an exterior panel 1253 outside a cage 1252 to which an observation window glass 1251 is attached, a box-shaped illumination casing 1256 in which an incandescent lamp or a fluorescent lamp (hot cathode-ray tube) 1254 is incorporated to become a light source inside, and an acrylic plate 1255 is arranged on a surface side to become a light emission section to transmit a light is disposed, and the fluorescent lamp 1254 or the like is lit to illuminate the outside through the acrylic plate 1255. A reference numeral 1257 denotes a hoistway pit, 1257 a landing floor, 1259 a hall door, 1260 a car door, 1261 a cage inner wall, 1262 a compensation rope, 1263 a compensation rope tension pulley, and 1264 a buffer.

Thus, the aforementioned car exterior light system generally carries out exterior illumination of the cage 1252 by almost exclusively using the incandescent lamp or the fluorescent lamp 1254 for general home use.

However, in the incandescent lamp or the fluorescent lamp 1254 for general home use, because of a large outside dimension and a large amount of generated heat, and from the standpoint of removing an uneven light transmitted through the acrylic plate 1255 or the like, a large distance must be set from the fluorescent lamp 1254 to the acrylic plat 1255 of the surface. Consequently, a depth dimension of the box-shaped illumination casing 1256 becomes large.

As a result, the outside dimension of the exterior panel 1253 becomes large, creating a possibility of interferences with the devices such as the compensation rope tension pulley 1263 in the hoistway pit. This may necessitate a change in device layout or design of the exterior panel 1253. The incandescent lamp or the fluorescent lamp 1254 for general home use has characteristics that a life is shortened each time it is repeatedly turned ON/OFF. It is because an excessive current is necessary at the starting time of the fluorescent lamp, and the excessive current damages a cathode. As a result, the fluorescent lamp for general home use is burned out about once every year. Each time, the maintenance engineer must go to the elevator installed site, and stop the elevator to carry out maintenance work. In the case of a long dimension in the pit height direction or in the case of a hoistway of no work footholds, time for stetting up a foothold or the like is necessary. If the number of elevators to be installed is large, replacement work must be frequently carried out.

Therefore, in the aforementioned car exterior lighting system of the elevator, because of the use of the incandescent lamp or the fluorescent lamp 1254 for general home use, a depth dimension of the box-shaped illumination casing 1256 becomes large, and thus a change must be made in device layout or design of the exterior panel 1253. Additionally, because of frequent replacement work of the lamp, maintenance costs become high, and running of the elevator must be stopped for each replacement work.

<Lighting System of Elevator Cage>

Next, description will be made of a conventional lighting system of an elevator cage.

In the elevator, the elevator cage is vertically moved through a suspended rope by a hoist disposed in a machine room of the hoistway upper portion. A user can move to a floor specified from the cage by depressing a call registration button of a previous floor in the cage or a call registration button of each floor landing to register a call.

In the elevator cage, a lighting system is generally disposed on a ceiling portion, and the inside of the cage is illuminated by the lighting system to secure safety and convenience. For this lighting system, a commercially available fluorescent lamp used at general home and facilities is used. However, because of a short life of the fluorescent lamp, replacement work must be frequently carried out.

Thus, in place of the fluorescent lamp, a cold-cathode fluorescent lamp of a small tube diameter of about 1 mm to 6 mm and long-life characteristics may be used as a light source of the lighting system.

The cold-cathode fluorescent lamp is used as a backlight of a liquid crystal device. However, as it is originally constituted to surface-illuminate a screen through an optical waveguide, even if it is directly used, an irradiation angle of the cold-cathode fluorescent lamp is small, and an uneven light is generated on the illumination plate surface.

<Blackout Lamp Device of Elevator>

Next, description will be made of a conventional blackout lamp device of an elevator.

Generally, in the elevator, a blackout lamp device is disposed to illuminate the inside of a cage by lighting at the time of a blackout. This blackout lamp device comprises a blackout lamp disposed on a ceiling section of the cage, and a blackout detector which detects the occurrence of a blackout and lights the blackout lamp by using a secondary battery at the time of the detection.

Brightness of the blackout lamp is stipulated by the law. Conventionally, however, since the blackout lamp is disposed on the ceiling portion of the cage, illuminance becomes short especially at the floor surface portion of the cage, i.e., at the foot portion of a passenger. At the time of a blackout, the foot portion is dark, and the passenger feels uneasier.

Furthermore, an operation panel is disposed in a part of the side face in the cage, and an interphone button operated in emergency is disposed together with a destination floor registration button and a door opening/closing button on the operation panel. Thus, illuminance for the operation panel also becomes short, and a position of the operation panel and a content of the button are difficult to be determined, which only confuses the passenger.

DISCLOSURE OF THE INVENTION

The present invention was made in view of the foregoing problems in the conventional art, and an object is to provide a lighting system of elevator which is prolonged in life to reduce maintenance work, and which has no problems to elevator users.

The present invention provides an elevator hall lantern which can be formed in a compact and thin structure and installed at a landing hall easily and efficiently, and which can easily realize irradiation with a white light.

An object of the present invention is to provide an elevator threshold which enables passengers to easily recognize a gap between a car threshold and a landing threshold, provides illumination by high illuminance to facilitate recognition of a generated step, illuminates a full width of a threshold to be easily seen in design, and secures safety of the passengers.

An object of the present invention is to provide a lighting system in an elevator cage which can reduce the number of times of replacing the lighting system in the elevator cage, and secure sufficient maintenance space.

An object of the present invention is to provide a car lighting system of an elevator which can reduce an exterior lighting dimension, prevent changes in device layout, and attach the exterior lighting even to a narrow exterior panel.

Another object of the present invention is to provide a car exterior lighting system of an elevator which prolongs an execution cycle of lamp replacement work, shortens work time, and reduces costs.

An object of the present invention is to provide a lighting system of an elevator cage which removes replacement work of a light source of the lighting system, and prevents generation of an uneven light on an illumination plate.

An object of the present invention is to provide a blackout lamp device of an elevator which effectively illuminates a required portion in a cage to soften anxiety of passengers, and enables clear recognition of a position of an operation panel and a content of a button.

In order to achieve the foregoing object, a lighting system of elevator of the present invention comprises a cage which a user can get on/off, and a cold-cathode fluorescent lamp which illuminates the inside of the cage.

A lighting system of elevator of the present invention comprises an elevator cage, a cold-cathode fluorescent lamp disposed on a ceiling of the cage, and a stabilizer which lights the cold-cathode fluorescent lamp.

A lighting system of elevator of the present invention is characterized by comprising a box having an opening on one side face, a phosphor which is constituted of a cold-cathode fluorescent lamp disposed in the box, and an illuminant disposed oppositely to the opening to direct a light of the phosphor to a landing hall of the elevator.

A lighting system of elevator of the present invention is characterized by comprising a first cold-cathode fluorescent lamp illuminator disposed in a side end of a hoistway side of a threshold of a landing entrance of each floor disposed in a hoistway in which a cage is vertically moved, and a second cold-cathode fluorescent lamp illuminator disposed in a side end of a threshold of an entrance of the cage opposite the threshold of the landing entrance. The first and second cold-cathode fluorescent lamp illuminators are arranged oppositely to the respective thresholds, and lit when the cage lands at the landing.

In order to achieve the foregoing object, a lighting system of elevator of the present invention is characterized by comprising a side plate which constitutes a part of the elevator car, and a lamp box which is attached to a surface portion of the side plate and which incorporates a cold-cathode fluorescent lamp and in which an illumination plate is disposed to transmit a light emitted from the cold-cathode fluorescent lamp toward the inside of the car.

According to the foregoing constitution of the present invention, compared with a conventional general fluorescent lamp, a use period of the cold-cathode fluorescent lamp can be extended, and the number of replacing times thereof can be greatly reduced. Moreover, since a diameter of the cold-cathode fluorescent lamp is very small, it can be made compact as a whole, and attached while maintenance space is secured even in a place in which the conventional general fluorescent lamp cannot be attached because of space.

The cold-cathode fluorescent lamp can be attached by using not only the side plate but also relatively small space of a joint of a base, an end rail and a side plate which constitute parts of the elevator cage. Thus, from the design standpoint of the elevator cage, various light effects can be provided.

In order to achieve the foregoing object, a lighting system of elevator of the present invention is constituted by disposing an exterior illuminator having a cold-cathode lamp to emit a light and an exterior casing having a light transmission section on a side facing the outside on an exterior panel covering the outside of the cage.

According to the aforementioned constitution of the present invention, for example, when the exterior illuminator is attached to the exterior panel on the bottom side of the cage, changes or the like in device layout of the hoistway pit can be prevented. When the exterior illuminator is attached to the exterior panel arranged on the side face of the cage, i.e., below the observation window, expansion of the hoistway is not necessary, and the exterior illuminator can be surely attached even to the exterior panel having narrow space.

A lighting system of elevator of the present invention comprises a plurality of lighting fixtures attached to a ceiling portion of the elevator cage, and an illumination plate disposed below to cover the plurality of lighting fixtures. The lighting fixtures are constituted by disposing a plurality of cold-cathode fluorescent lamps which are arranged in parallel, and reflection plates positioned above the cold-cathode fluorescent lamps, and arranged so that an interval between the cold-cathode fluorescent lamps of the adjacent lighting fixtures can be approximately equal to an interval between the plurality of cold-cathode fluorescent lamps disposed in each lighting fixture.

According to such a constitution, since the cold-cathode fluorescent lamps which are light sources for the plurality of lighting fixtures are arranged at equal intervals, and the illumination plate can be uniformly irradiated, no uneven light is generated on the illumination plate, and replacement work can be reduced by using characteristics of the long-life cold-cathode fluorescent lamps.

In this case, preferably, a rising piece is disposed on an edge of the reflection plate, and a height dimension of the rising piece is set shorter than a dimension from the reflection plate to a center of the cold-cathode fluorescent lamp.

A height dimension of a rising piece can be set so that an angle between a straight line which connects the center of the cold-cathode fluorescent lamp positioned in the vicinity of the rising piece to a tip of the rising piece and a straight line which connects the centers of the cold-cathode fluorescent lamps of the adjacent lighting fixtures to each other can be set equal to 54° or lower.

Further, a stabilizer can be integrally attached to the lighting fixture, and the stabilizer and an end of the cold-cathode fluorescent lamp can be covered with an insulator.

In the lighting fixture, the plurality of cold-cathode fluorescent lamps can be covered with an illumination plate constituted of a translucent synthetic resin.

A lighting system of elevator of the present invention is characterized by comprising an elevator cage, a blackout lamp disposed in at least one selected from a side plate portion of the cage, a base, and a bottom portion of an operation panel, and a blackout detector which detects a blackout, and lights the blackout lamp by using a battery device at the time of the detection.

A lighting system of elevator of the present invention is characterized by comprising an elevator cage, a blackout lamp disposed in at least one selected from a portion to illuminate a floor in the cage, a portion to illuminate an operation panel, and a portion to illuminate the entire section in the cage, and a blackout detector which detects a blackout, and lights the blackout lamp by using a battery device at the time of the detection.

Furthermore, a lighting system of elevator of the present invention is characterized by comprising an elevator cage, a blackout lamp disposed in each of a portion to illuminate a floor in the cage, a portion to illuminate an operation panel, and a portion to illuminate the entire section in the cage, a blackout detector which detects a blackout, and lights the blackout lamp by using a battery device at the time of the detection, and lighting means which enables selective lighting of the plurality of blackout lamps by using a commercial power source at the time of no blackout.

BEST MODE FOR CARRYING OUT THE INVENTION

<Elevator Lighting System>

A first embodiment of an elevator lighting system of the present invention will be described with reference to FIGS. 1 to 3.

Figure 1:
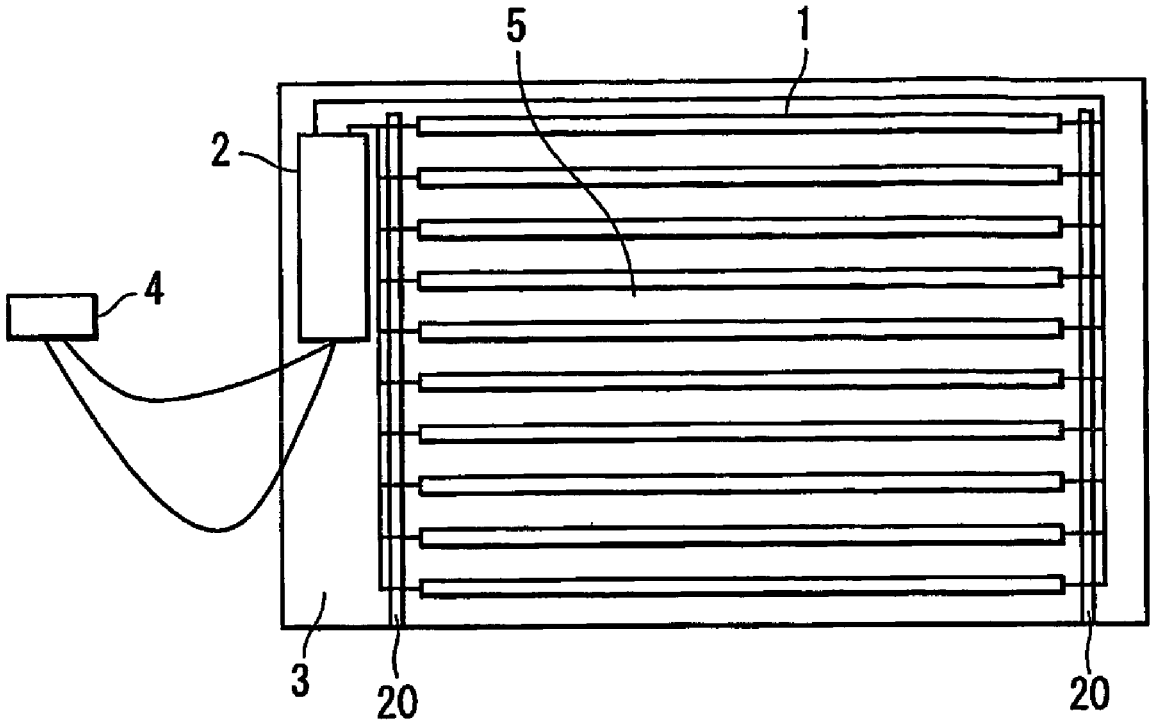
FIG. 1 is a front view of a lighting unit according to a first embodiment of a lighting system of an elevator of the present invention.
Figure 2:
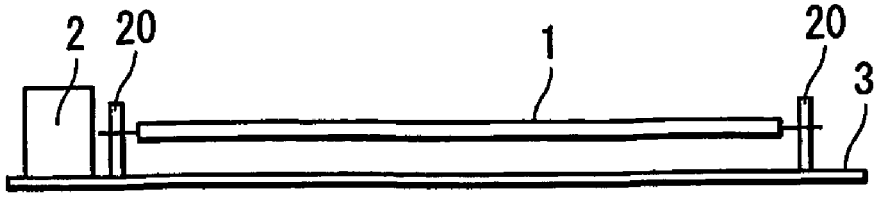
FIG. 2 is a side view of the lighting unit according to the first embodiment of the lighting system of the elevator of the present invention.
Figure 3:
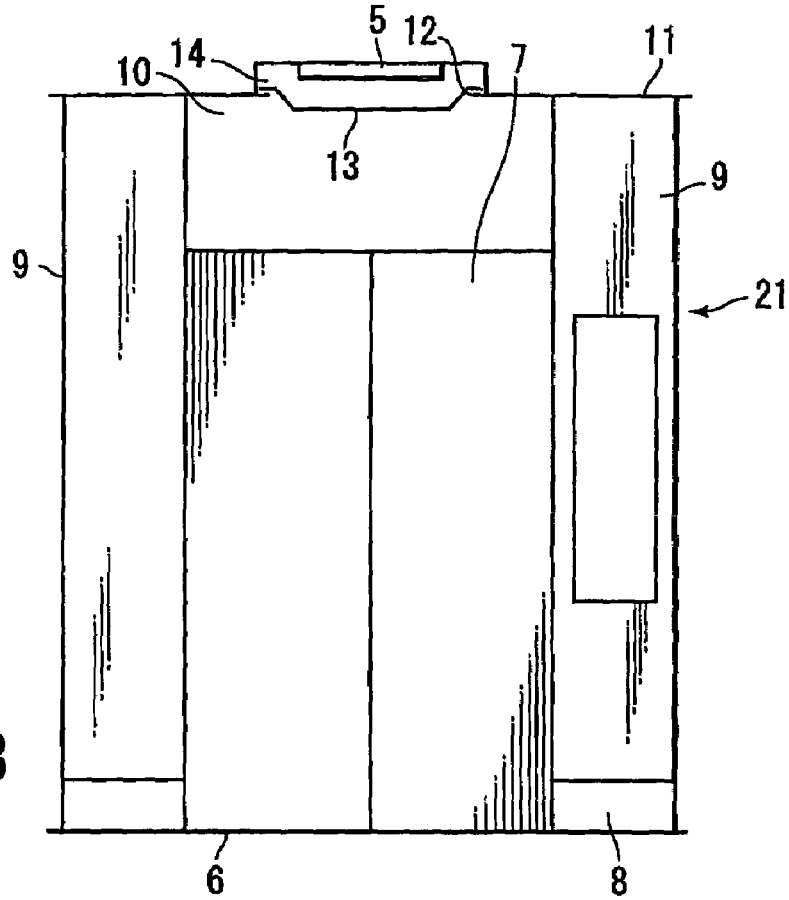
FIG. 3 is a front view of a cage according to the first embodiment of the lighting system of the elevator of the present invention.

FIG. 1 is a front view of the first embodiment of the elevator lighting system, FIG. 2 is a side view of the first embodiment of the elevator lighting system, and FIG. 3 is a front view of a car in which the elevator lighting system is arranged.

A lighting system 5 comprises at least ten straight-tube cold-cathode fluorescent lamps 1, a stabilizer 2 which lights the cold-cathode fluorescent lamp 1, a reflection plate 3 which reflects a visible light radiated from the cold-cathode fluorescent lamp 1, a connector 4 which supplies power to the stabilizer 2, and a support base 20 which supports the cold-cathode fluorescent lamp 1.

The cold-cathode fluorescent lamp 1 comprises at least a translucent discharge container having a diameter of about 1 mm to 6 mm, a pair of cold cathodes (not shown) sealed to both sides of the discharge container, a fluorescent material (not shown) coated on an inner surface of the discharge container, and a discharge medium (not shown) sealed in the discharge container. The cold-cathode fluorescent lamp 1 has characteristics that since the cold cathode emits lights without being heated, a life is not dependent on the number of ON/OFF times of illumination but decided simply by light emission time.

Additionally, the cold-cathode fluorescent lamp 1 has a feature that it is immediately lit when a high voltage is applied, and thus there is no time delay until light emission.

Support bases 20, 20 are installed in both ends of the reflection plate 3. A plurality of cold-cathode fluorescent lamps 1 are fixed in parallel to the support base 20. At this time, the plurality of cold-cathode fluorescent lamps 1 are arranged so as to be separated from each other by a predetermined distance and from the reflection plate 3 by a predetermined distance.

The stabilizer 2 which has, e.g., an inverter function, is arranged in the reflection plate 3. An end of each of the plurality of cold-cathode fluorescent lamps 1 is electrically connected to one end of the stabilizer 2, and the other end of the cold-cathode fluorescent lamp 1 is electrically connected to the other end of the stabilizer 2. For connection between the cold-cathode fluorescent lamp 1 and the stabilizer 2, for example, a terminal line of an end of the cold-cathode fluorescent lamp 1 and the stabilizer 2 are electrically connected to each other by soldering.

The stabilizer 2 is connected to the connector 4 to receive a supply of power.

The plurality of cold-cathode fluorescent lamps 1, the support base 20, the reflection plate 3 and the stabilizer 2 are integrally arranged to constitute one unit of a lighting system.

Next, a constitution of FIG. 3 will be described.

A cage 21 comprises a car floor 6, a front door 7, a base 8, a side plate 9, an end rail 10, and a top plate 11. A through-hole 12 is bored through the top plate 11, and a protection plate 13 made of, e.g., a light transmissive synthetic resin, to cover the through-hole 12. A box plate 14 roughly regular parallelepiped in shape is disposed outside the cage 21 to cover the protection plate 13. One unit (5) of a lighting system is arranged on a surface of the box plate 14 opposite the protection plate 13. A connector (not shown) of the lighting system is also arranged as occasion demands.

A bottom surface of the base 8 is fixed to the car floor 6, and an upper surface is fixed to the side plate 8. The side plate 9 is fixed to the top plate 11, and to an adjacent side plate. An upper surface of the end rail 10 is fixed to the top plate 11, and a side face is fixed to the side plate 8. The front door 7 is surrounded with the end rail 10, the side plate 19, the base 8 and the car floor 6, and can be opened/closed in a predetermined direction.

An operation of the first embodiment of the aforementioned constitution will be described.

Power is supplied from the connector 4 to the stabilizer 2, and a voltage current or the like is converted to become a desired value at the stabilizer 2. The converted voltage is applied to the plurality of cold-cathode fluorescent lamps 1 to radiate a light having a predetermined wavelength. A part of the radiated light is directly made incident on the protection plate 13, and another part of the light is radiated to the reflection plate 3 to be reflected thereon, and then made incident on the protection plate 13. Then, the light is transmitted through the protection plate 13 into the cage 21 to illuminate the inside thereof by predetermined illuminance.

According to the foregoing first embodiment, by using the cold-cathode fluorescent lamp 1 in the lighting system of the elevator, a life of the lighting system can be prolonged. Thus, it is possible to reduce maintenance work such as replacement of the lighting system by a maintenance engineer, and thus to suppress inconveniences to elevator users.

It is because different from the case of the conventional hot-cathode fluorescent lamp, the cold-cathode fluorescent lamp 1 has no cold cathodes which become high in temperature by a current. According to such a constitution, problems such as cathode disconnection never occur. While the hot-cathode fluorescent lamp has a life of about 6000 hours, the cold-cathode fluorescent lamp 1 has a life of about 50000 hours, and a length of its life is larger by about 10 times than that of the hot-cathode fluorescent lamp. Further, the life of the cold-cathode fluorescent lamp is not dependent on the number of ON/OFF times of illumination, which is one of the factors to achieve a long life. On the other hand, since the hot-cathode fluorescent lamp has characteristics that the life is shortened by the number of ON/OFF times of illumination, even if it has the life of about 6000 hours, the life becomes shorter as the number of ON/OFF times is increased.

If the cold-cathode fluorescent lamp 1 is always lit, a life of 50000 hours/24 hours/365 days=5.7 years can be obtained. Depending on ON/OFF operation of the lighting system of the elevator, for example, if the lighting system is not always lit (lit only during use), the life becomes much longer. Since the longer lifer of the lighting system enables reduction of maintenance inspection work for the lighting system of the elevator, there is a possibility that maintenance costs can be reduced.

Further, the capability of reducing the size of the cold-cathode fluorescent lamp 1 contributes to softening of design and installation conditions. It is because while the conventional hot-cathode fluorescent lamp has a diameter of about 34 mm, the lamp of the present invention has a very small diameter of about 1 to 6 mm, which is about ⅙. Because of the compact shape, the number of lamps, and a distance between each other can be set properly to obtain desired illuminance. A height of the box body 14 can be reduced, and a distance between the cold-cathode fluorescent lamp 1 and the protection plate 13 can be shortened. Thus, it is possible to miniaturize and thin the entire lighting system in the elevator cage.

Since installation conditions (distance etc.) of the cold-cathode fluorescent lamp 1 can be properly set, an uneven light which always becomes a problem in the lighting system can be suppressed, and it is possible to provide illumination of no uncomfortable feelings to elevator uses.

In one unit, the plurality of cold-cathode fluorescent lamps 1 are arranged. Thus, even if one of the lamps becomes a light nonemission state, recognition thereof by the users is difficult because the other cold-cathode fluorescent lamps 1 emit lights. Accordingly, it may be possible to delay replacement time of the cold-cathode fluorescent lamp 1 to be replaced.

Conventionally, the connection of the terminal of one cold-cathode fluorescent lamp 1 to the stabilizer 2 has been carried out manually such as by soldering. However, because of the formation of one unit, replacement can be carried out by a unit, and thus work time can be reduced, and safety during replacement work can be improved.

Furthermore, the door can be quickly opened after the cage lands at a floor from which a call is made. This is because time until a voltage is applied to the cold-cathode fluorescent lamp 1 to emit a light is very short compared with the conventional case.

Next, description will be made of a constitution of a second embodiment of a lighting system of an elevator of the present invention by referring to FIG. 4.

In the embodiment described below, components similar to those of the first embodiment are denoted by similar reference numerals, and overlapped description will be omitted.

Figure 4:
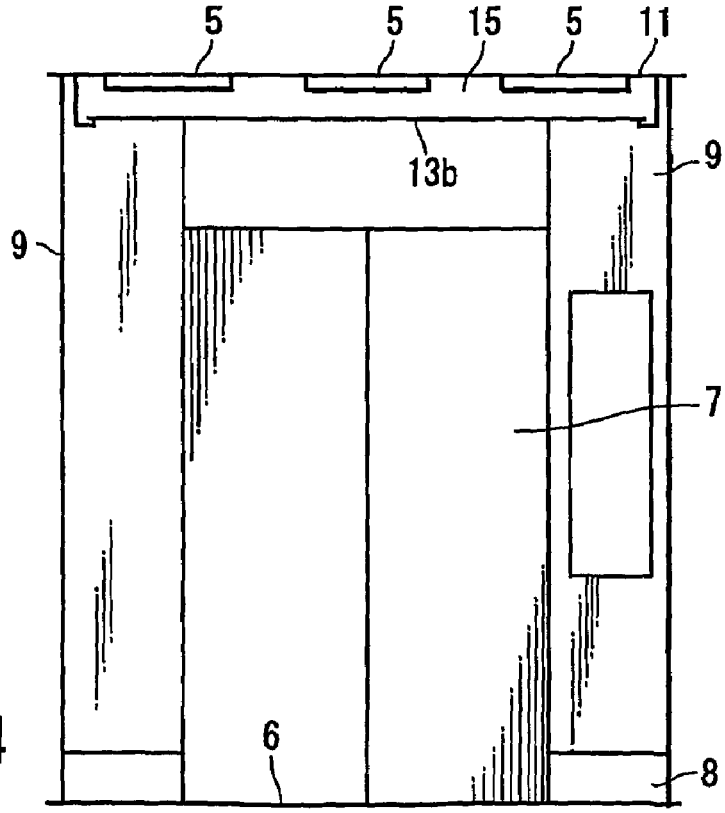
FIG. 4 is a front view of a cage according to a second embodiment of a lighting system of an elevator of the present invention.

As shown in a front view of FIG. 4, a luminous ceiling 15 is disposed to radiate a light from a roughly full surface of a ceiling of a cage. An illumination plate 13*b* is disposed below the luminous ceiling 15. In this ceiling plate 15, a plurality of lighting units 5 are arranged to match a shape of the illumination plate 13*b*.

According to this constitution, effects similar to those of the first embodiment can be obtained.

Figure 5:
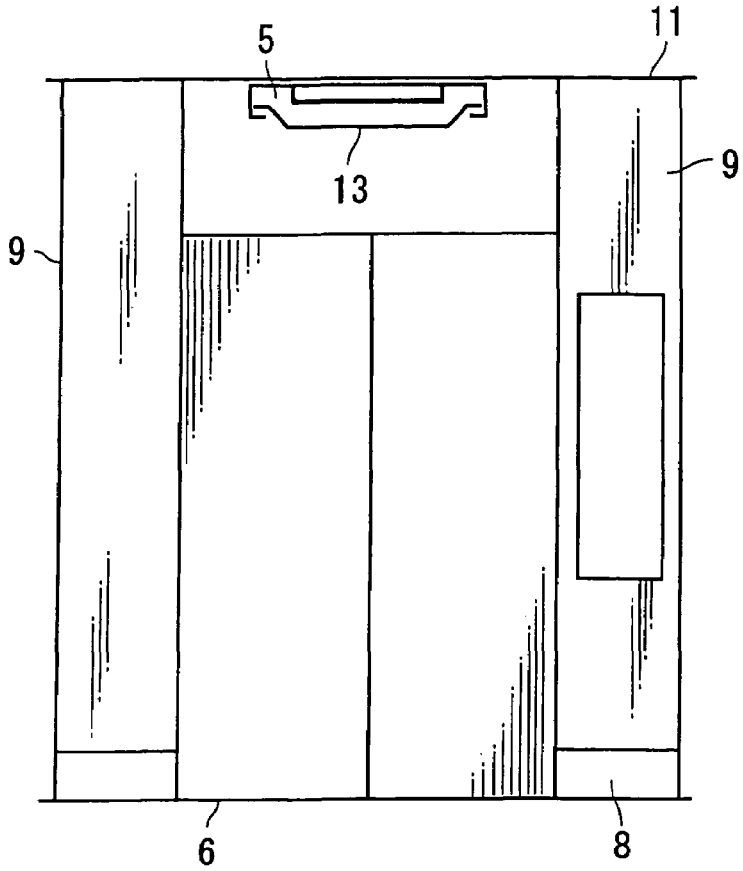
FIG. 5 is a front view of a cage according to a third embodiment of a lighting system of an elevator of the present invention.

Next, description will be made of a third embodiment of a lighting system of an elevator of the present invention by referring to a front view of FIG. 5.

A feature of the third embodiment is that a lighting unit 5 is directly attached to a top plate 11.

The lighting unit 5 is fixed to the top plate 11.

According to such a constitution, effects similar to those of the first embodiment can be obtained.

Since the lighting unit 5 does not project from the top plate 11 to the outside of a cage, it is possible to reduce top clearance which is a distance between the cage and a ceiling of a hoistway. Since there is no projected portion on the cage, design of car appearance can be improved.

Figure 6:
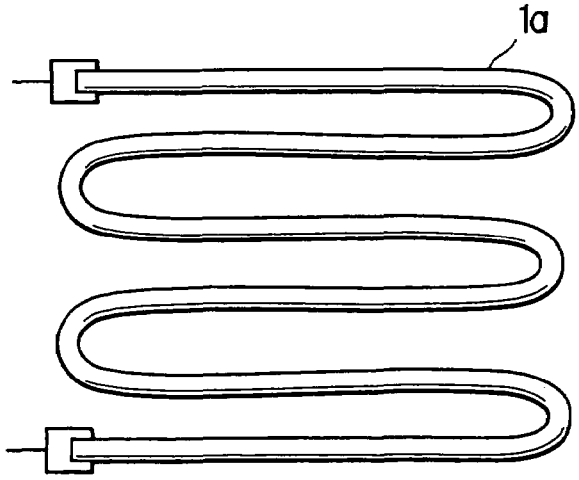
FIG. 6 is a plan view of a lighting unit according to a fourth embodiment of a lighting system of an elevator of the present invention.

Next, description will be made of a fourth embodiment of a lighting system of an elevator of the present invention by referring to a plan view of FIG. 6.

A cold-cathode fluorescent lamp 1*a* is a meandering type (combination of U shapes). According to such a constitution, an optimal shape can be formed properly by matching a dimension during attaching with a size of a ceiling of a cage or the like, and design can be improved.

Figure 7:
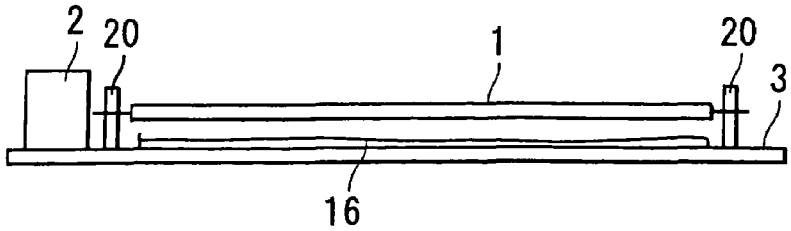
FIG. 7 is a side view of a lighting unit according to a fifth embodiment of a lighting system of an elevator of the present invention.

Next, description will be made of a lighting system of an elevator according to a fifth embodiment of the present invention with reference to FIGS. 7 to 9.

According to the embodiment, heat-retention means 16 is disposed adjacently to a cold-cathode fluorescent lamp 1 to keep the cold-cathode fluorescent lamp 1 warm. This heat-retention means 16 has a function of setting the cold-cathode fluorescent lamp 16 at a normal temperature, e.g., 25° C.

Figure 8:
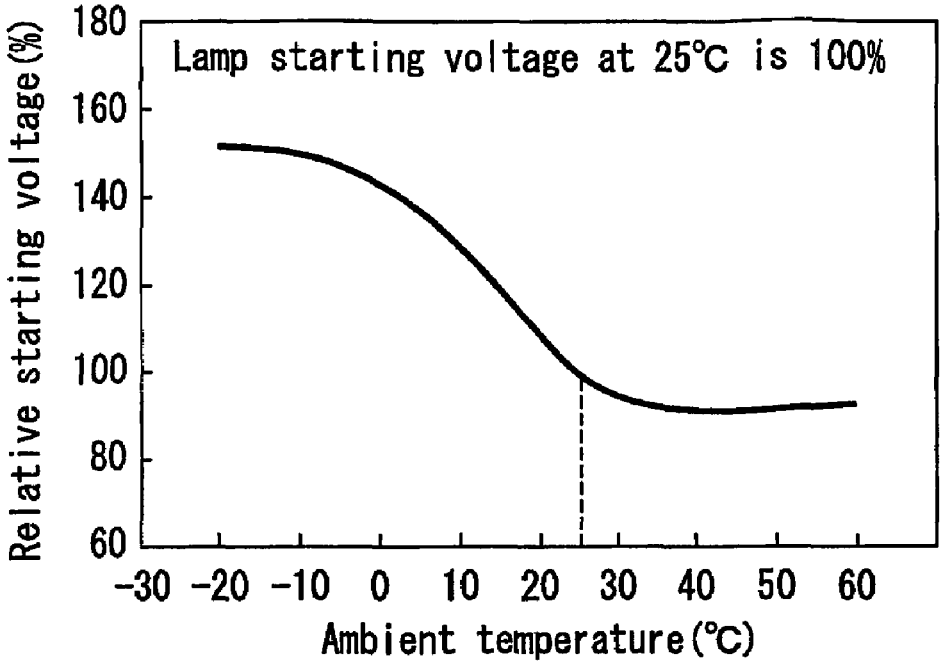
FIG. 8 is a graph showing a relation between an ambient temperature of a cold-cathode fluorescent lamp used by the present invention and a lamp starting voltage.

In the cold-cathode fluorescent lamp 1, as shown in FIG. 8, a starting voltage of the lamp becomes low around 25° C. If lower than 25° C., the starting voltage is increased to make lighting of the lamp difficult.

Figure 9:
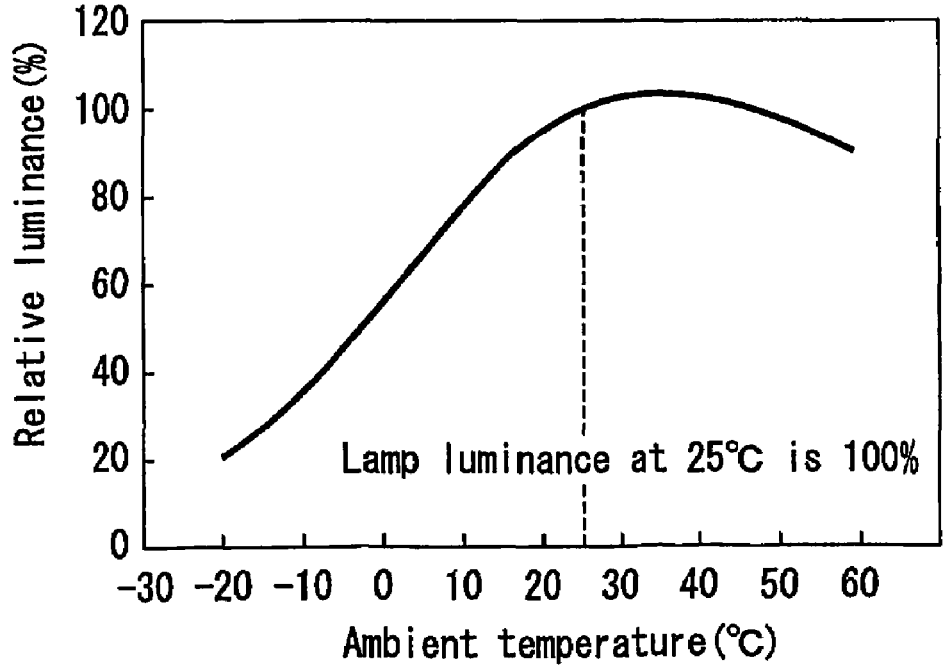
FIG. 9 is a graph showing a relation between an ambient temperature of the cold-cathode fluorescent lamp used by the present invention and lamp luminance.

As shown in FIG. 9, luminance of the cold-cathode fluorescent lamp 1 becomes maximum around 25° C. If lower than 25° C., the luminance is reduced to make it impossible to obtain proper illuminance in the elevator.

Thus, according to the third embodiment, the heat-retention means 16 is disposed to keep the cold-cathode fluorescence lamp warm.

Further, if the heat-retention means for keeping the cold-cathode fluorescent lamp warm is disposed, lighting of the cold-cathode fluorescent lamp is facilitated, and instantaneous lighting can be carried out. Since output characteristics of the lamp, i.e., a light output from the lamp, can be increased, a power saving effect can be obtained.

The present invention is not limited to the aforementioned embodiments and, needless to say, various changes can be made. For example, any number of cold-cathode fluorescent lamps may be set as long as desired illuminance can be obtained. The plurality of cold-cathode fluorescent lamps may be arranged apart from one another by any distances or from the reflection plate by any distances.

According to the present invention, since the cold-cathode fluorescent lamp is used, and the lamp life is very long, e.g., 50000 hours, the number of times that the lamp becomes inoperable while the elevator still has a life is 1/10 compared with that of the conventional hot-cathode fluorescent lamp, and costs of lamp maintenance can be greatly reduced.

If the cold-cathode fluorescent lamp, the reflection plate and the stabilizer are formed in a unit by using the characteristics that the life of the cold-cathode fluorescent lamp is long, maintenance work can executed very easily in addition to a reduction in the number of maintenance times.

Similar effects can be obtained when the present invention is applied to an exterior lighting system of an elevator cage for observation.

As described above, according to the present invention, by prolonging the life of the lighting system, the number of maintenance times can be reduced, and an elevator which gives no inconveniences to users can be provided.

<Hall Lantern of Elevator>

Next, the embodiment of the present invention will be described with reference to FIGS. 10 to 19. Portions corresponding to those of the conventional constitution are denoted by similar reference numerals, and overlapped description will be omitted.

Figure 10:
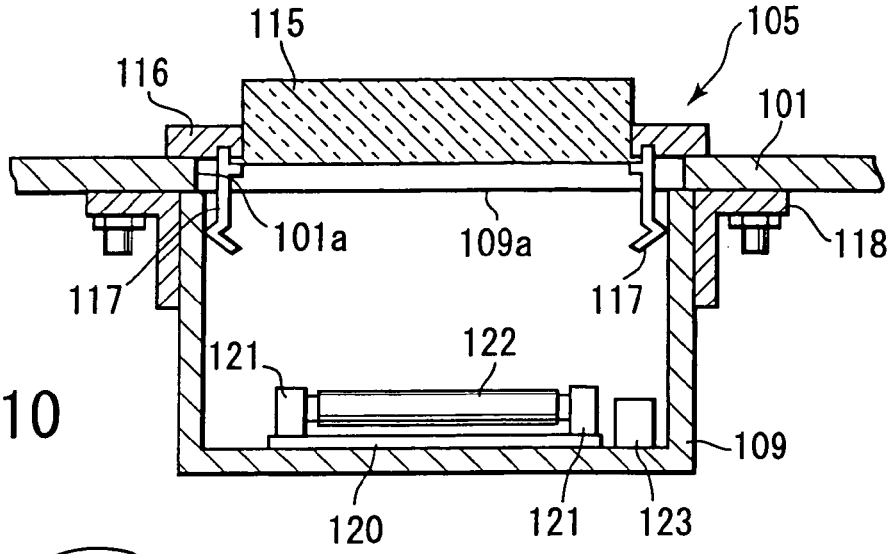
FIG. 10 is a sectional view of a hall lantern according to a first embodiment of the present invention.

FIG. 10 shows a first embodiment, and a thickness of a box 109 attached through a bracket 8 to the backside of a wall body 101 is sufficiently smaller than that in the conventional case.

A base 120 is attached to a wall surface in the box 109, a pair of opposing brackets 121 constituted of electric insulators are attached on the base 120, and a phosphor 122 constituted of a straight-tube cold-cathode fluorescent lamp is laid between the brackets 121 to face an illuminant 115.

A stabilizer 123 is attached side by side with the base 120 to the wall surface in the box 109. This stabilizer 123 is electrically connected to the phosphor 122 and an elevator control panel (not shown).

The cold-cathode fluorescent lamp as the phosphor 122 comprises a translucent discharge container having a diameter of about 1 to 6 mm, a pair of cold cathodes (not shown) sealed to both ends of the discharge container, a fluorescent material (not shown) coated on an inner surface of the discharge container, and a discharge medium (not shown) sealed in the discharge container.

One of the features of the cold-cathode fluorescent lamp is that since the cold cathode emits lights without being heated, a life is long, the life is not dependent on the number of ON/OFF times different from a general fluorescent lamp (hot-cathode fluorescent lamp), it is immediately lit when a high voltage is applied, and thus there is no time delay until light emission.

In such a hall lantern 105, since the phosphor 122 is a cold-cathode fluorescent lamp, almost no heat generation occurs during lighting. Thus, the illuminant 115 and the phosphor 122 are brought close to, or into contact with each other, there are no problems such as heat deformation or melting in the illuminant 115. Therefore, the box 109 car be made compact in which its thickness is sufficiently small. A shape of the cold-cathode fluorescent lamp as the phosphor 122 is small itself compared with an incandescent lamp. Thus, the box 109 can be made more compact.

Incidentally, a thickness must be set to about 150 to 200 mm in the conventional box 109. In the box 109 of the embodiment, however, a thickness can set small, about 20 to 30 mm.

Accordingly, when the box 109 is attached to the backside of the wall body 101, design planning to prevent mechanical interferences between a beam (not shown) of a building at the backside thereof and the box 109 is facilitated, and execution during its attachment is facilitated.

The cold-cathode fluorescent lamp as the phosphor 122 can emit a white light. It can be immediately lit in accordance with application of a voltage. Thus, the hall lantern of a white light can be easily provided. A form can be easily employed in which a light is flashed ON/OFF regularly based on control by the control panel, and information is notified to passengers waiting for car arrival at the landing hall.

The number of phosphors 122 (cold-cathode fluorescent lamps) in the box 109 may be singular or plural. If a plurality of phosphors 122 are used, it is possible to reduce an uneven light at the illuminant 115.

Figure 11A:
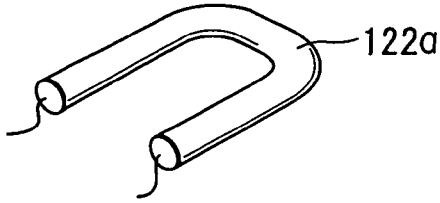
FIGS. 11A and 11B are perspective views showing a modified example of a cold-cathode fluorescent lamp used as a phosphor of the hall lantern.
Figure 11B:
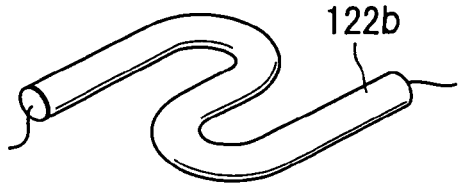

According to the aforementioned first embodiment, the straight-tube cold-cathode fluorescent lamp is used as the phosphor 122. However, a cold-cathode fluorescent lamp bent in a U shape 122*a* can be used as shown in FIG. 11A, and a cold-cathode fluorescent lamp or the like bent in an S shape 122*b* can be used as shown in FIG. 11B.

In the case of using the U-shaped or S-shaped cold-cathode fluorescent lamp, a light emission interval becomes long. Thus, illumination efficiency can be increased, and an uneven light can be reduced more by a smaller number of lamps.

Figure 12A:
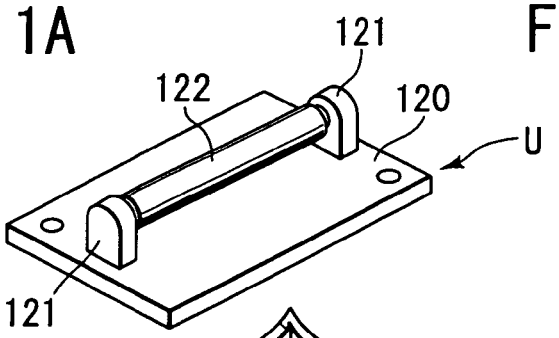
FIGS. 12A and 12B are perspective views showing a second embodiment of the present invention.
Figure 12B:
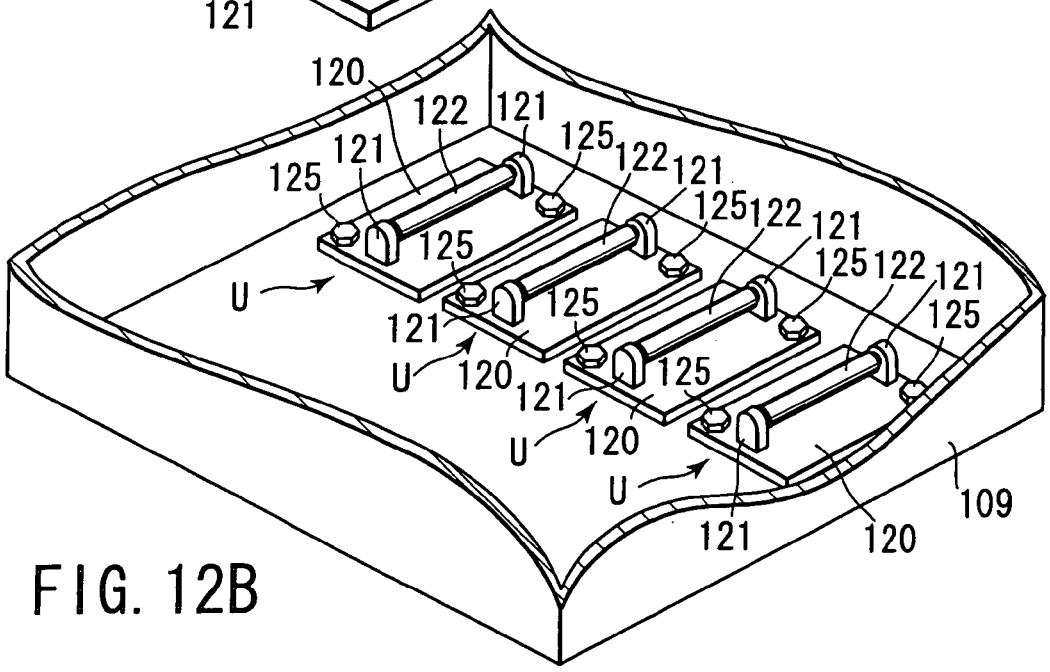

FIGS. 12A and 12B show a second embodiment. According to the embodiment, as shown in FIG. 12A, an integral phosphor unit U is constituted beforehand of a base 120, a pair of brackets 121 attached on the base 120 oppositely to each other, and a phosphor 122 constituted of a cold-cathode fluorescent lamp which is laid between the brackets 121.

As shown in FIG. 12B, the necessary number of phosphor units U can be attached through fastening tools 25 such as bolts to the inner wall surface of a box 109.

Various specifications of hall lanterns 105 are employed for design of landing halls, and the shape of the box 109 accordingly varies. According to the embodiment, however, the necessary number of phosphors 122 can be arranged in the box 109 just enough in accordance with a change in the shape of the box 109.

In the case of disposing the plurality of phosphors 122 (cold-cathode fluorescent lamps) in the box 109, a constitution can be employed in which some of the phosphors 122 are set as normally used light sources, the remaining phosphors 122 are set as spare light sources and, when the normally used phosphors 122 (cold-cathode fluorescent lamps) come to the ends of lives, energization circuits are switched to the spare phosphors 122 (cold-cathode fluorescent lamps), and the spare phosphors 122 are lit thereafter.

In such a case, replacement of the phosphors 122 which have come to the ends of lives is unnecessary, a phosphor replacement free hall lantern 105 can be provided, and maintainability can be improved.

Figure 13:
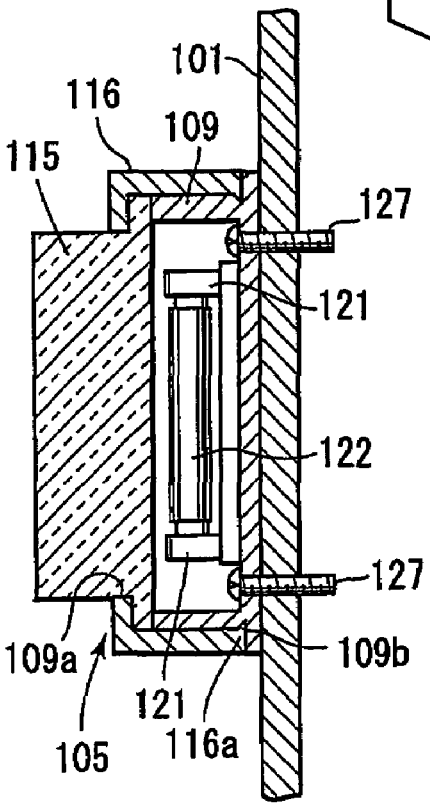
FIG. 13 is a sectional view showing a third embodiment of the present invention.

FIG. 13 shows a third embodiment. According to the embodiment, a box 109 made thin is attached through bolts 27 as fastening tools to a surface of a wall body 101.

A base 120 is attached to the inner wall surface of the box 109, a pair of brackets 121 are attached on the base 120 oppositely to each other and, between the brackets 121, a phosphor 122 which becomes a cold-cathode fluorescent lamp is laid so as to be brought oppositely close to an illuminant 115.

The illuminant 115 is fastened through a face plate 116 made of a stainless metal or the like to an opening 109*a* on the front of the box 109. The face plate 116 is fitted to an outer periphery of the box 109, and it has a claw 116*a* in its inner peripheral edge. This claw 116 is engaged with a groove 109*b* formed in the outer peripheral surface of the box 109 to prevent pulling-out of the face plate.

In this hall lantern 105, a thickness of the box 109 is sufficiently small and, even if the box 109 is exposed to the surface of the wall body 101, no design problems occur. Because of the constitution in which the box 109 is attached to the surface of the wall body 101, formation of a large through-hole in the wall body 101 is unnecessary, and only a small hole (not shown) for wiring needs to be formed. The box 109 can be attached from the surface side of the wall body 101, i.e., the landing hall side, and it is not necessary for a worker to enter a hoistway on the backside of the wall body 101. Accordingly, attaching work can be easily, efficiently and safely carried out.

Furthermore, since the box 109 is disposed on the surface of the wall body 101, replacement work of the phosphor 122 inside can be carried out easily, efficiently and safely from the surface side of the wall body 101.

Figure 14A:
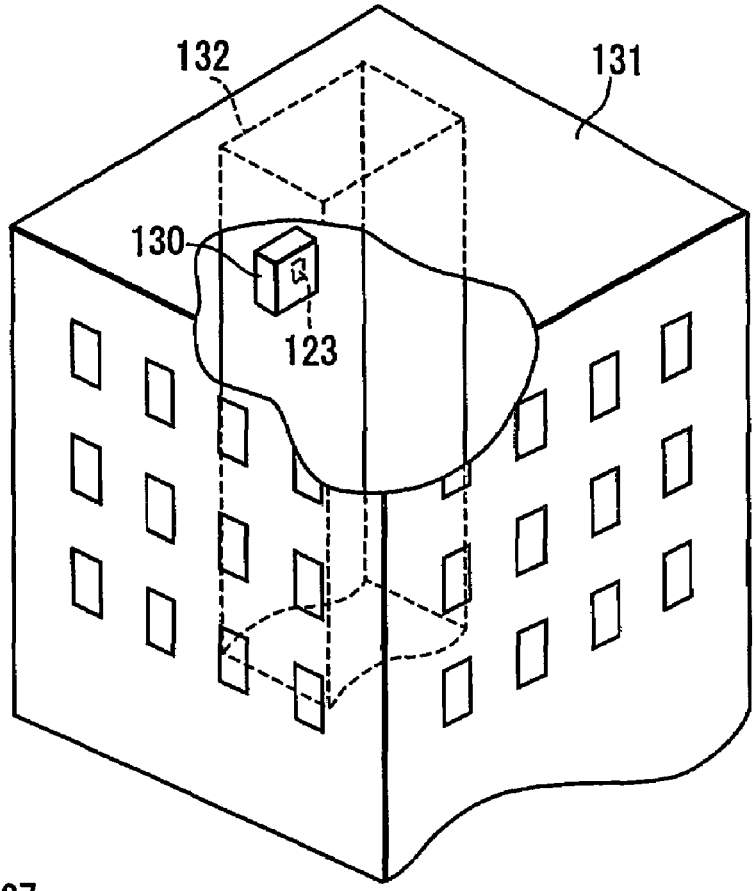
FIGS. 14A and 14B are explanatory views showing a fourth embodiment of the present invention.
Figure 14B:
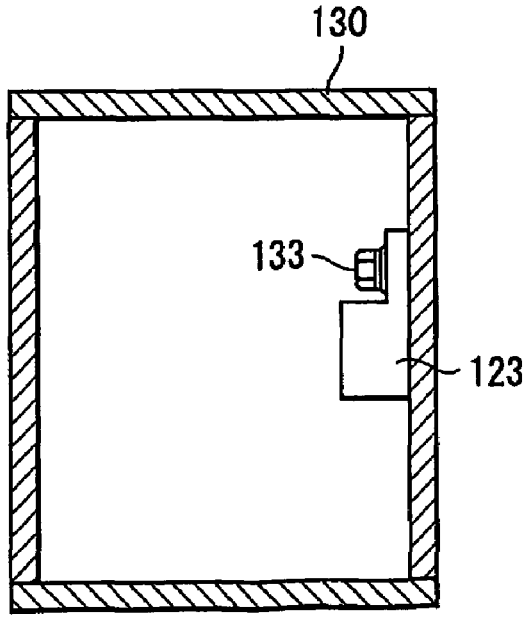

FIGS. 14A and 14B show a fourth embodiment. According to the embodiment, a stabilizer 123 which lights an illuminant of a hall lantern is disposed in an elevator control panel 130. The control panel 130 is made of a steel plate or the like, and formed in a box shape. As shown in FIG. 14A, it is installed in the midway of an elevator hoistway 132 disposed in a building 131.

As shown in FIG. 14B, a stabilizer 123 is attached through a fastening tool 33 such as a bolt in the control panel 130. This stabilizer 123 is connected through a wire harness to a phosphor (cold-cathode fluorescent lamp) in a hall lantern disposed at an elevator landing hall.

Thus, by disposing the stabilizer 123 in the control panel 130, a constitution of the hall lantern can be simplified, and the degree of designing freedom of the hall lantern can be increased. By installing the stabilizer 123 in the control panel 130, maintenance of the stabilizer 123 can be easily carried out.

Figure 15:
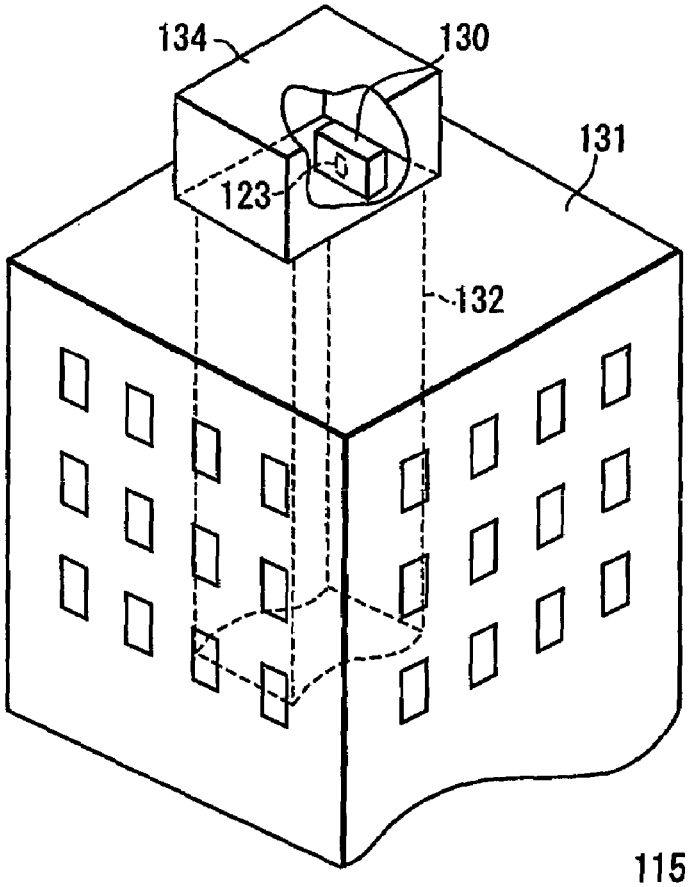
FIG. 15 is an explanatory view showing an example in which a stabilizer for lighting the phosphor of the hall lantern is disposed in a control panel installed in a machine room of an elevator.
Figure 16:
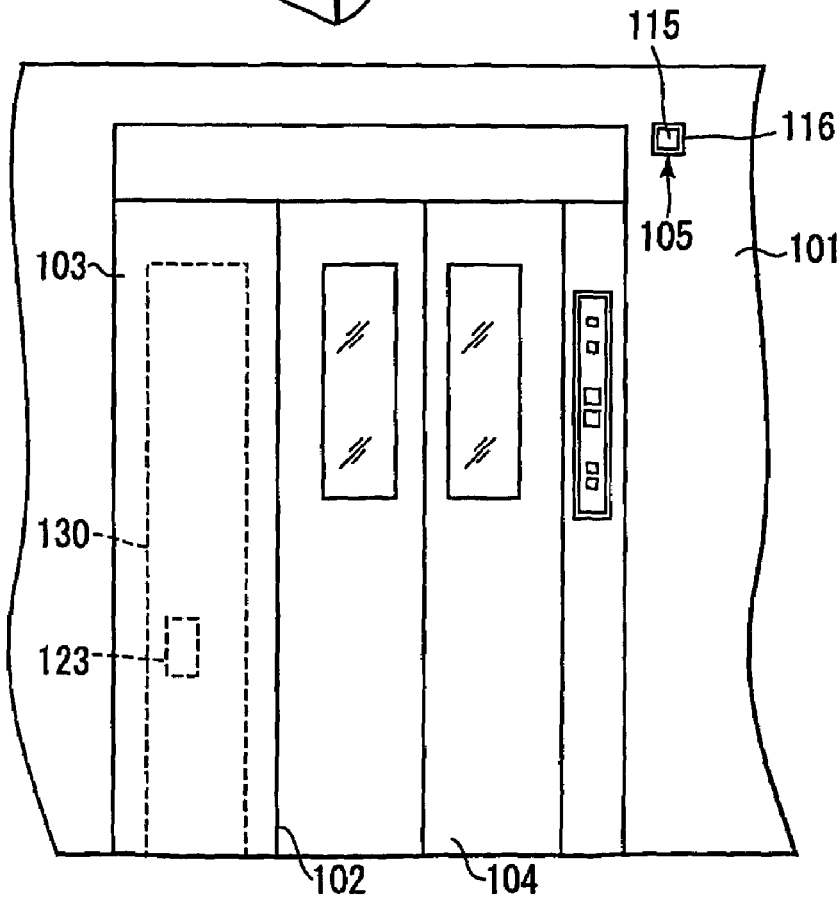
FIG. 16 is an explanatory view showing an example in which the stabilizer for lighting the phosphor of the hall lantern is disposed in the control panel installed inside a three-way frame of the elevator.

The control panel 130 may be installed in a machine room 134 disposed on a rooftop of the building 131 as shown in FIG. 15, or inside a three-way frame 3 at the landing hall as shown in FIG. 16.

Figure 17:
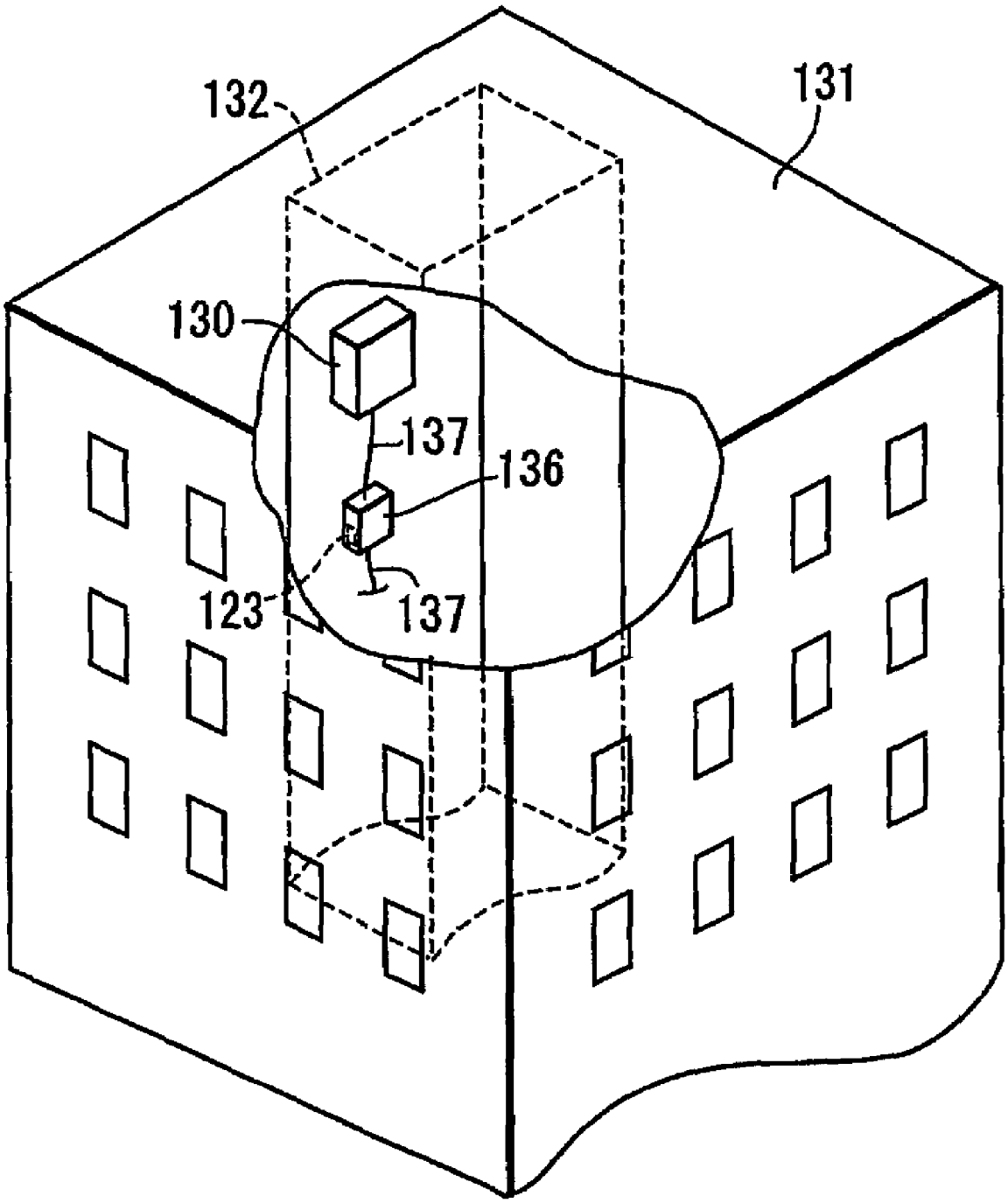
FIG. 17 is an explanatory view showing an example in which the stabilizer for lighting the phosphor of the hall lantern is stored in a box separate from the control panel in a hoistway of the elevator.

FIG. 17 shows a fifth embodiment. According to the embodiment, a control panel 130 is installed in a hoistway 132 of a building 131. Separately from the control panel 130, a box 136 made of a steel plate or the like and formed in a box shape is attached through an anchor (not shown) to a position near an elevator landing hall in the midway of the hoistway 132, and a stabilizer 123 is stored in the box 136.

The stabilizer 123 stored in the box 136 is connected through a wire harness 137 to the control panel 130 and a phosphor (cold-cathode fluorescent lamp) of a hall lantern.

According to such a constitution, since the stabilizer 123 is disposed in the box 136 separate from the control panel 130, and this box 136 is installed in the position near the elevator landing hall in the midway of the hoistway 132, the stabilizer 123 and the phosphor (cold-cathode fluorescent lamp) of the hall lantern are arranged close to each other. There are advantages that a voltage reduction can be prevented, efficiency can be increased, and energy can be saved.

In the foregoing description, the hall lantern is disposed in the wall body of the landing hall. However, it may be disposed in a wall surface of the three-way frame or the like.

Figure 18:
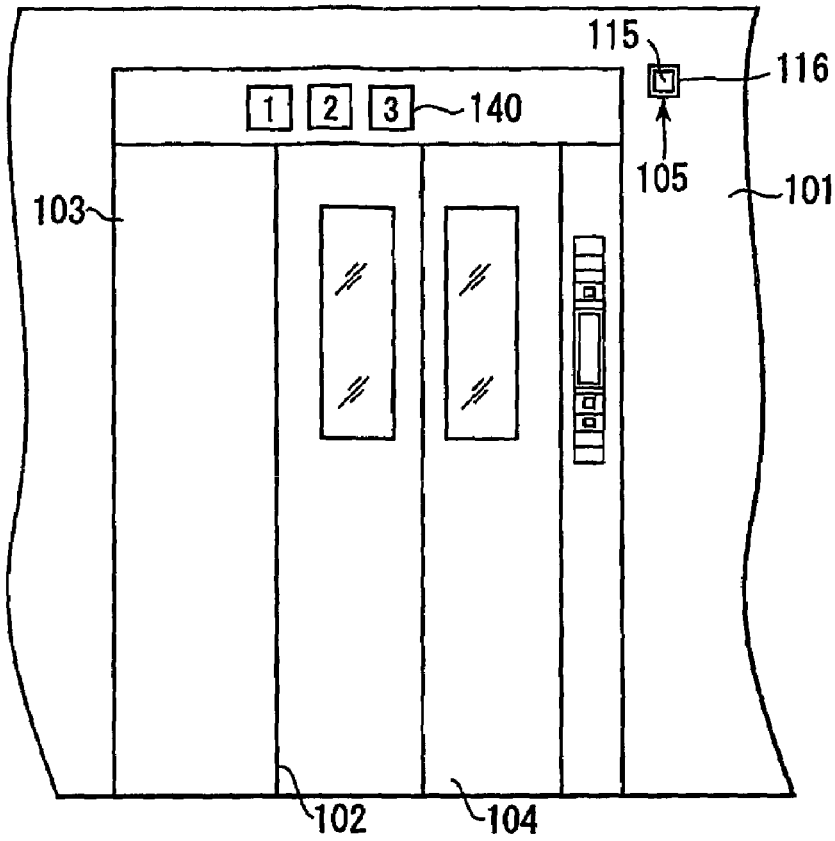
FIG. 18 is an explanatory view showing an example in which the cold-cathode fluorescent lamp is used as a phosphor of a hall indicator.
Figure 19:
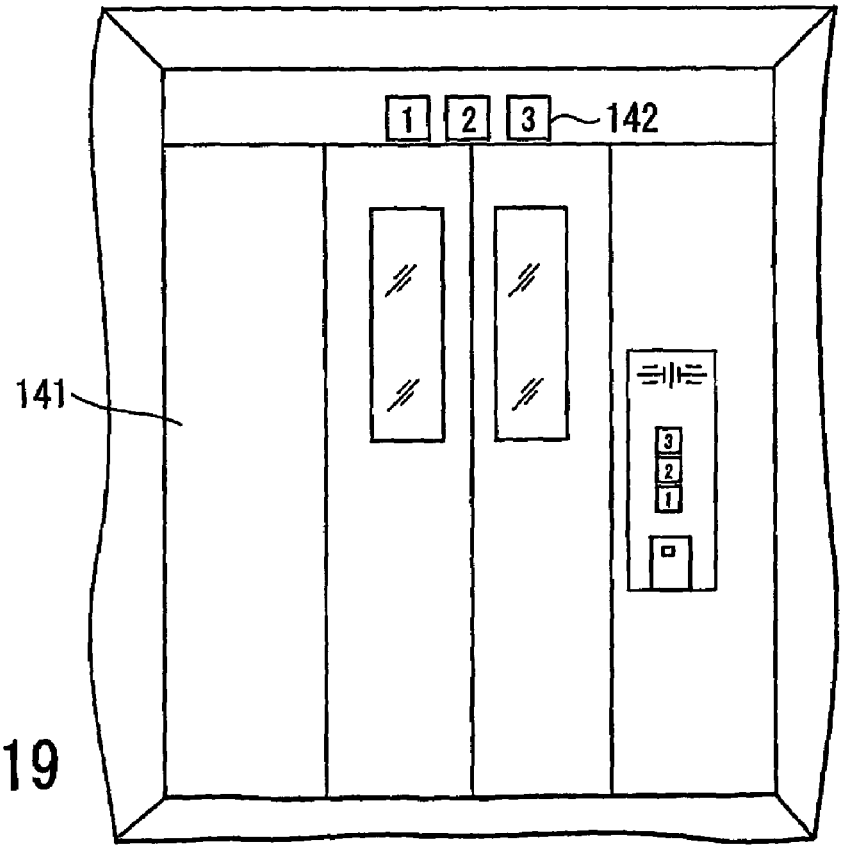
FIG. 19 is an explanatory view showing an example in which the cold-cathode fluorescent lamp is used as a phosphor of a hall indicator of a cage.

The cold-cathode fluorescent lamp can be used as a phosphor of a dot type hall indicator 140 disposed in a three-way frame 103 as shown in FIG. 18, or as a phosphor of a dot type car indicator 142 disposed in a cage 141 as shown in FIG. 19.

In each of the aforementioned embodiments, the cold-cathode fluorescent lamp is used as the light source of the phosphor. However, in place of the cold-cathode fluorescent lamp, an LED (light emitting diode) or organic EL (electroluminescence) can be used. In such a case, for example, a plurality of white LED or organic EL elements are mounted to a holder or the like of a proper shape to form a bar-shaped, ring-shaped or two-dimensional planar phosphor, and this phosphor is housed in a box to constitute a hall lantern. By using one LED or organic EL element, a bar-shaped, ring-shaped or two-dimensional planar phosphor can be formed.

In the box, only an LED may be housed as a light source, only organic EL may be housed, or proper numbers of LED and organic EL elements may be combined to be housed.

The use of the LED or the organic EL is not limited to the white color. Other colors can be used in accordance with an installation place of the hall lantern, a surrounding environment, the amount of light, a use time zone, a use season etc. Pluralities of color LED and organic EL elements can be mixed to be used. Further, a cold-cathode fluorescent lamp can be housed as a light source together with the LED or the organic EL in the box to constitute a hall lantern.

Furthermore, needless to say, as means for emitting a light from the LED or the organic EL, a driving control device which has conventionally been used generally is used.

As described above, according to the present invention, it is possible to provide an elevator hall lantern which can be constituted in a compact and thin structure, easily and efficiently installed at the landing hall, and capable of easily realizing white illumination.

<Elevator Threshold>

Next, detailed description will be made of the embodiment of an elevator threshold of the present invention with reference to the accompanying drawings.

Figure 20A:
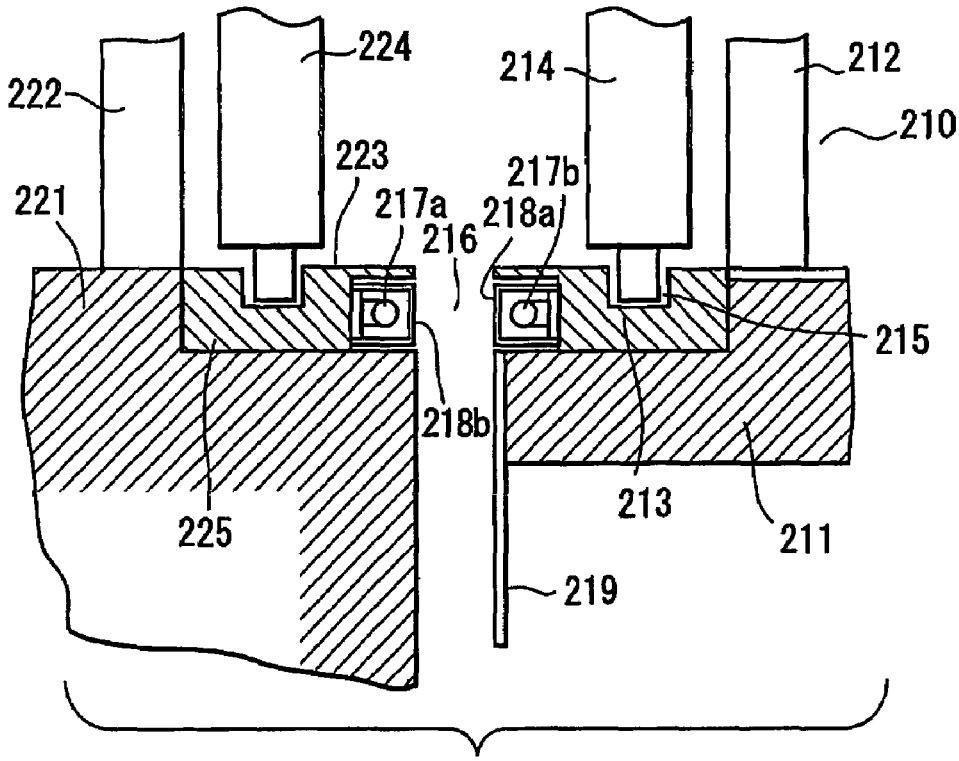
FIGS. 20A and 20B are conceptual views of an elevator threshold showing a constitution and an operation of a first embodiment of the present invention.
Figure 20B:
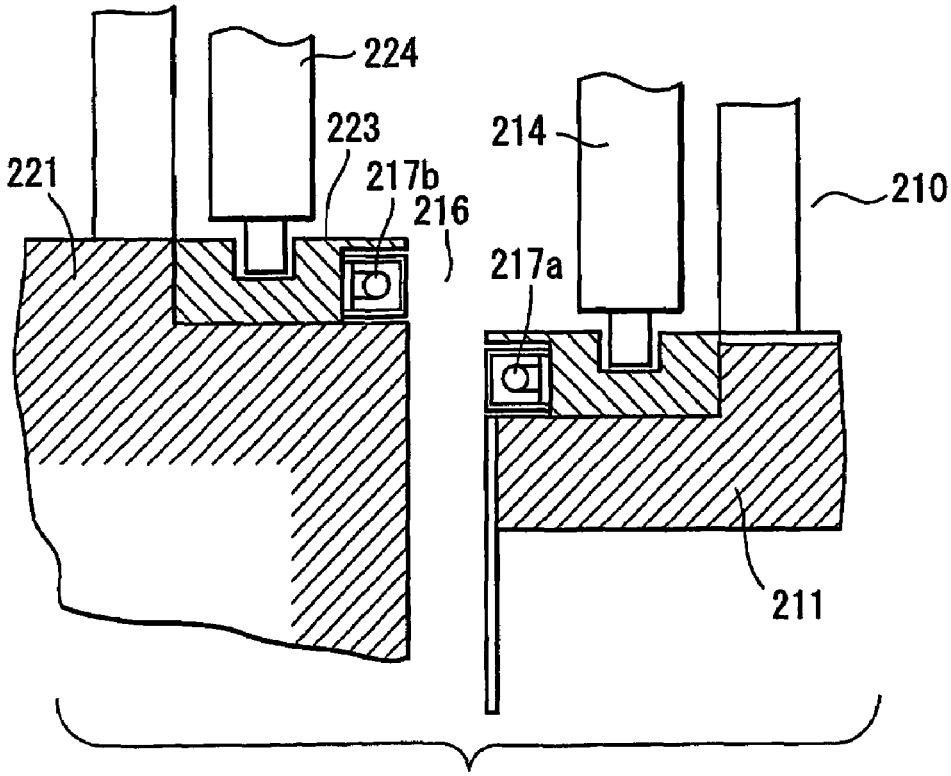

FIGS. 20A and 20B are conceptual views of threshold portions of a landing and a cage showing a constitution of a first embodiment of the present invention. FIG. 20A is an enlarged conceptual view when the cage stops without any steps. FIG. 20B is an enlarged conceptual view when the cage is shifted downward to generate a step. In the drawings, common portions are denoted by similar reference numerals.

According to the constitution of the embodiment, as shown in FIGS. 20A and 20B, a platform of a cage 10 comprises a car floor 211 and an entrance column 212, and a car threshold 213 is disposed on a part of the car floor 211 outside the entrance column 212.

On the upper surface of the car threshold 213, a guiding groove 215 is disposed for a car door 214 which slides on the upper portion of the entrance column 212 and which is held by hanging metal fittings. On a side end of the car threshold 213 opposite a landing threshold 223, a cold-cathode fluorescent lap illuminator 217*a* which is approximately equal to a width of an entrance of the cage and which illuminates the landing threshold side and comprises a translucent resin cover 218*a* on its front is disposed in parallel with the threshold. This cold-cathode fluorescent lamp illuminator 217*a* uses a thin cold-cathode fluorescent lamp having a diameter of about 1 mm to 6 mm, and can carry out illumination of high luminance. Here, as the cold-cathode fluorescent lamp, a fluorescent layer is coated on an inner wall of a transparent tube-shaped envelope such as glass, mercury vapor or xenon gas sealed in the tube is discharged by a cold cathode arranged inside or outside the tube to excite the fluorescent layer, thereby emitting a light.

Further, an apron 219 is disposed below the car threshold 213 to prevent falling-off of passengers.

On the other hand, a three-way frame 222 is disposed on a landing building floor of each floor, and a landing threshold 223 is disposed on a hoistway side of the landing building floor 221. A guiding groove 225 for a landing door 224 which similarly slides on the upper portion of the three-way frame 222 and which is held by hanging metal fittings is disposed. On a side end of the landing threshold 223 opposite the car threshold 213, a cold-cathode fluorescent lamp illuminator 217*b* which is approximately equal to a width of a landing entrance and which illuminates the landing threshold side and comprises a translucent resin cover 218*a* on its front is disposed in parallel with the threshold.

In each of the cold-cathode fluorescent lamp illuminators 217*a*, 217*b* disposed at the thresholds, in order to light the lamps, a not-shown stabilizer. (inverter) is disposed below the car floor 211 or in an empty place of the landing building floor 221, and control of a lighting timing or the like is carried out by a similarly not-shown control panel.

In the operation/action of the first embodiment of the foregoing constitution, the cage 210 is moved in the hoistway and, when it lands at one of the floors based on control by the not-shown control panel, the control panel checks the stop of the cage 210, and supplies power to the not-shown stabilizers of the cold-cathode fluorescent lamp illuminators 217*a*, 217*b*, whereby the cold-cathode fluorescent lamp illuminators 217*a*, 217*b* are lit. After the lighting, the car door 214 and the landing door 224 are opened to allow entrance/exit of passengers.

Figure 29A:
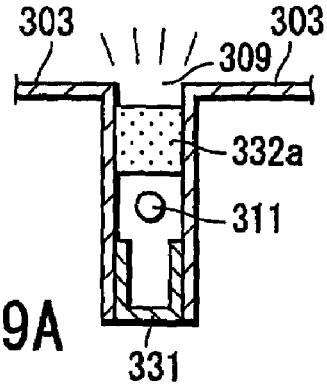
FIGS. 29A and 29B are sectional views when the lighting system is attached to a joint of two side plates shown in FIG. 23.
Figure 29B:
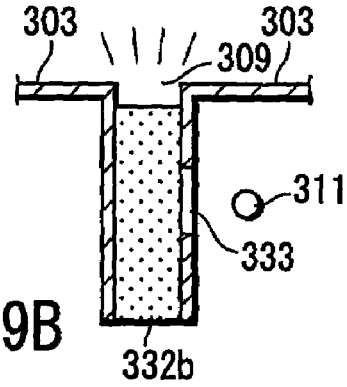

After opening of each door, as shown in FIG. 20*a*, since lights of the lit cold-cathode fluorescent lamp illuminators 217*a*, 217*b* are leaked through a gap 216 between the car threshold 213 and the landing threshold 223 to the passengers passing on the threshold, the gap 216 between both thresholds is seen bright to be recognized. Additionally, as shown in FIG. 29B, for example, if a step is generated, and the cage 210 stops at a lower position, the passengers who exit from the cage 210 see the car threshold 213 illuminated bright by the light of the cold-cathode fluorescent lamp illuminator 217*b* of the higher landing threshold 223 and the side end of the landing threshold 223 which light source is seen brightly, and thus can immediately recognize the higher landing threshold 223. On the other hand, the passengers who enter the cage 210 from the landing can similarly recognize presence of a step because the brightly illuminated car threshold 223 is seen.

In the case of a step in which the cage 210 stops at a high position, the passengers who enter the cage 210 brightly see the landing threshold 223 brightly illuminated by the light of the cold-cathode fluorescent lamp illuminator 217*a* of the higher car threshold 213 and the side end of the car threshold 213 which light source is seen bright. On the other hand, since the brightly illuminated landing threshold 223 is seen, the passengers who exit from the cage 210 can similarly recognize presence of the step immediately.

According to the first embodiment, the gap between the car threshold and the landing threshold is brightly lit by the cold-cathode fluorescent lamps disposed in the side ends of both thresholds. Thus, the passengers entering/exiting from the cage pay attention to the gap, and can even recognize a width of the gap by a width of a leaked light. Even if a step is generated, the upper surface of the lower threshold of the step is brightly illuminated, and a height of the step can be recognized from a height of the cold-cathode fluorescent lamp illuminator which becomes a higher side step and is seen bright. Thus, the passengers who see the light from the cold-cathode fluorescent lamp illuminator can intuitively recognize a level of preventing such a gap or a step, and safely pass through the entrance of the cage.

Further, in the cold-cathode fluorescent lamp illuminator disposed in the side end of the threshold, high luminance can be obtained even if a diameter of the cold-cathode fluorescent lamp is small, about 1 mm to 6 mm. Thus, no great changes are necessary in the car floor or the landing building floor, and it is compact and thus can be easily arranged in the side end of the threshold which can be easily recognized by the passengers and effective for optical display to draw attention to the gap and the step. Moreover, since a light source becomes continuous and long different from an incandescent lamp, design appearance can be secured.

Since a life is longer compared with a general illuminator such as a fluorescent lamp, there are advantages that the number of replacement times is small, and maintainability is high.

Figure 21:
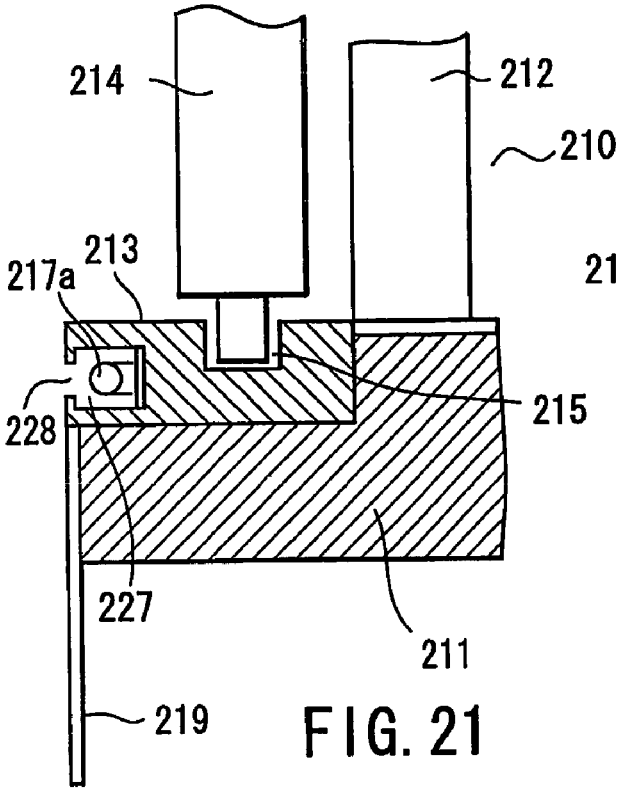
FIG. 21 is a conceptual view of an enlarged cage threshold showing a constitution of a second embodiment of the present invention.

FIG. 21 is a view showing a concept of a second embodiment of the present invention, a schematic view showing a constitution of a threshold in which a cold-cathode fluorescent lamp illuminator is installed in a car threshold.

According to the second embodiment, in opposing side ends of the car threshold and a landing threshold, concave portions C-shaped in section are formed to directly receive cold-cathode fluorescent lamps to constitute a car threshold and a landing threshold.

According to a constitution of the second embodiment, for example, in a cage shown in FIG. 21, a guiding groove 215 for a car door 214 is disposed on the upper surface of a car threshold 226. In a side end of the car threshold 226 opposite a not-shown landing threshold, a long concave portion 227 which is approximately equal to a width of an entrance and C-shaped in section is disposed so that an opening 229 is formed on the landing threshold side. A cold-cathode fluorescent lamp illuminator 217*a* is installed in the concave portion 227. Further, in order to light the cold-cathode fluorescent lamp illuminator 217*a*, a stabilizer (not shown) is disposed in an empty place such as below a car floor 211, and a similarly not-shown control panel is disposed to control a lighting timing.

On the other hand, at the landing threshold, similarly, a guiding groove for a landing door is disposed on the upper surface and, in a side end, a long concave portion which is approximately equal to a width of a three-way frame 222 and C-shaped in section is disposed so that an opening is formed on the threshold side. A cold-cathode fluorescent lamp illuminator is installed in this concave portion. Moreover, a stabilizer to light the cold-cathode fluorescent lamp illuminator is disposed in an empty place near the landing, and control of a lighting timing or the like is carried out by the aforementioned control panel.

In an action/operation of the second embodiment of the foregoing constitution, when the cage 210 lands and stops, the cold-cathode fluorescent lamp 217*a* of the car threshold 226 and the cold-cathode fluorescent lamp illuminator of the landing threshold are lit by control of the control panel, a light is radiated from the opening 229 of the car threshold or the opening of the landing threshold to illuminate each front direction.

By this illumination, the gap between both thresholds is brightly lit in the case of a stop of no step between the car threshold and the landing threshold. In the case of a stop of a step, the upper surface of the threshold of the lower step side is illuminated by a light from the opening of the threshold of the higher side, and the opening of the threshold of the higher side is seen by the passengers. Thus, the passengers can recognize a situation of the is car threshold and the landing threshold.

According to the second embodiment, since the concave portion C-shaped in section is disposed in each threshold to directly receive only the cold-cathode fluorescent lamp illuminator, a thin tube type cold-cathode fluorescent lamp of about 1 mm to 6 mm is used for this cold-cathode fluorescent lamp illuminator, and a threshold lighting fixture useful for recognition of the situation of the car threshold and the landing threshold by the passengers can be installed at the thin car threshold of the car floor. Thus, it is effective to secure safety during passage of the elevator passengers through the entrance.

Figure 22:
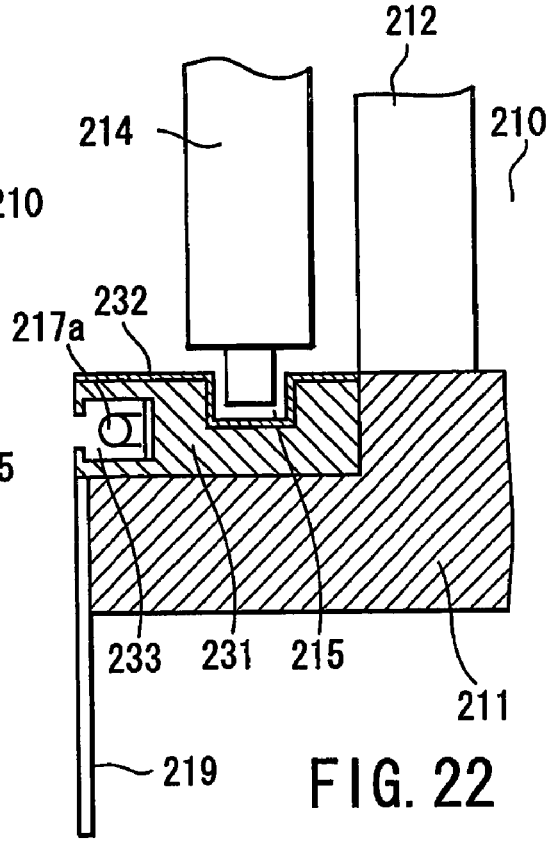
FIG. 22 is a conceptual view of an enlarged cage threshold showing a third embodiment of the present invention.

FIG. 22 is a schematic view showing a constitution of a third embodiment of the present invention.

According to the third embodiment, each of a car threshold and a landing threshold is made of a translucent resin, a concave portion is formed in a side end to directly receive a cold-cathode fluorescent lamp illuminator, and light shielding means is disposed in an upper surface of each of the car threshold and the landing threshold. In this way, each is constituted.

According to the constitution of the third embodiment, for example, in a cage shown in FIG. 22, a car threshold 231 is made of a translucent resin, a guiding groove 215 for a car door 214 is disposed on its upper surface, and light shielding means 232, e.g., a light shielding sheet which has been subjected to sticking processing, is applied on the entire upper surface of the car threshold 231 made of the translucent resin. A long concave portion 233 approximately equal to a width of an entrance is disposed in a side end of the car threshold 231 opposite a landing threshold (not shown), and a cold-cathode fluorescent lamp illuminator 217*a* is installed in this concave portion 233. Further, in order to light the cold-cathode fluorescent lamp 217*a*, a stabilizer (not shown) is disposed in an empty place below a car floor 211 or the like, and a similarly not-shown control panel is disposed to control a lighting timing or the like.

On the other hand, though not shown, a landing threshold is similarly made of a translucent resin, a guiding groove for a landing door is disposed on the upper surface of the landing threshold and, further, for light shielding, e.g., a light shielding sheet which has been subjected to sticking processing is applied on the entire upper surface of the landing threshold made of the translucent resin. A long concave portion approximately equal to a width of a three-way frame is disposed in a side end of the landing threshold opposite the car threshold 231, and a cold-cathode fluorescent lamp illuminator of the landing threshold is installed in this concave portion. Additionally, a stabilizer is disposed in an empty place near the landing to light the cold-cathode fluorescent lamp, and control of a lighting timing or the like is carried out by the aforementioned control panel.

As the light shielding means 232 made of the translucent resin in the upper surface of each threshold, in processing of sticking/arranging a light shielding material on the upper surface of each threshold such as sticking of a nonslip mat in place of the aforementioned light shielding sheet, coating of light shielding paint or plating of a light shielding film, needless to say, light shielding which is a purpose of the embodiment is similarly carried out.

In an action/operation of the third embodiment, when the cage 210 lands and stops, the cold-cathode fluorescent lamp illuminator 217*a* of the car threshold 231 and the cold-cathode fluorescent lamp illuminator of the landing threshold are lit by control of the control panel and, further, lights are made incident on the translucent resins of the car threshold and the landing threshold. The incident lights are irregularly reflected repeatedly in the thresholds, and radiated from the full surfaces of the opposing side ends of the car threshold 231 and the landing threshold which are not light shielded. Because of the light shielding means disposed on the upper surface of the threshold, no light radiation occurs from the inside of the threshold to the upper surface.

By the light radiated from the full end surface of the side end, a gap between both thresholds is illuminated brightly in the case of a stop of no step between the car threshold and the landing threshold. In the case of a stop of a step, the upper surface of the lower threshold of the step is illuminated by a light from the side end of the higher threshold, and the full surface of the side end of the higher threshold is seen by the passengers to emit a light. Thus, the passengers can recognize a situation of the car threshold and the landing threshold.

As described above, according to the third embodiment, each threshold is made of the translucent resin, and the concave portion is formed in the side end to receive the cold-cathode fluorescent lamp illuminator. Thus, the light radiated by lighting the cold-cathode fluorescent lamp illuminator is repeatedly subjected to reflection/scattering in the translucent resin threshold, radiated from the opposing side ends of the threshold of no light shielding, and the full surface of the side end of each threshold emits a light as if it is a surface light source. In the case of the stop of the cage in which there is a step, since the step is seen by the passengers as a side end to emit a beltlike light, there is an effect that the passengers can immediately recognize a level of the step. Additionally, since the scattered light is radiated, a mild surface light source is realized which prevents recognition of the cold-cathode fluorescent lamp illuminator as an original light source. Thus, there is a good design advantage.

All the first to third embodiments can be implemented by repairing the existing elevator or the like, and installing a new cold-cathode fluorescent lamp illuminator or replacing the existing incandescent lamp by a cold-cathode fluorescent lamp illuminator. In this case, since the cold-cathode fluorescent lamp is compact, there are advantages that a process, time and costs for the repairing work can be limited, and installation can be carried out without greatly changing design of the car threshold or the landing threshold.

As described above, according to the elevator threshold of the present invention, the gap between the car threshold and the landing threshold can be easily recognized by the passengers, and illuminated by high illuminance. In the case of the stop of the cage in which a step is generated, the illumination of the side end of the threshold in which the height of the gap is easily recognized, and the full width of the threshold easily seen in design is carried out by the thin tube cold-cathode fluorescent lamp illuminator. There is an effect that the elevator passengers are cautioned to secure safety during entering/exiting.

<Lighting System in Elevator Car>

Next, the embodiment of the present invention will be described with reference to the accompanying drawings.

First Embodiment

Figure 23:
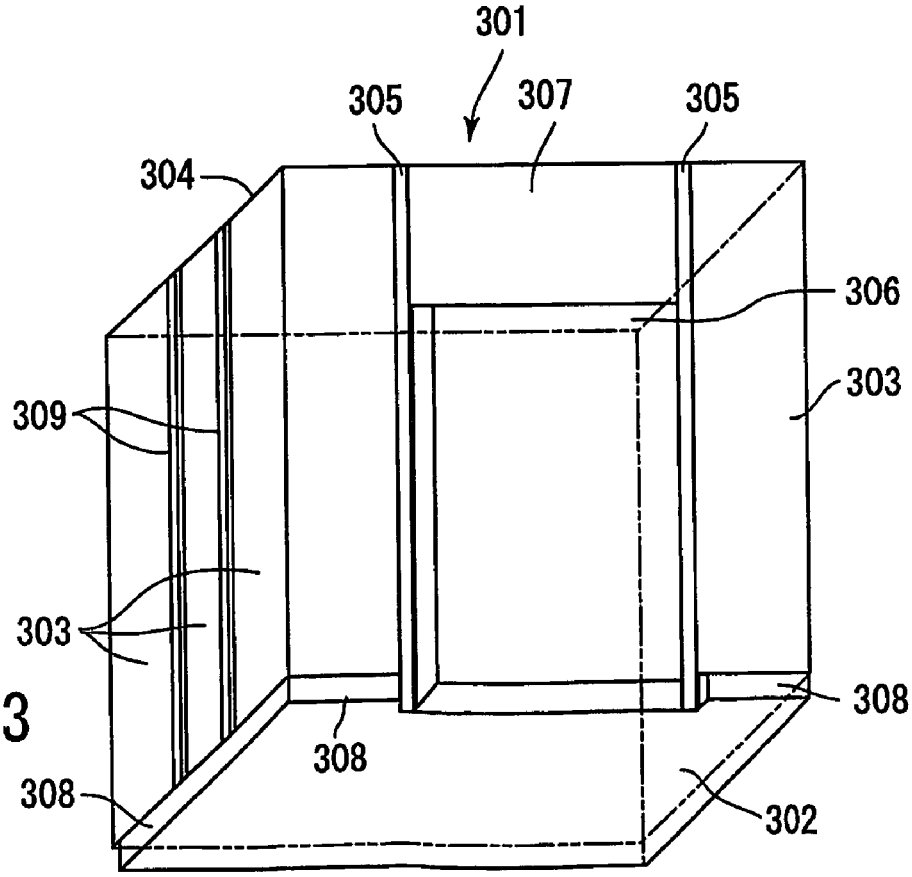
FIG. 23 is a constitutional view showing the inside of an elevator car to which a lighting system in an elevator car of the present invention is applied.

The first embodiment of a lighting system in an elevator car of the present invention will be described with reference to FIGS. 23 to 25. FIG. 23 is a view showing a portion in the elevator car by a solid line, and FIGS. 24A and 24B are sectional views when the lighting system is attached to a side plate.

This elevator car 301 comprises a car floor 302, a side plate 303 which becomes a car wall, a top plate 304 which becomes a car ceiling disposed to cover an upper portion of the side plate 303, entrance columns 305 erected at a predetermined interval on the car front side, a front door 306 arranged between both entrance columns 305 to be opened/closed during entering/exiting of users, an end rail 307 attached between an upper portion of the front door 306 and the top plate 304, and a base 308 attached between the car floor 302 and the side plate 303. A reference numeral 309 is a joint of the side plates 303. Normally, surfaces of the elevator car 301 except the front door 306 are formed by joining a plurality of side plates 303.

Figure 24A:
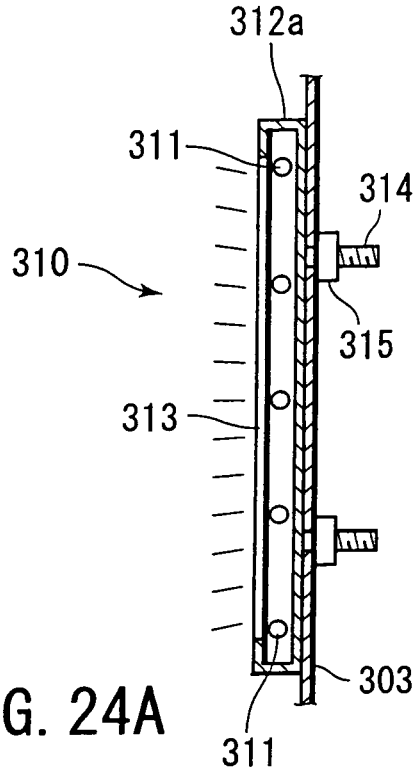
FIGS. 24A and 24B are sectional views when the lighting system is attached to a side plate shown in FIG. 23.
Figure 24B:
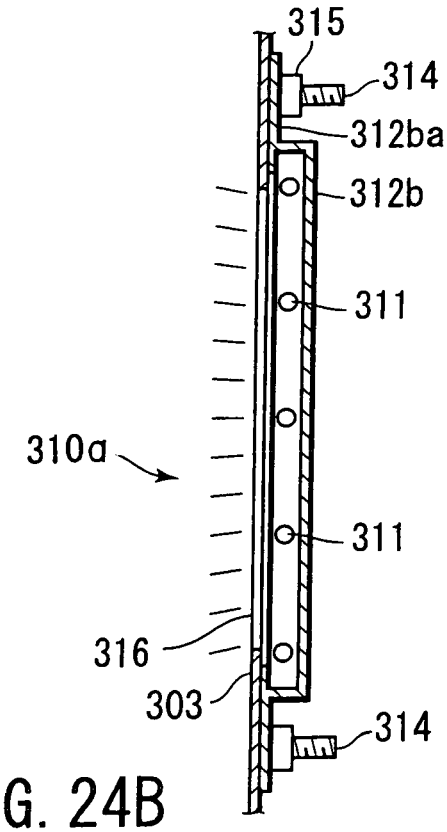

FIG. 24A is a sectional view of a lighting system 310 attached to the side plate 303 which constitutes a part of the elevator car 301.

The lighting system 310 comprises, for example, five straight tube cold-cathode fluorescent lamps 311, a support base (not shown) which supports both ends of each cold-cathode fluorescent lamp 311, a stabilizer (not shown) to light the cold-cathode fluorescent lamp 311, a lamp box 312*a* formed in, e.g., a concave shape in section to surround at least the plurality of cold-cathode fluorescent lamps 311 except a light irradiation side and the lamp support base, an illumination plate 313 arranged on a light irradiation direction side of the lamp box 312*a* to transmit a light emitted from the fluorescent lamp 311, and an attaching member 314 which is projected from a plurality of places on the backside of the lamp box 312*a* and in which a screw thread is formed.

The lighting system 310 is attached to the side plate 303 in a manner that through-holes are bored in the side plate 303 by considering an attaching dimension relation of a plurality of attaching members 314 beforehand, the attaching member 314 on the backside of the lamp box 312*a* is inserted through each through-hole, and screw-fixed by a nut 315 as a fastening member from the opposite surface of the side plate 303.

The cold-cathode fluorescent lamp 311 comprises at least a translucent discharge container having a diameter of about 1 mm to 6 mm, a pair of cold cathodes sealed to both sides of the discharge container, a fluorescent material coated on an inner surface of the discharge container, and a discharge medium sealed in the discharge container. The cold-cathode fluorescent lamp 311 has characteristics that since the cold cathode emits lights without being heated, a life is not dependent on the number of ON/OFF times of illumination but decided simply by light emission time. Additionally, the cold-cathode fluorescent lamp 311 has a feature that it is immediately lit when a high voltage is applied, and thus there is no time delay until light emission.

For the lamp box 312*a*, preferably, paint is coated or a material is used to provide a reflection function on an inner side thereof which reflects a light emitted from the cold-cathode fluorescent lamp 311. Thus, the inside of the elevator car 301 can be efficiently irradiated with the light from the cold-cathode fluorescent lamp 311.

In the lamp box 312*a*, support bases are arranged at a predetermined interval in both ends, and each cold-cathode fluorescent lamp 311 is supported by the support bases of both sides. For example, a stabilizer of an inverter function is arranged in the lamp box 312*a*, ends of the plurality of cold-cathode fluorescent lamps 311 are electrically connected to one end of the stabilizer, and the other ends of the plurality of cold-cathode fluorescent lamps 311 are electrically connected to the other end of the stabilizer. A connector is connected to the stabilizer to supply power.

Thus, according to the embodiment, by attaching the lighting system 310 which uses the cold-cathode fluorescent lamp 311 to the side plate 303 of the elevator car 301, compared with the conventional general fluorescent lamp, a lamp life is prolonged, a lamp use period is extended, and the number of times of replacing the cold-cathode fluorescent lamp can be reduced. Moreover, since a diameter of the cold-cathode fluorescent lamp 311 is very small, the lighting system 310 can be made compact as a whole, and can be attached to a place in which the conventional general fluorescent lamp cannot be attached because of a space problem.

Further, since the entire lighting system 310 can be made compact, a step between the side plate 303 and the lamp box 312*a* becomes inconspicuous, and design of the elevator car is excellent.

The illumination plate 313 can be removed from the inside of the elevator car, the cold-cathode fluorescent lamp 311 can be easily replaced, and the cold-cathode lamp 311 can be replaced without stopping the elevator within a short time.

In FIG. 24A, the attaching member 314 is projected on the backside of the lamp box 312*a*. However, for example, a constitution may be employed in which an attaching member 314 having a screw thread is projected on the inner side surface of the side plate 303, a through-hole is formed in a relevant place of the lamp box 312*a* and, after the through-hole of the lamp box 312*a* is inserted through the attaching member 314, the lighting system is screw-fixed by a nut 315 from the inside of the lamp box 312*a* to be attached to the side plate 303.

FIG. 24B is a sectional view of the lighting system 310*a* attached to the side plate 303 which constitutes a part of the elevator car 301 similar to FIG. 24A.

According to the side plate attaching constitution of the lighting system 310*a*, first, on the side plate 303 which constitutes the elevator car 301, an opening 316 which has a width equivalent to an area to capture illumination in the elevator car 301 is bored.

On the other hand, in the lamp box 312*b*, an attaching flange 312*ba* is disposed to project from the box front end to the outside so as to maintain the same plane as that of the box front. A through-hole is formed in the attaching flange 312*ba*. By considering a dimensional relation between the through-holes formed in the attaching flange 312*ba* of the lamp box 312*b*, attaching members 314 having screw threads are disposed in a plurality of places on the backside of the side plate 303. A reference numeral 315 is a nut which becomes a fastening member.

The lighting system 310*a* is completely similar to that of FIG. 24A, and thus for details, see FIG. 24A.

Next, an attaching operation of such a lighting system 310*a* will be described.

Since the opening 316 is formed beforehand on the side plate 303 to capture a light, the lighting system 310*a* is fixed to the side plate 303 by inserting the through-hole of the attaching flange 312*ba* disposed in the lamp box 312*b* which incorporates the cold- cathode fluorescent lamp 311 from the backside of the opening 316 toward the attaching member 314 projected in the side plate 303, and then screw-fixing it by the nut 315.

Especially, since the cold-cathode fluorescent lamp 311 is used, compared with the general hot-cathode fluorescent lamp, the lighting system 310*a* can be attached compact. Since there is almost no bulging from the backside of the side plate 303, the lighting system 310*a* can be attached even if there is an obstacle near the side plate 303. Moreover, since space is saved for the lamp box 312*b*, much maintenance space can be secured during fluorescent lamp replacement.

Because of a very small diameter of the cold-cathode fluorescent lamp 311, the cold-cathode fluorescent lamp 311 and the side plate 303 to which no lamps are attached are approximately equal in size, and thus these members can be shipped by the same method. Further, as one of elevator specifications, a side plate cover 317 later-described with reference to FIG. 25 is attached at a predetermined interval to the outside of the side plate 303 to deal with wind sound. The lamp box 312*b* can be sufficiently housed in a gap between the side plate 303 and the side plate cover 317, and the lighting system 310*a* can be surely attached while wind sound countermeasures are taken.

In FIG. 24B, a constitution may be employed in which an opening 316 is bored on the side plate 303 of the elevator car 301 to a size to bury the lamp box 312*b*, on the other hand, an attaching member 314 is attached to the surface side of the side plate 303, and the lamp box 312*b* is screw-fixed from the inside of the elevator car 301. During such attaching of the lighting system 310*a*, the lamp box 312*b* is attached to the attaching member 314, fastened and fixed by the nut 315, and then the nut 315 is concealed by a blindfolding member. Thus, a good design is provided.

Second Embodiment

Figure 26A:
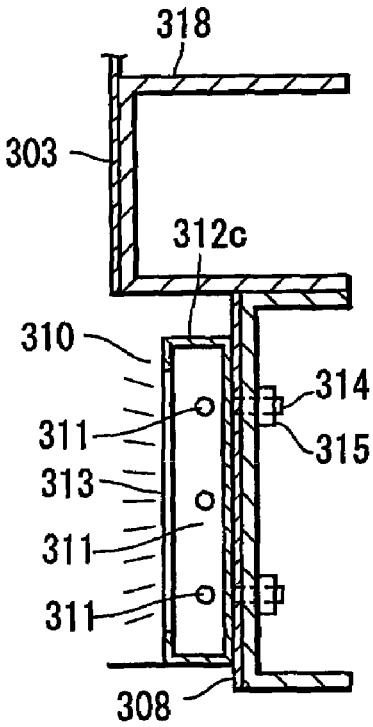
FIGS. 26A and 26B are sectional views when the lighting system is attached to the base shown in FIG. 23.
Figure 26B:
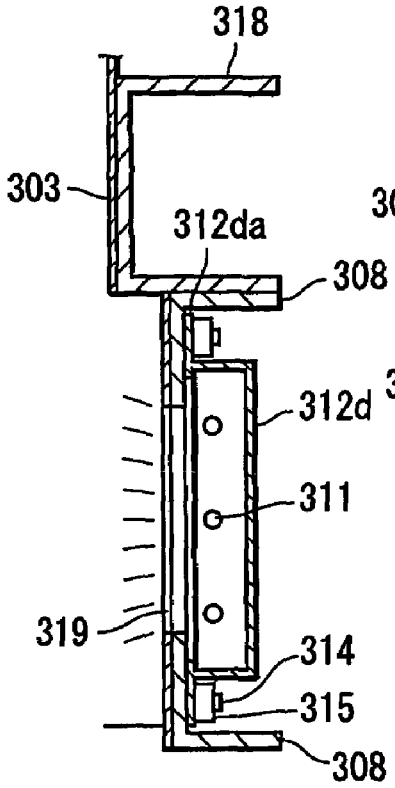
Figure 27:
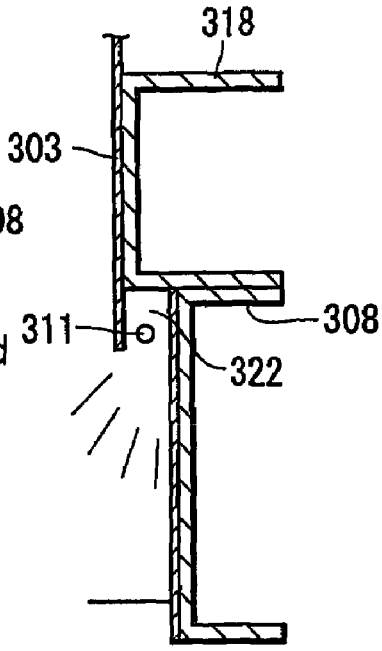
FIG. 27 is a sectional view when the lighting system is attached to the base shown in FIG. 23.

Next, a second embodiment of a lighting system in an elevator car of the present invention will be described with reference to FIGS. 23, 26A, 26B and 27. FIG. 23 is as describe above, and description thereof will be omitted. FIGS. 26A, 26B and 27 are sectional views when the lighting system of the present invention is attached to a base 308 which constitutes a part of the elevator car.

In this elevator car 301, the base 308 U-shaped in section is attached between a car floor 302 and a side plate 303. In this case, for example, the side plate 303 and the base 308 are connected to each other through a connection member 308 U-shaped in section so that a flat surface portion can face the inside of the car.

If the side plate 303 and the base 308 are arranged in a positional relation in which the base 308 is arranged after the side plate 303, a step is formed between the side plate 303 and the base 308.

FIG. 26A shows an example in which the lighting system 310 is attached to a surface portion of the base 308 by using the step between the side plate 303 and the base 308.

The lighting system 310 comprises, for example, three straight tube cold-cathode fluorescent lamps 311, a support base (not shown) which supports both ends of each cold-cathode fluorescent lamp 311, a stabilizer (not shown) to light the cold-cathode fluorescent lamp 311, a lamp box 312*c* formed in, e.g., a nearly concave shape in section to surround at least the plurality of cold-cathode fluorescent lamps 311 except a light irradiation side and the lamp support base, an illumination plate 313 arranged on a light irradiation direction side of the lamp box 312*a* to transmit a light emitted from the fluorescent lamp 311, and an attaching member 314 which is projected from a plurality of places on the backside of the lamp box 312*c* and in which a screw thread is formed.

The lighting system 310 is attached to the base 308 in a manner that through-holes are bored in the base 308 side by considering an attaching dimension relation of a plurality of attaching members 314 projected from the backside of the lamp box 312*c* beforehand, the attaching member 314 on the backside of the lamp box 312*c* is inserted through each through-hole, and screw-fixed by a nut 315 as a fastening member from the backside of the base 308.

For the lamp box 312*c*, preferably, paint is coated or a material is used to provide a reflection function on an inner side thereof which reflects a light emitted from the cold-cathode fluorescent lamp 311. Thus, the inside of the elevator car 301 can be efficiently irradiated with the light from the cold-cathode fluorescent lamp 311.

In the lamp box 312*a*, support bases (not shown) are arranged at a predetermined interval in both ends, and each cold-cathode fluorescent lamp 311 is supported by the support bases of both sides. For example, a stabilizer (not shown) of an inverter function is arranged in the lamp box 312*a*, ends of the plurality of cold-cathode fluorescent lamps 311 are electrically connected to one end of the stabilizer, and the other ends of the plurality of cold-cathode fluorescent lamps 311 are electrically connected to the other end of the stabilizer. A connector is connected to the stabilizer to supply power.

Thus, according to the embodiment, in addition to operation effects similar to those describe above with reference to FIG. 24A, while the step between the side plate 303 and the base 308 is normally about 20 mm, the lighting system 310 can be surely attached in the step because it is compact as a whole. Therefore, if the lighting system 310 which uses the cold-cathode fluorescent lamp 311 is attached, the lighting system 310 can be attached, for example, without changing the hoistway or the support erect frame. Moreover, the lighting system 310 can be attached without being bulged, and good design of the elevator car is provided.

For example, a constitution may be employed in which an attaching member 314 having a screw thread is projected on the surface portion of the base 308, a through-hole is formed in a relevant place of a lamp box 312*d* and, after the through-hole of the lamp box 312*d* is inserted through the attaching member 314, the lighting system is screw-fixed by a nut 315 from the inside of the lamp box 312*d* to be attached to the base 308.

FIG. 26B shows an example of attaching the lighting system 310 to the base 308 by using the step between the side plate 303 and the base 308 similarly to FIG. 26A. A difference from FIG. 26A is that an opening 319 having a width equivalent to an area to capture illumination in the car is bored in the elevator car 301 on the surface portion of the base 308, an attaching flange 312*da* is disposed to project from the box front end to the outside so as to maintain the same plane as that of the front of the lamp box 312*d*, and a through-hole is formed in the attaching flange 312*da*. On the other hand, attaching members 314 having screw threads are disposed in a plurality of places on the backside of the base 308. A reference numeral 315 is a nut which becomes a fastening member.

The lighting system 310 is completely similar to that of FIG. 24A, and thus for details, see FIG. 24A.

Next, an attaching operation of such a lighting system 310 will be described.

Since the opening 319 is formed in the base 308 to capture a light, the lighting system 310 is attached to the base 308 by inserting the through-hole of the attaching flange 312*da* disposed in the lamp box 312*d* which incorporates the cold-cathode fluorescent lamp 311 from the backside of the opening 319 toward the attaching member 314 projected in the base 308, and then screw-fixing it by the nut 315.

Figure 25:
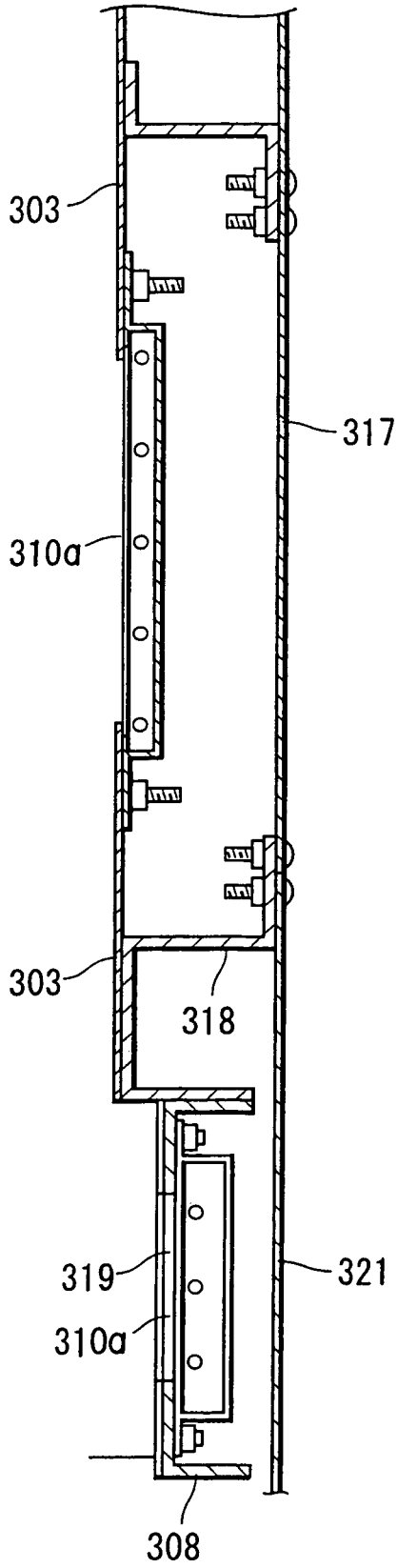
FIG. 25 is a view explaining an attached state of the lighting system when wind sound prevention means is disposed in the side plate and the outside of a base shown in FIG. 23.

Thus, according to the embodiment, in addition to operation effects similar to those described above with reference to FIG. 24B, while a base cover 320 is disposed outside the base 308 as shown in FIG. 25 if wind sound is dealt with as one of elevator specifications, the lamp box 312*d* can be sufficiently housed in a gap between the base 308 and the base cover 321, and the lighting system 310 can be surely attached while wind sound countermeasures are taken.

As in the case of FIG. 24B, a constitution may be employed in which an opening is bored in the base 308 to a size to bury the lamp box 312*d*, on the other hand, an attaching member 314 is attached to the surface side of the base 308, and the lamp box 312*d* is screw-fixed from the inside of the elevator car 301. During such attaching of the lighting system 310, the lamp box 312*d* is attached to the attaching member 314, fastened and fixed by the nut 315, and then the lighting system 310 is attached from the inside of the car.

FIG. 27 shows another example in which the lighting system 310 is attached by using a step between the side plate 303 and the base 308.

That is, if there is a step between the side plate 303 and the base 308, by projecting the lower end of the side plate 303 to cover a part of the base 308, a space portion 322 can be formed between the projected portion and the base 308. Thus, if by using the space portion 322, a lamp box (not shown) is buried to install a cold-cathode fluorescent lamp 311, or a cold-cathode fluorescent lamp 311 including the support base is attached to the connection member 318 to connect the side plate 303 and the base 308, the lighting system 310 can be attached by effectively using the gap between the projection portion of the side plate 303 and the base 308.

Therefore, according to the embodiment, even if a step between the side plate 303 and the base 308 is small, the lighting system 310 can be attached by effectively using space. For example, even in the case of a step of 5 mm between the side plate 303 and the base 308, the cold-cathode fluorescent lamp 311 can be received in the step.

Third Embodiment

Figure 28A:
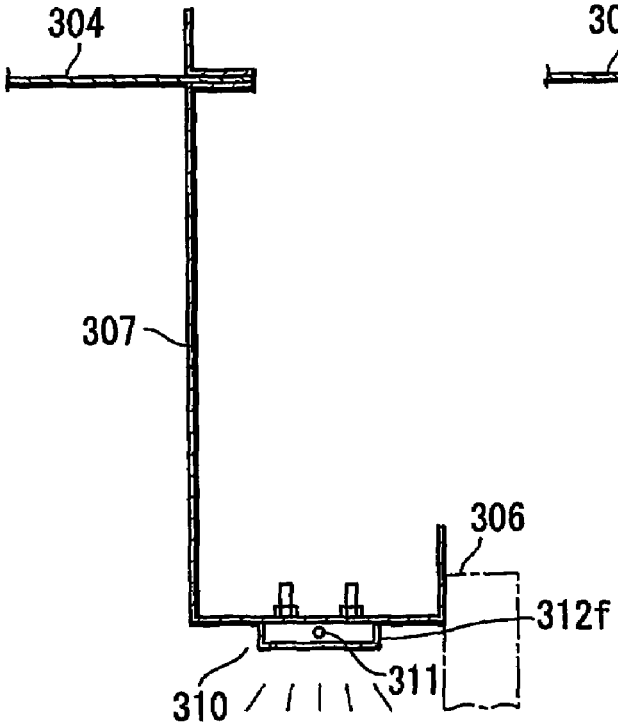
FIGS. 28A and 28B are sectional views when the lighting system is attached to an end rail shown in FIG. 23.
Figure 28B:
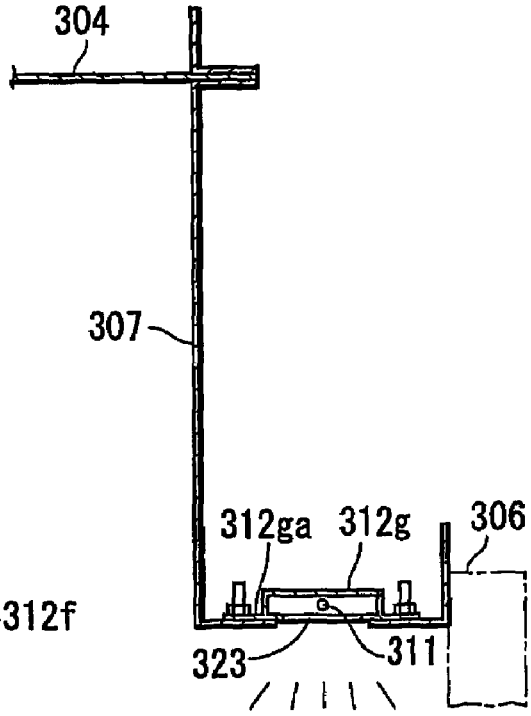

Next, description will be made of a third embodiment of a lighting system in an elevator car with reference to FIGS. 23, 28A and 28B. FIG. 23 is as described above, and thus description thereof will be omitted. FIGS. 28A and 28B are sectional views when a lighting system in an elevator car of the present invention is attached to an end rail 317 which constitutes a part of the elevator car.

In the elevator car 301, the end rail 307 is arranged between an upper portion of a front door 306 indicated by a dotted line in the drawing and a top plate 304. This end rail 307 is formed so that a certain width can be set in an entering/exiting direction and a depth direction of users.

Thus, in FIG. 28A, the lighting system 310 which uses a cold-cathode fluorescent lamp 311 is attached by using a bottom surface portion of the end rail 307.

Specifically, the lighting system 310 comprises a required number of straight tube cold-cathode fluorescent lamps 311, a support base (not shown) which supports both ends of each cold-cathode fluorescent lamp 311, a stabilizer (not shown) to light the cold-cathode fluorescent lamp 311, a lamp box 312*f* formed in, e.g., a nearly concave shape in section to surround at least the plurality of cold-cathode fluorescent lamps 311 except a light irradiation side and the lamp support base, an illumination plate 313 arranged on a light irradiation direction side of the lamp box 312*f* to transmit a light emitted from the fluorescent lamp 311, and an attaching member 314 which is projected from a plurality of places on the backside of the lamp box 312*f* and in which a screw thread is formed. The lighting system 310 is attached to the end rail 307 in a manner that through-holes are bored beforehand in the base 307 by considering an attaching dimension relation of a plurality of attaching members 314, the attaching member 314 on the backside of the lamp box 312*f* is inserted through each through-hole, and screw-fixed by a nut 315 as a fastening member from the backside of the base 307.

According to the embodiment, in addition to operation effects similar to those described above with reference to FIG. 24A, the lighting system 310 can be realized very compact. Thus, even if there is not much attaching space in the bottom surface portion of the end rail 307, even in space not for attaching conventionally, the lighting system 310 can be attached.

FIG. 28B is similar to FIG. 28A in that the lighting system 310 is attached to the end rail 307. However, a particular difference is that an opening 323 having a width equivalent to an area to capture illumination in the elevator car 301 is bored on the bottom surface portion of the base 307, an attaching flange 312*ga* is disposed to project from the box front end to the outside so as to maintain the same plane as that of the front of the lamp box 312*g*, and a through-hole is formed in the attaching flange 312*ga*. On the other hand, attaching members 314 having screw threads are disposed in a plurality of places on the backside of the end rail 307. A reference numeral 315 is a nut which becomes a fastening member.

The lighting system 310 is completely similar to that of FIG. 24A, and thus for details, see FIG. 24A.

Thus, according to the embodiment, the lighting system 310 is attached to the end rail 307 by inserting the through-hole of the attaching flange 312*ga* disposed in the lamp box 312*g* which incorporates the cold-cathode fluorescent lamp 311 from the backside of the opening 323 toward the attaching member 314 projected in the end rail 307, and then screw-fixing it by the nut 315.

Thus, according to the embodiment, since it uses the cold-cathode fluorescent lamp 311, compared with the general hot-cathode fluorescent lamp, the lighting system 310 can be attached compact. Since there is almost no bulging from the backside of the end rail 307, the lighting system 310 can be attached even if there is an obstacle near the end rail 307. Moreover, since space is saved for the lamp box 312*g*, much maintenance space can be secured during fluorescent lamp replacement.

Fourth Embodiment

Next, description will be made of a fourth embodiment of a lighting system in an elevator car of the present invention with reference to FIGS. 23, 29A and 29B. FIG. 23 is as described above, and thus description thereof will be omitted. FIGS. 29A and 20B show an example of attaching a lighting system 310 by using a joint 309 of a side plate 303 and an adjacent side plate 303.

FIG. 29A shows an example in which the lighting system 310 is attached to the joint 309. This lighting system in an elevator car is constituted in a manner that an inspection bracket 331 is fitted from the backside in a gap of the joint 309 formed by folding portions of two side plates 303 adjacent to each other, or a deep portion of the joint 309 in which a slight gap is intentionally disposed, a cold-cathode fluorescent lamp 311 which includes a support base is attached between the inspection bracket 331 and the joint 309, and an illumination member 332*a* which transmits a light emitted from the cold-cathode fluorescent lamp 311 is fitted from a surface side to seal up the surface joint 309.

Thus, according to the embodiment, in addition to operation effects similar to those described above with reference to FIGS. 254A and 24B, the cold-cathode fluorescent lamp 311 can be attached by effectively using the narrow joint 309. Especially, if the lighting system 310 which becomes box-shaped is mounted beforehand to the surface joint 309 by the folding portions of the two side plates 303 adjacent to each other, the lighting system 310 can be easily attached to the joint 309 on the spot. The inside of elevator car 301 can be illuminated by effectively using the surface joint 309 of the two side plates 303 adjacent to each other. Moreover, aesthetic illumination can be realized by setting a required color in the illumination member 332*a*, and thus a design effect can be increased.

FIG. 29B shows another example in which the lighting system 310 is attached to the joint 309. This lighting system in the elevator car is constituted in a manner that a hole 333 through which a light is passed is formed in one of the folding portions of the two side plates 303 adjacent to each other, and an illumination member 332*b* which transmits a light is buried in the gap of the joint 309. Then, the lighting system 310 which uses the cold-cathode fluorescent lamp 311 is arranged near the hole 333, and a light emitted from the cold-cathode fluorescent lamp 311 is passed through the hole 333, and outputted as an indirect light from the illumination member 332*b*.

According to the embodiment, in addition to operation effects similar to those described above with reference to FIGS. 24A and 24B, since the cold-cathode fluorescent lamp 311 is arranged near the hole 333 formed in the folding portion of the side plate 303, the light from the cold-cathode fluorescent lamp 311 can be outputted through the illumination plate 313 from the joint 309. A design effect different from that of FIG. 29A can be realized.

Fifth Embodiment

Next, description will be made of a fifth embodiment of a lighting system in an elevator car of the present invention with reference to FIG. 23 and FIGS. 30 to 32. FIG. 23 is as described above, and thus description thereof will be omitted.

Figure 30:
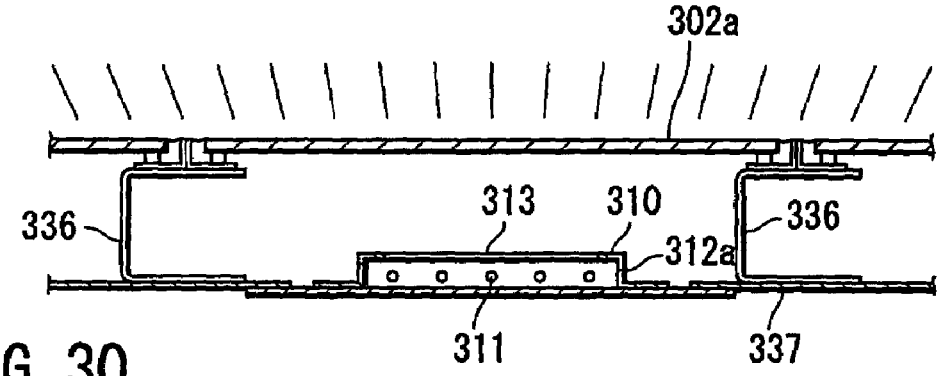
FIG. 30 is a sectional view when the lighting system is attached to a car floor shown in FIG. 23.

FIG. 30 shows an example of attaching a lighting system 310 to a car floor 302 which constitutes a part of the elevator car.

The lighting system in the elevator car is constituted in a manner that a illumination floor 302*a* which transmits a light is laid on the entire portion or a part of a car floor 302, an illumination attaching plate 337 is attached through a plurality of U-shaped members 336 to a bottom side of the illumination floor 302*a* and, if the lighting system 310 shown in FIG. 24A or 24B is installed in the illumination attaching plate 337, a light emitted from the cold-cathode fluorescent lamp 311 is passed through the illumination floor 302*a* to illuminate the inside of the car.

According to such an embodiment, in addition to operation effects similar to those described above with reference to FIGS. 24A and 24B, the inside of the elevator car can be illuminated from the car floor 302 by using little space of the car floor portion. Moreover, by illuminating the car floor 302, the car floor 302 can be reduced in weight.

Figure 31:
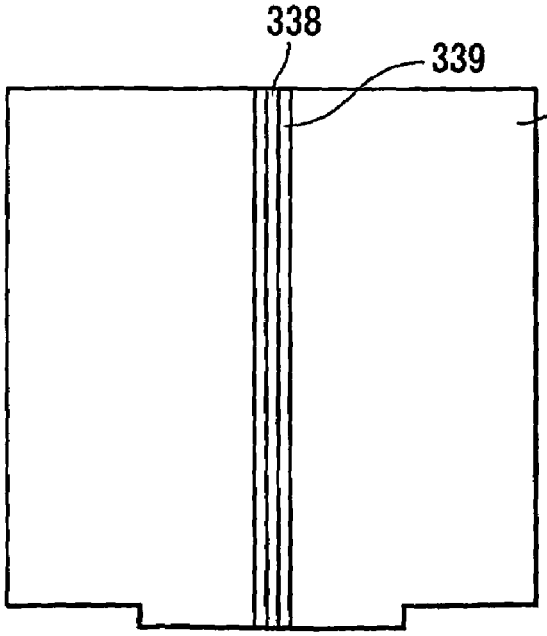
FIG. 31 is a view showing a car floor surface portion when the lighting system is attached to the car floor.
Figure 32:
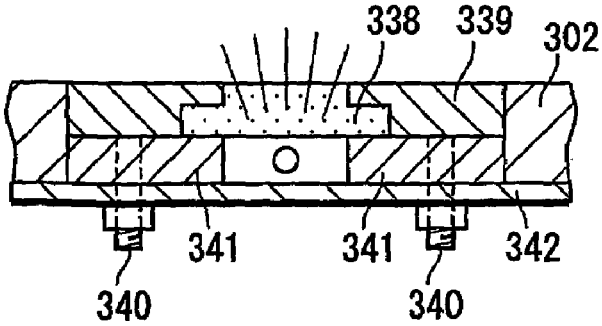
FIG. 32 is a sectional view of the car floor.

FIGS. 31 and 32 show other examples in which the lighting system 310 is similarly attached to the car floor 302. FIG. 31 is a view showing a surface portion of the car floor, and FIG. 32 is a sectional view of the car floor of FIG. 31.

In this car floor 302, a floor joint 338 which transmits a light and has a convex shape in section is laid to be linear to the surface portion of the car floor 302, and two reverse concave shaped floor joint pressing members 339 are disposed to be pressed to the convex shaped portion of the floor joint 338 from the above. On each of the backsides of the two joint pressing members 339, a plurality of attaching members 340 in which screw threads are formed are projected, put through a floor base plate 342 via an intermediate block 341, and fastened from the backside of the floor base plate 342 by a nut 343 which is a fastening member to prevent pulling-out of the floor joint 338. Then, the lighting system 310 which uses the cold-cathode fluorescent lamp 311 is housed in a space portion formed by the floor joint 338 and the pair of intermediate blocks 341 and 342.

Thus, according to the embodiment, in addition to operation effects similar to those of FIGS. 24A and 24B, since the lighting system 310 which uses the cold-cathode fluorescent lamp 311 can be realized compact, the lighting system 310 can be attached even to a relatively fine back of the floor joint 338, and a design effect of the car floor 302 can be expected.

The present invention is not limited to the aforementioned embodiment, and various changes and modifications can be made without departing from the teachings. FIG. 23 shows a modified example of the elevator car 301. There are various types of elevator cars to meet the demands of users or the like. The invention can be applied to all these types of elevator cars 301. In each drawing, the cold-cathode fluorescent lamp 311 is arranged in a required direction. However, there is no particular limitation on its arranging direction.

The embodiment has been described by way of example in which the cold-cathode fluorescent lamp 311 is used for the lighting system 310. However, in place of the cold-cathode fluorescent lamp 311, for example, an element such as an LED (light emitting diode) or organic EL (electroluminescence) may be used to emit a light. The element such as an LED or organic EL as the lighting system 310 is arrayed in a bar shape (fluorescent lamp), a ring shape (circular-line) or on a two-dimensional plane. In the lamp box or the like which constitutes a part of the lighting system 310, only an LED may be incorporated, only organic EL may be incorporated, or a cold-fluorescent lamp 311, an ELD and organic EL may be properly combined.

Further, in addition to the use of a white color for the ELD or the organic EL, other colors can be used in accordance with an ambient temperature, the amount of light, a use time zone, a use season etc, and LED and organic El of a plurality of colors can be mixed. Needless to say, in order to emit a light from the element such as an LED or organic EL, the driving control device which has conventionally been used generally is used.

Furthermore, the embodiments can be implemented by being combined as much as possible and, in such a case, effects by the combination can be obtained. Each embodiment includes various inventions of upper and lower stages, and various inventions can be extracted by proper combination of the plurality of disclosed components. For example, if some of all the component requirements described in means to solve the problems are omitted to extract the invention, the omitted portions are properly compensated for by a well-known customary technology in the case of implementing the extracted invention.

As described above, according to the present invention, it is possible to reduce the number of lamp replacement times of the lighting system installed in the elevator car, to attach the lighting system by using little space of the component which constitutes a part of the elevator car, and to provide a lighting system in an elevator car which can secure sufficient maintenance space during cold-cathode fluorescent lamp replacement.

<Car Exterior Lighting System of Elevator>

Next, the embodiment of the present invention will be described with reference to the accompanying drawings.

First Embodiment

Figure 33:
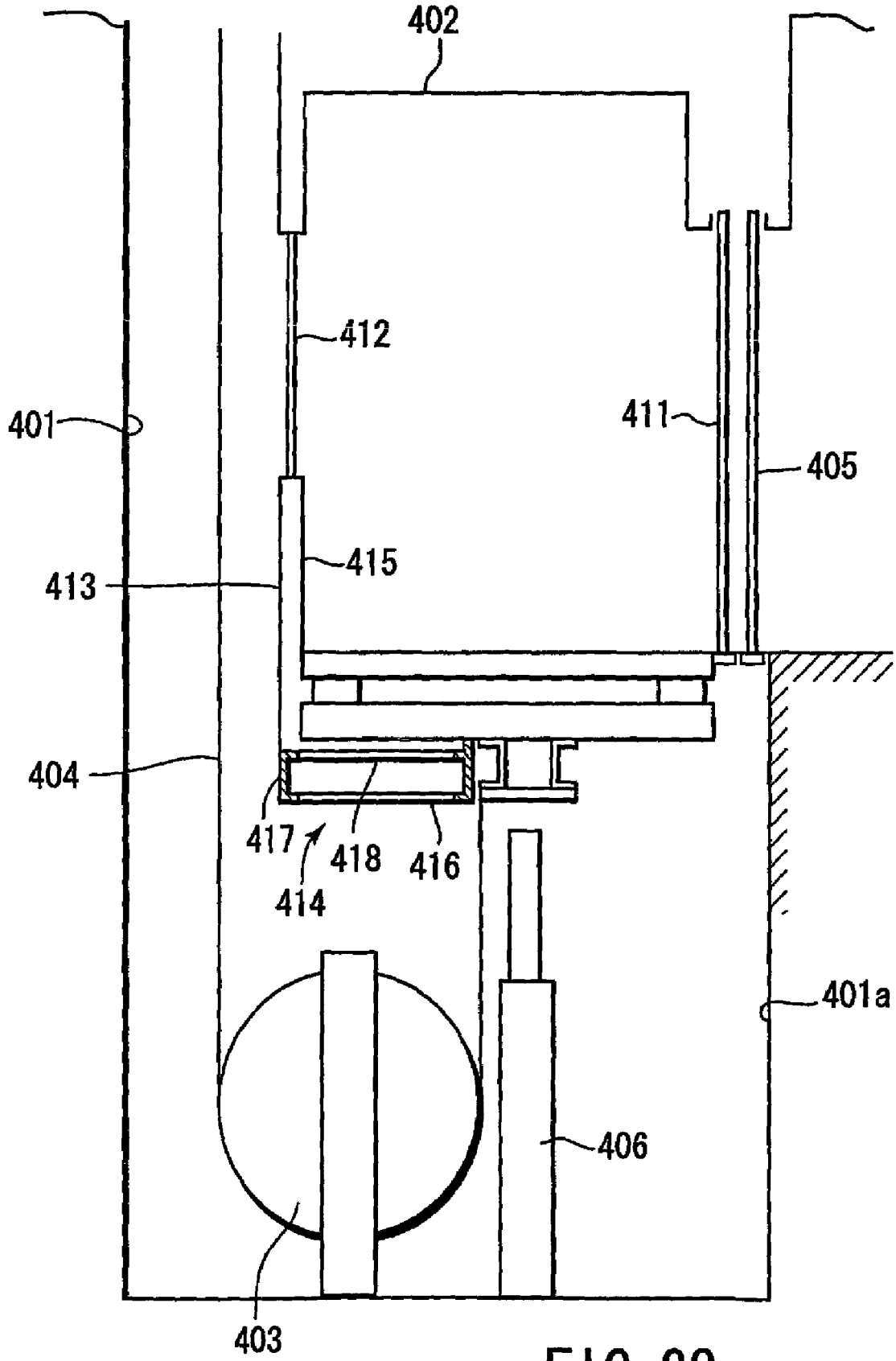
FIG. 33 is an elevator constitutional view explaining an embodiment of a car exterior lighting system of the elevator of the present invention.

FIG. 33 is a constitutional view of an elevator explaining an embodiment of a car exterior lighting system of the elevator of the present invention.

This elevator is constituted in a manner that a cage 402 is suspended from one end side of a main rope (not shown) hung on a hoist (not shown) installed in a machine room or the like of an upper portion of a hoistway 401, a counter weight (not shown) is attached to the other end of the main rope, and a vertical movement of the cage 402 is controlled by driving of the hoist.

A compensation rope 404 is connected through a compensation rope tension pulley 403 between a bottom portion of the cage 402 and the bottom portion of the counter weight, and the cage 402 and the counter weight serve to cancel the weight of the main rope during the vertical movement in the hoistway. A reference numeral 401*a* is a hoistway pit, 405 a hall door of a landing side, and 406 a spring or hydraulic buffer which is an emergency stopping device having a function to receive the cage 402. This buffer 406 is projected in the hoistway pit 401*a* directly below the cage 402, and a length thereof varies in accordance with cage weight, a hoistway length or the like.

On the other hand, the cage 402 comprises a car door 411 arranged in a side to face the hall door 405 and opened/closed when a landing of each floor is reached, an observation window 412 arranged in one or both of an opposite surface side and a left/right surface side with respect to the car door 411 to enable observation of the outside of the cage, an exterior panel 413 which covers the outside of the cage 402 except the car door 411 and the observation window 412, and an exterior illuminator 414 attached to the exterior panel 413 facing the bottom portion of the cage 402 to illuminate the outside of the cage. A reference numeral 415 is a cage inner wall.

As the hoistway 401, if it is all glassed or only a side facing the outside is glassed, the outside can be observed through the observation window 412 from the inside of the cage 402. Additionally, if there is no hoistway 401, the outside can similarly be observed through the observation window 412 from the inside of the cage 402.

The exterior illuminator 414 comprises a box-shaped casing 417 in which a light transmission plate 416 including a translucent acrylic material on a surface side, one or more straight tube cold-cathode fluorescent lamps 418 which are supported by a support base (not shown) attached to the inside of the box-shaped casing 417 and which emit lights, a stabilizer (not shown) having an inverter function to light one or more straight tube fluorescent lamps 418 individually or a plurality, and a power source (not shown) which supplies required power to the stabilizer.

The cold-cathode fluorescent lamp 418 comprises at least a translucent discharge container having a diameter of about 1 mm to 6 mm, a pair of cold cathodes sealed to both sides of the discharge container, a fluorescent material coated on an inner surface of the discharge container, and a discharge medium sealed in the discharge container. The cold-cathode fluorescent lamp 418 has characteristics that since the cold cathode emits lights without being heated, a life is not dependent on the number of ON/OFF times of illumination but decided simply by light emission time. Additionally, the cold-cathode fluorescent lamp 418 has a feature that it is immediately lit when a high voltage is applied, and thus there is no time delay until light emission.

Description will be made of an operation of the first embodiment having the aforementioned constitution.

Required power is supplied from the power source to the stabilizer, converted into a voltage/current of a required value at the stabilizer, and then supplied to the cold-cathode fluorescent lamp 418. Upon reception of the required power, the cold-cathode fluorescent lamp 418 is lit to emit a light having a predetermined wavelength, and illuminate the exterior outside through the light transmission plate 416.

Thus, according to the embodiment, one or more cold-cathode fluorescent lamps 418 which emit lights are attached to the exterior panel 413 of the bottom portion of the cage, and the box-shaped exterior illuminator 414 in which the light transmission plate 416 is disposed is attached to the surface side as the exterior outside from the cold-cathode fluorescent lamp 418. However, the diameter of the cold-cathode fluorescent lamp 418 is very small, a depth-direction dimension of the exterior illuminator 414 becomes very small, the amount of projection from the exterior panel 413 to the hoistway pit 401*a* side is reduced, interferences with various devices installed in the hoistway pit 401*a* are reduced, and layout changes of the devices in the pit or changes of exterior design can be reduced.

Additionally, in the case of the exterior illuminator 414 which uses the cold-cathode fluorescent lamp 418, compared with the conventional general fluorescent lamp, a lamp life is prolonged, a lamp use period is extended, and the number of replacement times of the cold-cathode fluorescent lamp 418 is reduced.

Over a long period, work time for maintenance can be greatly shortened. Thus, maintenance costs can be reduced greatly.

Figure 34:
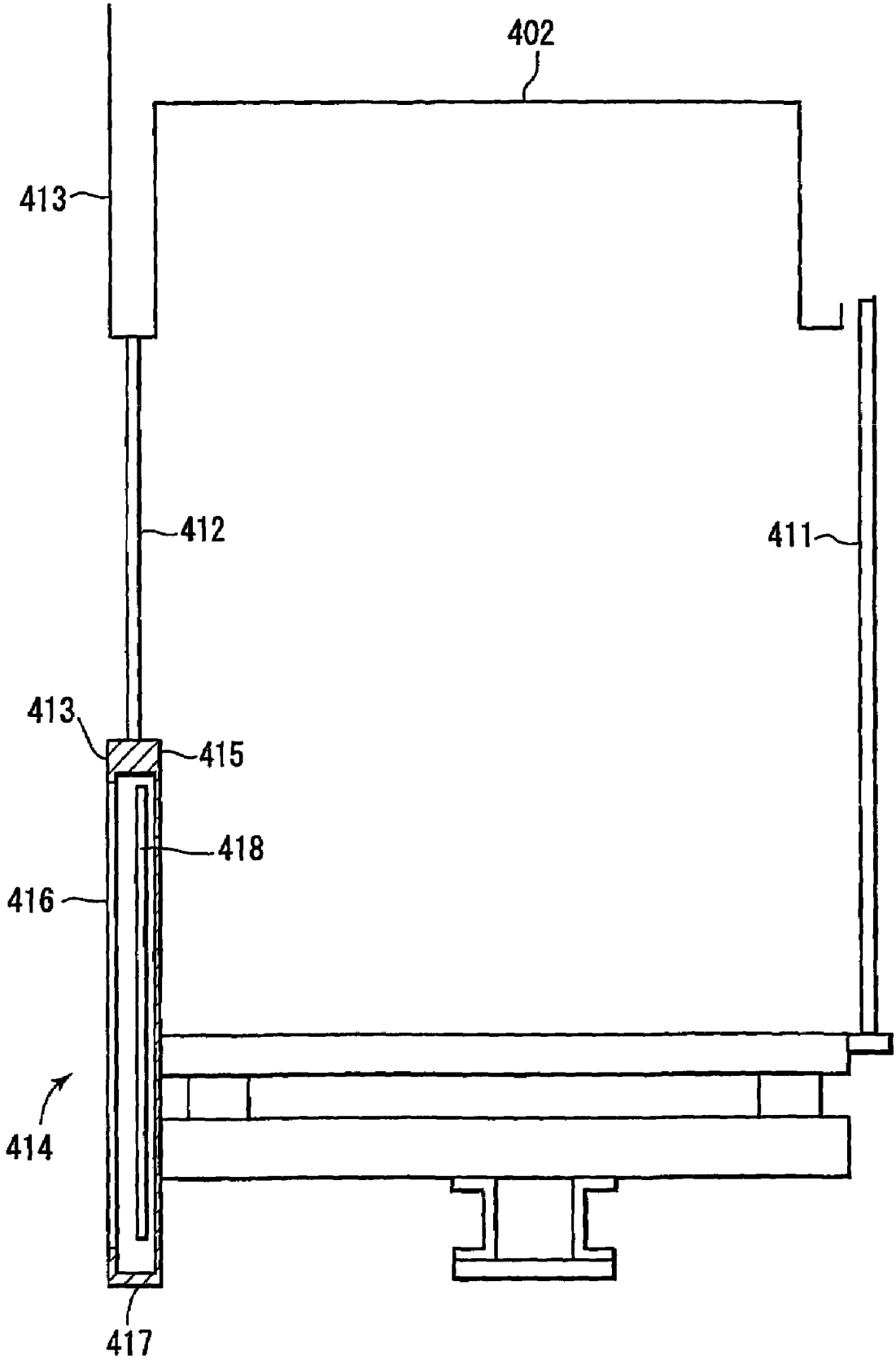
FIG. 34 is an elevator constitutional view showing a modified example of the car exterior lighting system of the elevator shown in FIG. 33.

According to the embodiment, the exterior illuminator 414 which illuminates the exterior outside is attached to the exterior panel 413 of the bottom portion of the cage 402. However, as shown in FIG. 34, by a constitution in which the exterior illuminator 414 is attached to the exterior panel 413 of the bottom portion of the observation window 412, operation effects similar to those of FIG. 33 can be obtained. In this system, since an outside dimension of the cold-cathode fluorescent lamp 418 is small, a part of the exterior panel 413 can be illuminated without enlarging a gap between the exterior panel 413 and the cage inner wall 415. That is, the exterior illuminator 414 can be attached without changing a planar dimension of the exterior panel 413 or without changing a width of the hoistway 401.

Second Embodiment

Figure 35:
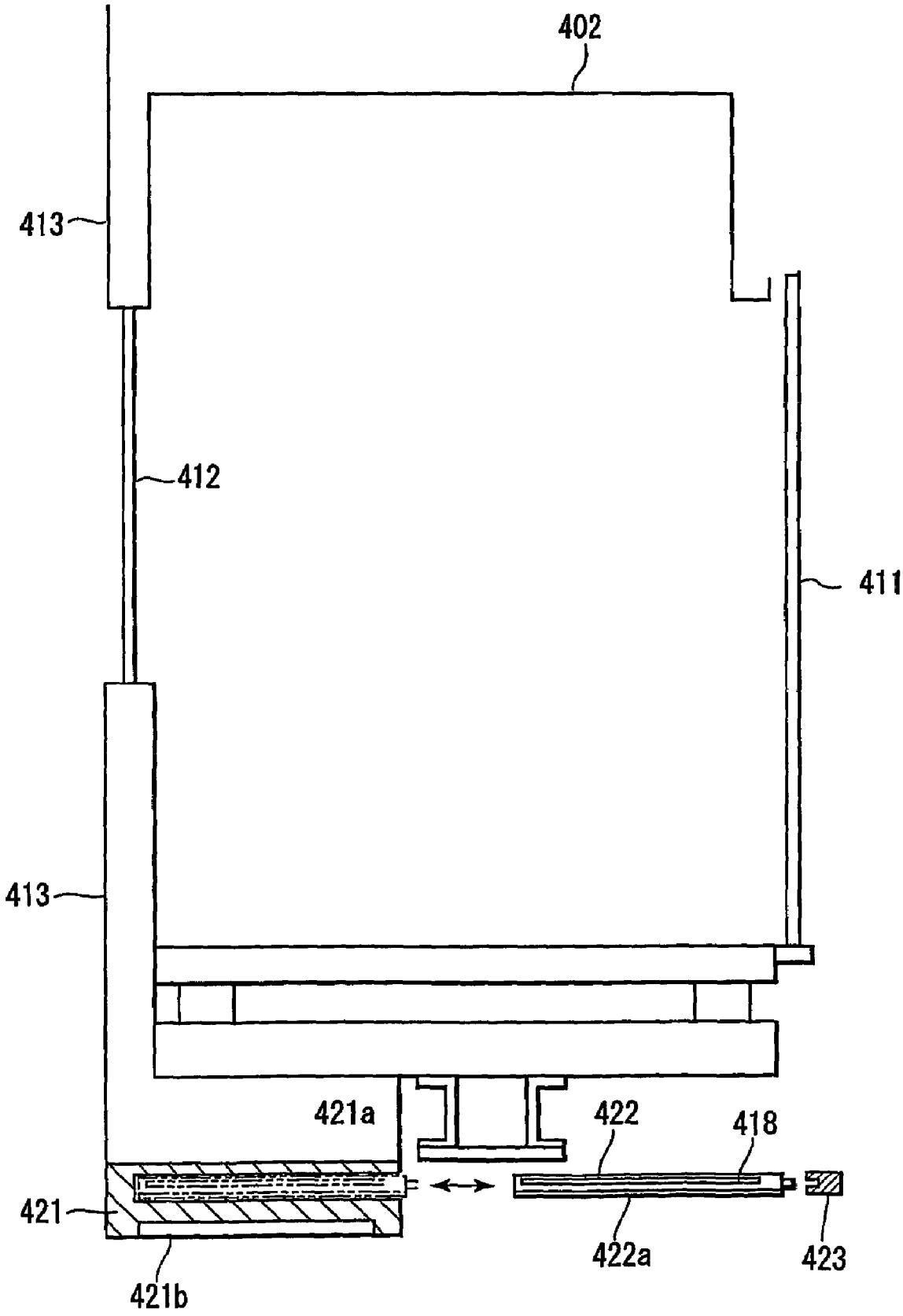
FIG. 35 is an elevator constitutional view explaining another embodiment of a car exterior lighting system of an elevator of the present invention.

FIG. 35 is a constitutional view of an elevator explaining a second embodiment of a car exterior lighting system of the elevator of the present invention. More specifically, it is a view explaining a preferable constitution for replacement of a cold-cathode fluorescent lamp 418 used in an exterior lighting system 414. In the drawings, portions similar to those of FIG. 33 are denoted by similar reference numerals, and for details see FIG. 33.

This exterior illuminator 414 comprises an exterior casing 421 in which a U-shaped loading groove 421*a* is disposed from a shown right end surface toward a left end, and which is constituted of a light transmission section 421*b* at least a side of which facing the outside includes a translucent acrylic material, a lighting unit 422 of a box-shaped casing which houses a stabilizer (not shown) having an inverter function for voltage/current conversion necessary for a cold-cathode fluorescent lamp 418 and lamp lighting, and which is constituted of a light transmission section 422*a* at least a side of which facing the light transmission section 421*a* includes a translucent acrylic material, and detachably inserted into the loading groove 421*a* of the exterior casing 421, and an inspection cap 423 which is engaged with a screw thread formed outside or inside the exterior casing 421 or moved straight and rotated along an L-shaped groove formed in a right end surface or the like of the exterior casing 421 to be locked after the lighting unit 422 is inserted into the loading groove 421*a* of the exterior casing 421, and then fixed to the exterior casing 421.

A power source is installed in the exterior casing 421. As electrical connection means between the power source of the exterior casing 421 and the stabilizer of the lighting unit 422, for example, contacts which become power terminals are disposed at a predetermined interval on the bottom portion of the loading groove 421*a* of the exterior casing 421. On the other hand, if a contact which captures power is added to the shown left end surface of the lighting unit 422, the lighting unit is positioned so that the light transmission section 422*a* can face the light transmission section 421*b* of the exterior casing 421, and inserted, then the power source of the exterior casing 421 side is electrically connected to the stabilizer.

Next, regarding an operation of the lighting system constituted in the aforementioned manner, replacement work of the cold-cathode fluorescent lamp 418 will be described.

When it is necessary to replace the cold-cathode fluorescent lamp 418, if worker rotates the inspection cap 423 in a required direction, the inspection cap 423 is separated from the loading groove 421*a* of the exterior casing 421. In this state, the lighting unit 422 is pulled out from the loading groove 421*a* of the exterior casing 421, replaced by a new lighting unit 422, positioned to be inserted into the loading groove 421*a* of the exterior casing 421, the inspection cap 423 is closed, and then the replacement work of the cold-cathode fluorescent lamp 418 is completed.

Thus, according to the embodiment, because of a very small outside dimension of the cold-cathode fluorescent lamp 418, the lighting system can be formed in a unit including the cold-cathode fluorescent lamp 418. By forming the detachable insertion groove 421*a* in the exterior casing 421, the cold-cathode fluorescent lamp 418 can be replaced by a one-touch operation. Considering a longer life compared with the conventional fluorescent lamp, the replacement work time can be greatly reduced, and thus it is possible to greatly reduce maintenance costs.

As replacement means of the cold-cathode fluorescent lamp 418, if the shown left end of the light transmission plate 416 disposed on the surface side of the box-shaped casing 417 of the exterior illuminator 414 shown in FIG. 33 is attached to the box-shaped casing 417 by a hinge to realize a cap which right end side is opened/closed, it is possible to easily replace the cold-cathode fluorescent lamp 418 in the box-shaped casing 417.

Third Embodiment

Figure 36A:
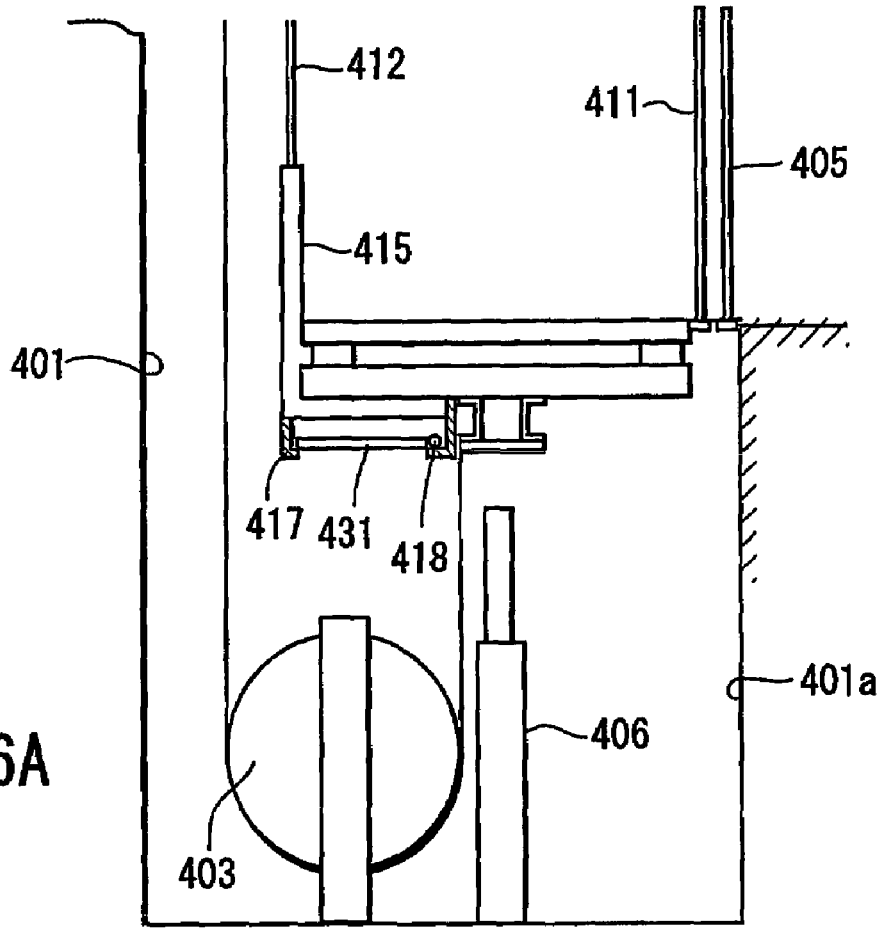
FIG. 36A is an elevator constitutional view explaining yet another embodiment of a car exterior lighting system of an elevator of the present invention, in which the exterior lighting system is attached to an exterior panel of a cage lower portion.
Figure 36B:
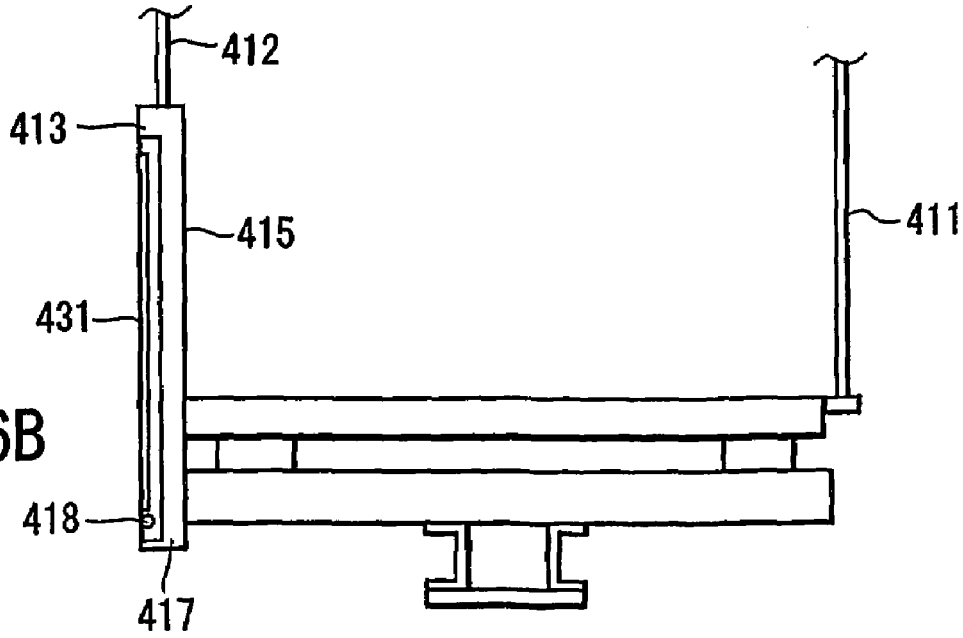
FIG. 36B is an elevator constitutional view explaining yet another embodiment of a car exterior lighting system of an elevator of the present invention, in which the exterior lighting system is attached to an exterior panel of a side of a cage lower portion.

FIGS. 36A and 36B are constitutional views of an elevator explaining a third embodiment of a car exterior lighting system of the elevator of the present invention. FIG. 36A is a view similar to FIG. 33 in which an exterior illuminator 414 is attached to an exterior panel 413 of a bottom portion of a cage 402, and FIG. 36B is a view similar to FIG. 34 in which the exterior illuminator 414 is attached to the exterior panel 413 of a bottom portion of an observation window 412. Thus, in the drawings, portions similar to those of FIGS. 33 and 34 are denoted by similar reference numerals, and for details see FIGS. 33 and 34.

This exterior illuminator 414 is constituted in a manner that while the light transmission plate 416 which includes a translucent acrylic material is disposed on the surface side of the box-shaped casing 417 shown in FIGS. 33, 34, an optical waveguide 431 is disposed in place of the light transmission plate 416, and a cold-fluorescent lamp 418 is disposed to face an end surface of the optical waveguide. Other components are completely similar to those of FIGS. 33, 34. As a result, when the cold-cathode fluorescent lamp 418 is lit, a light emitted from the cold-cathode fluorescent lamp 418 is made incident on the end surface of the optical waveguide 431 and, internally, through propagation by light refraction, a light is outputted from a required one surface portion of the optical waveguide 431.

The optical waveguide 431 has a function of radiating a light introduced from the cold-cathode fluorescent lamp 418 to the outside which has directivity only in a fixed direction while being refracted inside as in the case of an optical fiber. Thus, when seen from the inside of the elevator car, it works to emit a light from the exterior panel.

Therefore, according to the embodiment, in addition to operation effects similar to those of the first embodiment, since the optical waveguide 431 which replaces the light transmission plate 416, and the cold-cathode fluorescent lamp 418 can be arranged on the same line, the exterior illuminator 414 can be easily attached even to the exterior panel 413 which has internal space narrower than that of the aforementioned embodiment.

Fourth Embodiment

Figure 37:
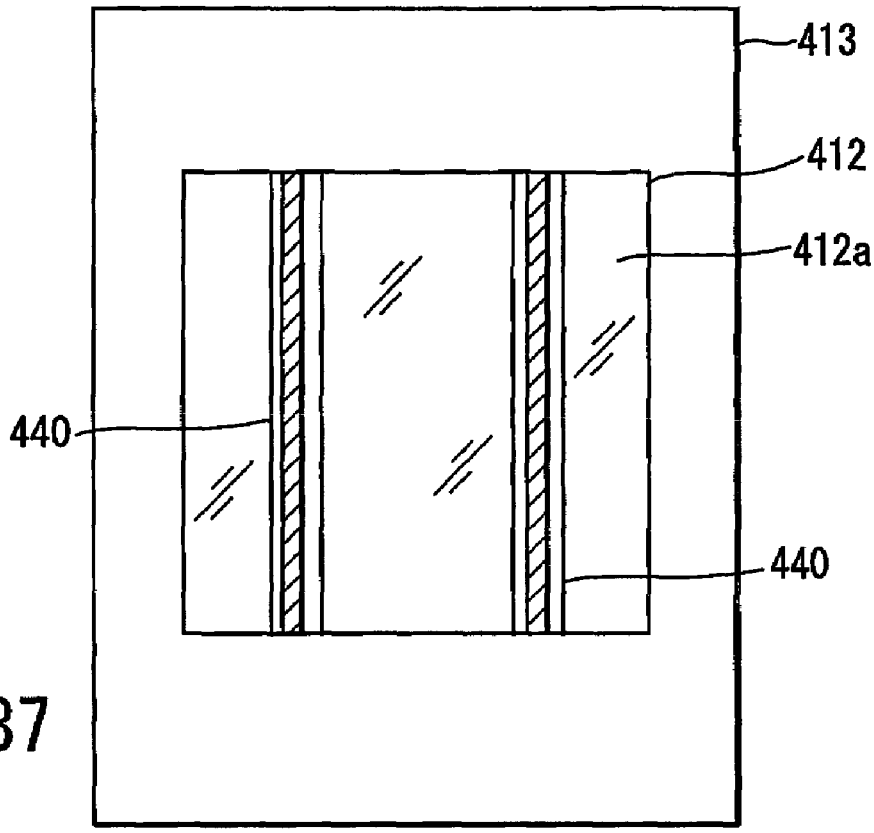
FIG. 37 is a view explaining another attaching example of the car exterior lighting system of the elevator of the present invention.
Figure 38:
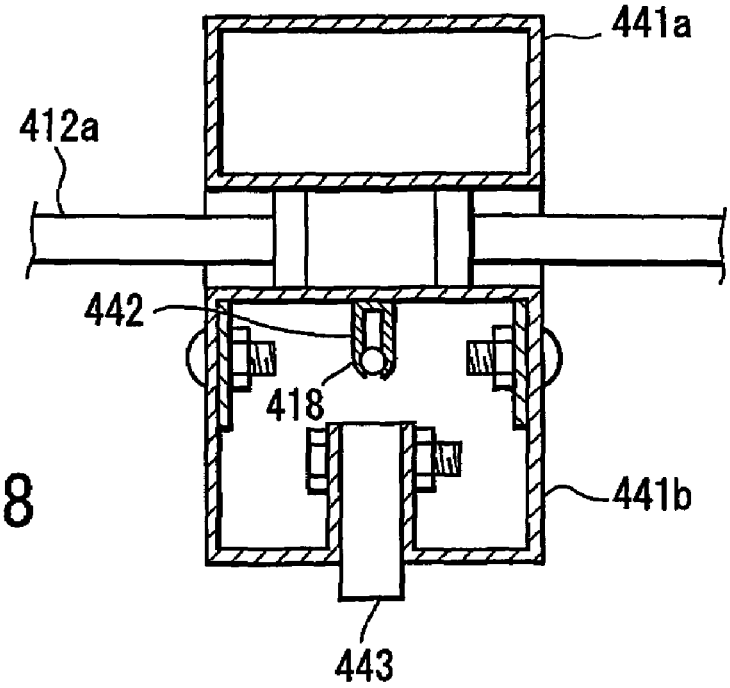
FIG. 38 is a plan sectional view in which the exterior lighting system is attached to a window column shown in FIG. 37.

FIGS. 37 and 38 are views explaining a fourth embodiment of a car exterior lighting system of an elevator of the present invention, more specifically views in which an exterior illuminator 414 is attached to a window column. FIG. 37 is an exterior backside view when an exterior panel 413 including an observation window 412 of a cage 402 is seen from the outside of the cage, and FIG. 38 is a plan sectional view near the window column.

That is, when the cage 402 is seen from the outside of the cage, as shown in FIG. 37, an observation window glass 412*a* is fitted between the observation window (window frame) 412 disposed in the exterior panel 413 and two window columns 440 erected at a required interval.

Specifically, as shown in FIG. 38, the window column 440 is constituted in a manner that two hollow window columns 441*a*, 441*b* are erected to sandwich the observation window glass 412*a* from the inside and the outside, the outer side hollow window column 441*b* is formed in, e.g., an open cap structure by screw fixing, a cold-cathode fluorescent lamp 418 is attached through a lamp holding member 442 in the hollow window column 441*b*, and a light transmission section 443 of a translucent acrylic material or the like is disposed on the open cap structure surface side. As an example of attaching the light transmission section 443 to the open cap structure surface side, there is an example in which the light transmission section 443 is attached to the open cap surface portion to constitute a part of an open cap, or the open cap side is divided into two as shown, two open caps are arranged to sandwich the light transmission section 443 and, by fastening the open caps to each other by a bolt and a nut, the light transmission section 443 is secured to a fixed position.

Thus, according to the embodiment, because of a very small outside dimension of the cold-cathode fluorescent lamp 418, the exterior illuminator 414 can be attached even to narrow space in the window column 440, and the window column can be illuminated.

The present invention is not limited to the aforementioned embodiment, and various changes and modifications can be made without departing from the teachings. The embodiment has been described by way of example in which the cold-cathode fluorescent lamp 411 is used for the exterior illuminator. However, in place of the cold-cathode fluorescent lamp 411, for example, an element such as an LED (light emitting diode) or organic EL (electroluminescence) may be used to emit a light. The element such as an LED or organic EL is arrayed in a bar shape (fluorescent lamp), a ring shape (circular-line) or on a two-dimensional plane as a light source of the exterior illuminator. One LED or organic EL element can be used to constitute a bar shape, a ring shape or a two-dimensional planar shape. In the exterior illuminator, or a lighting unit or an exterior panel which constitutes a part of the exterior illuminator, only an LED may be incorporated, only organic EL may be incorporated, or a cold-fluorescent lamp 411, an ELD and organic EL may be properly combined.

Further, in addition to the use of a white color for the ELD or the organic EL, other colors can be used in accordance with an ambient temperature, the amount of light, a use time zone, a use season etc, and LED and organic El of a plurality of colors can be mixed. Needless to say, in order to emit a light from the element such as an LED or organic EL, the driving control device which has conventionally been used generally is used.

Furthermore, the embodiments can be implemented by being combined as much as possible and, in such a case, effects by the combination can be obtained. Each embodiment includes various inventions of upper and lower stages, and various inventions can be extracted by proper combination of the plurality of disclosed components. For example, if some of all the component requirements described in means to solve the problems are omitted to extract the invention, the omitted portions are properly compensated for by a well-known customary technology in the case of implementing the extracted invention.

As described above, according to the present invention, it is possible to greatly reduce the outside dimension of the exterior illuminator of the cage. For example, in the case of attachment to the exterior panel of the bottom side of the cage, it is possible to prevent changes or the like in device layout of the hoistway pit. In the case of attachment to the exterior panel of the cage side face, expansion of the hoistway is not necessary, and it is possible to surely attach the illuminator even to a narrow exterior panel.

According to the present invention, since the cold-cathode fluorescent lamp, the LED, the organic EL or the like is used as the exterior illuminator, compared with the conventional lamp, an execution cycle of the lamp replacement work can be made longer, the time of the lamp replacement work can be shortened, and maintenance costs can be reduced.

<Lighting System of Elevator Cage>

Figure 39:
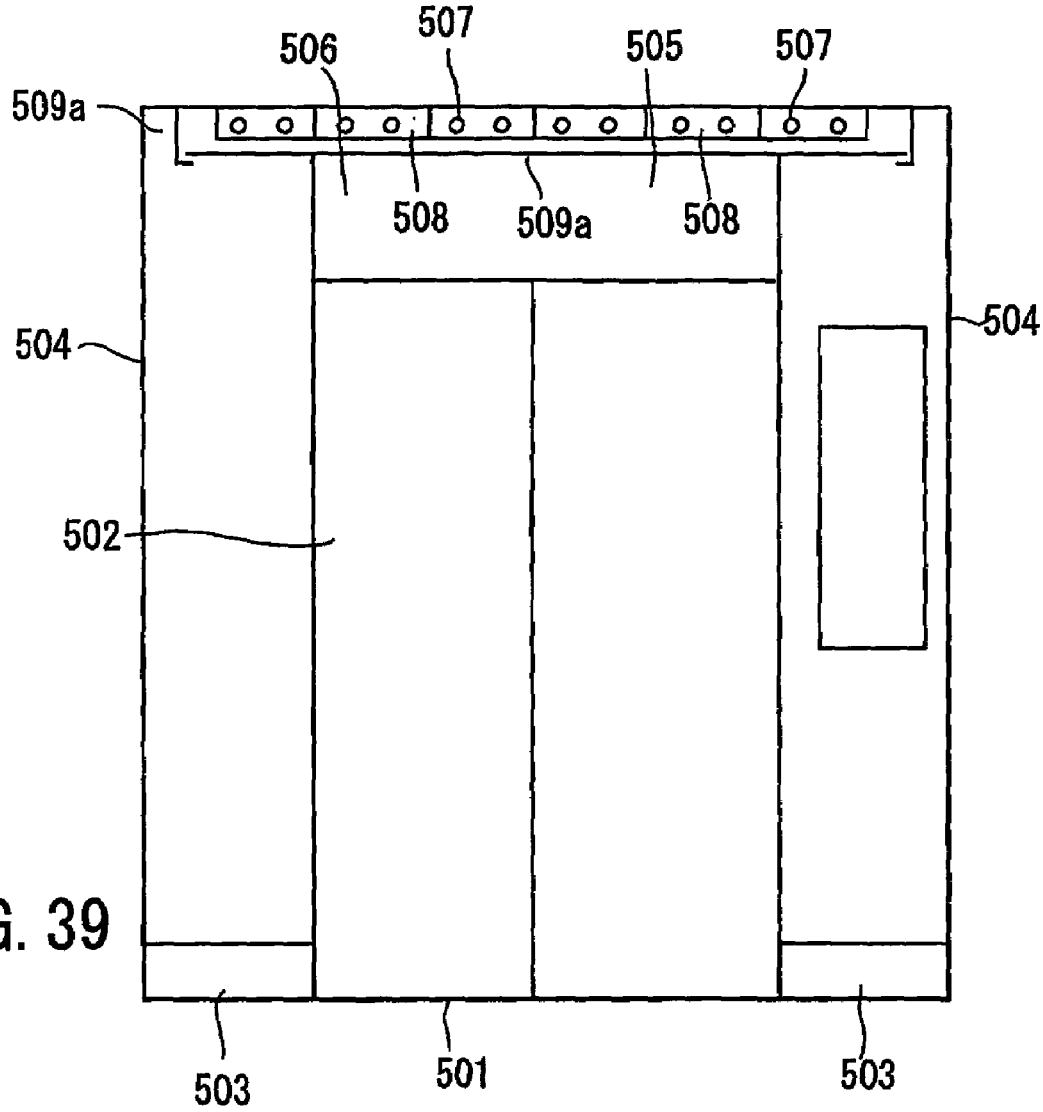
FIG. 39 is a front view showing a first embodiment of lighting system of en elevator cage of the present invention.

Next, the embodiment of the present invention will be described. FIG. 39 is a front view showing a first embodiment of a lighting system of an elevator cage of the present invention.

Figure 41:
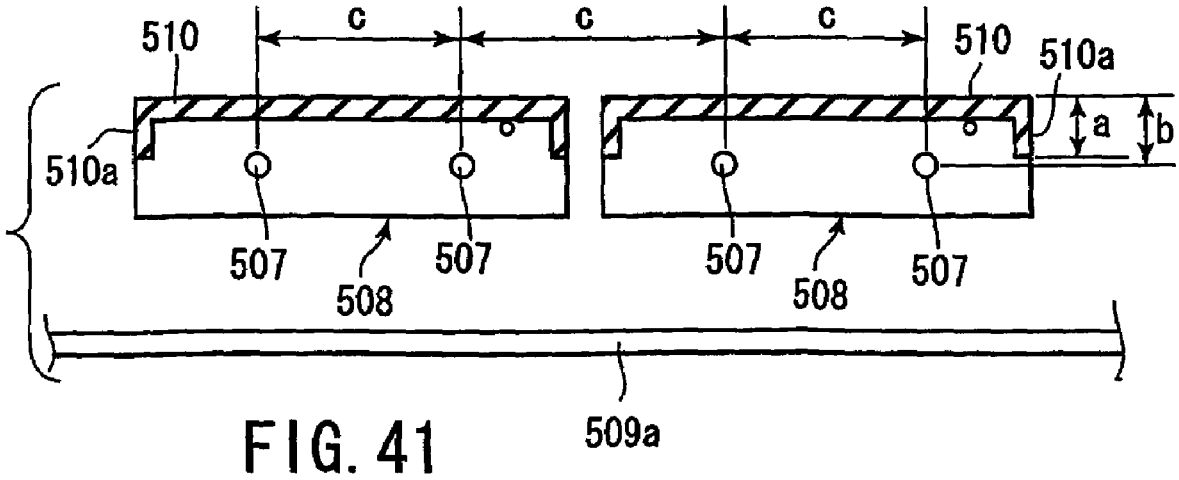
FIG. 41 is a front sectional view showing an enlarged main section of FIG. 39.
Figure 40A:
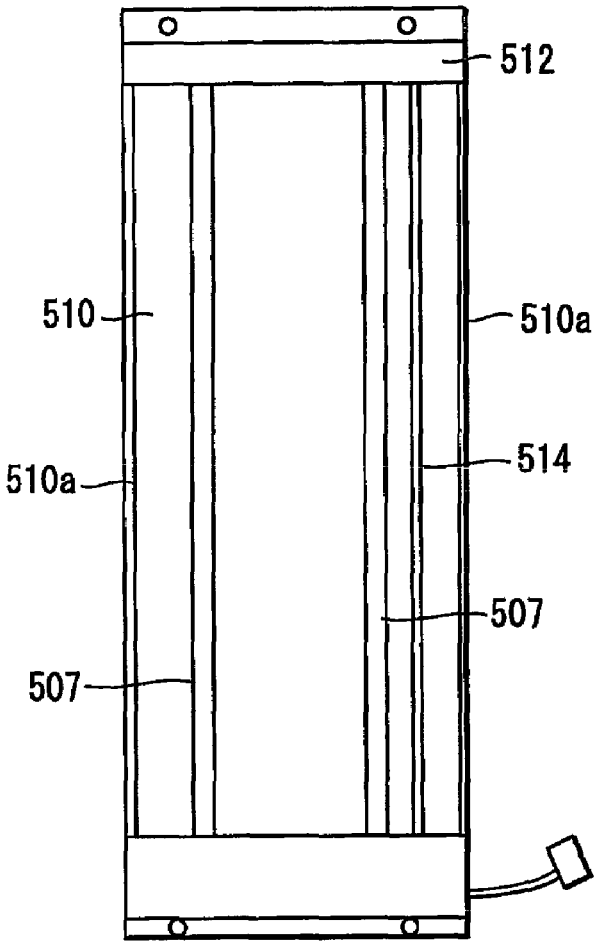
FIGS. 40A to 40C are respectively front, side sectional and bottom sectional views showing a lighting fixture used in the first embodiment of FIG. 39.
Figure 40B:
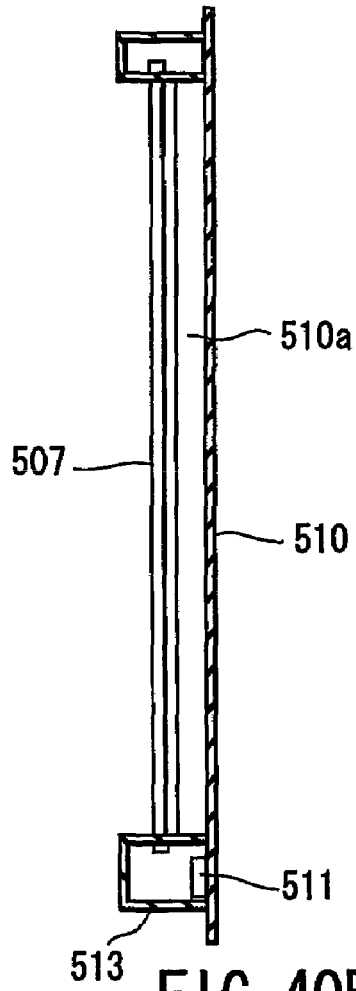
Figure 40C:
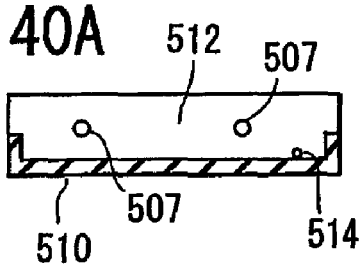

FIGS. 40A to 40C are front, side sectional and bottom sectional views showing a lighting tool used in the first embodiment of FIG. 39. FIG. 41 is a front sectional view showing in expansion a main portion of FIG. 39.

In FIG. 39, a base 503 is fixed around an upper surface of a cage floor 501 except an entrance 502 of the front, and a plurality of side plates 504 are adjacently arrayed on the base 503. On the entrance 502, an end rail 505 is disposed to be held between both side plates 504.

The lighting system is constituted in a manner that a top plate 506 is attached to the plurality of side plates 504 and the end rail 505 to constitute a ceiling portion, a plurality of lighting tools 508 in which a plurality of cold-cathode fluorescent lamps 507 are disposed to constitute a unit light source are arranged in parallel on the bottom surface of the top plate 506, and an illumination plate 509*b* is positioned below the lighting tools 508 to cover the plurality of lighting tools 508 and supported by a box body 509*a*. The illumination plate 509*b* is made of a synthetic resin cover in which a concave/convex portion, a groove or the like is disposed in a translucent milk-white or transparent body to increase light scattering.

As shown in FIGS. 40A to 40C, the lighting tool 508 in the lighting system is constituted in a manner that a plurality, e.g., two, cold-cathode fluorescent lamps 507 of 1 mm to 6 mm in diameter are arranged in parallel to be supported on a rectangular reflection plate 510 which serves also as a unit case, and a stabilizer 511 which has an inverter function to drive the cold-cathode fluorescent lamp 507 is integrally attached to one end in a longitudinal direction. The cold-cathode fluorescent lamp 507 and the stabilizer 511 are supported and fixed to the reflection plate 510 by covers 512, 513 made of insulators, connected to each other by an electric wire or the like, and connected to the outside by a connector 515.

The covers 512, 513 are fixed to the reflection plate 510 to cover the end of the cold-cathode fluorescent lamp 507 and the terminal connection portion of the stabilizer 511.

Rising pieces 510*a*, 510*b* are disposed on both side edges positioned in both sides of the reflection plate 510 opposite the cold-cathode fluorescent lamp 507 to increase mechanical strength of the reflection plate 510. A height dimension a of each of the rising pieces 510*a*, 510*b* from the bottom side of the reflection plate 510 to the tip is, as shown in FIG. 41, shorter than a height dimension b from the bottom side of the reflection plate 510 to the center of the cold-cathode fluorescent lamp 507, a luminous flux of the cold-cathode fluorescent lamp 507 is widened by 180° or more, and diffused by the illumination plate 509 to brightly illuminate the inside of the cage.

The plurality of lighting tools 508 are attached by being arrayed in parallel on the ceiling portion of the cage, and especially arranged, as shown in FIG. 41, so that an interval c between the cold-cathode fluorescent lamps 507 of the adjacent lighting tools 508 can be approximately equal to an interval c between the plurality of cold-cathode fluorescent lamps 507 disposed in each lighting tool 508. Accordingly, the plurality of cold-cathode fluorescent lamps 507 in the plurality of lighting tools 508 are arranged all at equal intervals.

Thus, by arranging the plurality of cold-cathode fluorescent lamps 507 in parallel in the plurality of lighting tools 508 to reflect the light on the common reflection plate 510, arranging the cold-cathode fluorescent lamps 507 of each lighting tool 508 at equal intervals, setting the height dimension a of the rising piece 510*a* in the reflection plate 510 shorter than the height dimension b, and radiating the luminous flux of the cold-cathode fluorescent lamp 507 from the reflection plate 510 toward the illumination plate 509*b* by 180° or more, the illumination plate 509*b* can be illuminated without generating any uneven lights.

Each lighting tool 508 is constituted as a unit to facilitate handling, and replacement work can be reduced by using characteristics of the long-life cold-cathode fluorescent lamp.

Further, since the electrical connection portions of the cold-cathode fluorescent lamp 507 and the stabilizer 511 are covered with the insulator covers 512, 513, an electric shock is prevented during inspection and replacement of the lighting tool 508.

According to the first embodiment, the height dimension a of the rising piece 510*a* of the reflection plate 510 from the bottom side to the tip is set shorter than the height dimension b from the bottom side of the reflection plate 510 to the center of the cold-cathode fluorescent lamp 507. However, in order to further increase the mechanical strength of the reflection plate 510, the height dimension a of the rising piece 510*a* can be made longer than the height dimension b to protect the exposed cold-cathode fluorescent lamp 507.

Figure 42:
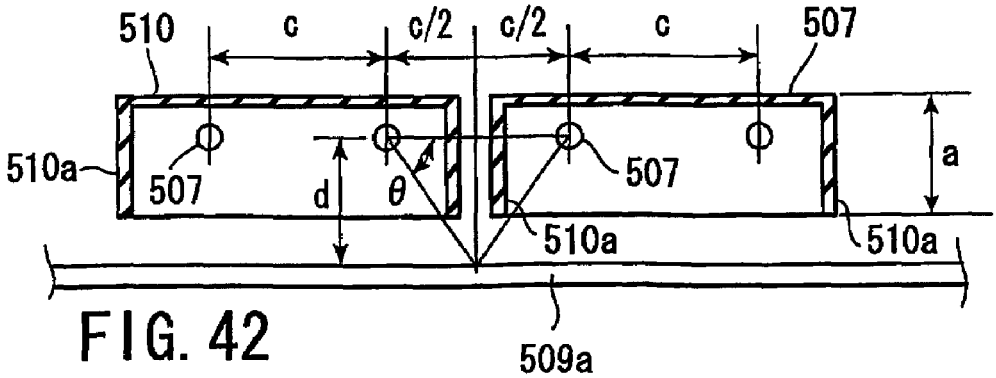
FIG. 42 is a sectional view of a main section in a second embodiment of the present invention.

FIG. 42 is a sectional view of a main portion showing a second embodiment of the present invention, showing a constitution in which a height dimension a of a rising piece 510*a* is longer than a height dimension b. In this case, the height dimension a of the rising piece 510*b* is set so that an angle between a straight line connecting a center of a cold-cathode fluorescent lamp 507 positioned near the rising piece 510*a* with a tip of the cold-cathode fluorescent lamp 507 and a straight line connecting centers of cold-cathode fluorescent lamps 57 of adjacent lighting tools 508, 508 with each other can be 54° or lower.

That is, as in the case of the first embodiment, when a plurality of lighting tools 508 each of which comprises a plurality of cold-cathode fluorescent lamps 507 are arrayed on a ceiling portion, a constitution in which a distance c between the cold-cathode fluorescent lamps 507 in each lighting tool 508 is set equal to a distance c between the cold-cathode fluorescent tools 507 of adjacent lighting tools 507 is most effective for preventing generation of uneven lights on the surface of an illumination plate 509*b*.

On the other hand, from a general rule of an illumination technology that if a distance c between light sources is smaller than 1.5 times of a distance d from a center of the light source to the illumination plate, no uneven light is generated on the illumination plate, the following is established:

$$1.5d \geqq c \tag{1}$$

If this is applied to the adjacent lighting tools 508 as shown in FIG. 42, the following equation (2) is obtained:

$$\tan\theta = d/0.5c \tag{2}$$

$\theta = 53.1°$ is obtained. Thus, it is advised to set $\theta \leqq 5.4°$ considering a tube diameter. If larger than $\theta = 54°$, the lighting tools must be brought closer to each other, or the distance d must be increased to reduce an uneven light. However, according to the constitution of the embodiment, the tool strength can be increased by increasing the height dimension a of the rising piece 510*b* without causing such a problem.

Figure 43:
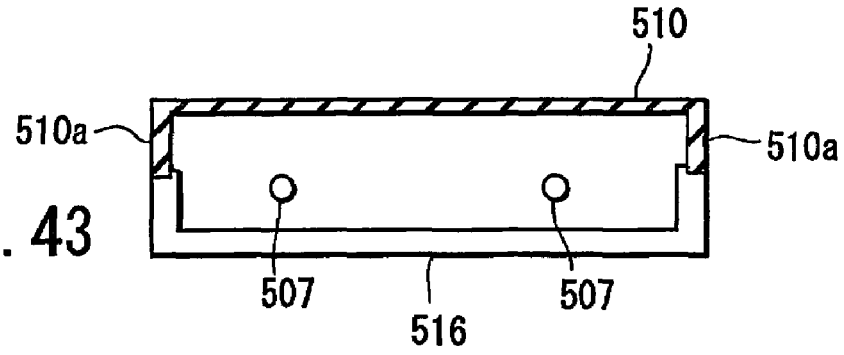
FIG. 43 is a sectional view of a lighting fixture in a third embodiment of the present invention.

FIG. 43 is a sectional view of a lighting tool of a third embodiment of the present invention. In the aforementioned embodiment, the cold-cathode fluorescent lamp 507 is exposed. However, according to the embodiment, a plurality of cold-cathode fluorescent lamps 507 are covered with a transparent synthetic resin cover 516 to enable protection of the cold-cathode fluorescent lamps 507.

A heater can be disposed in the lighting tool 508 to improve operation efficiency of the cold-cathode fluorescent lamp 507.

As described above, according to the lighting system of the elevator cage of the present invention, the plurality of lighting tools are constituted of the plurality of cold-cathode fluorescent lamps, and arranged so that the interval between the cold-cathode fluorescent lamps of the adjacent lighting tools can be approximately equal to the interval between the plurality of cold-cathode fluorescent lamps disposed in each lighting tool. Thus, since the illumination plate can be uniformly illuminated, no uneven light is generated on the illumination plate, and replacement work can be reduced by using characteristics of the long-life cold-cathode fluorescent lamp.

<Blackout Lamp Device of Elevator>

Next, the embodiment of the present invention will be described with reference to the accompanying drawings.

Figure 44:
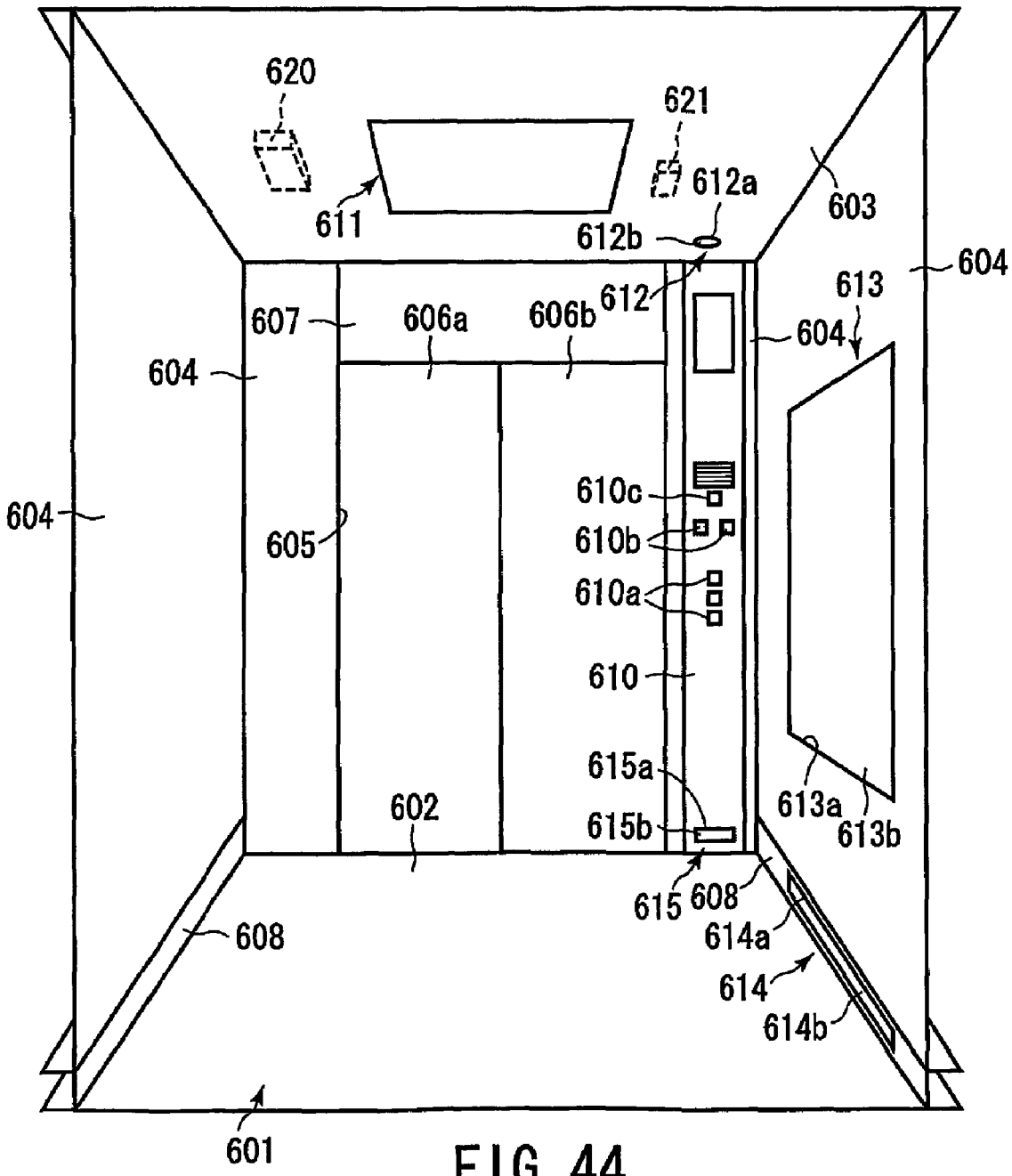
FIG. 44 is an appearance perspective view of the inside of an elevator cage showing an embodiment of the present invention.

FIG. 44 is an appearance view when the inside of a cage 601 is seen from the backside to the front side. The cage 601 comprises a floor portion 602, a ceiling portion 603, and a plurality of side plates 604. An entrance 605 is formed on the front of the cage 601 and, in the entrance 605, for example, double-open doors 606*a*, 606*b* are disposed so as to be opened/closed.

An end rail 607 is disposed on the entrance 605, and a base 608 is disposed between the floor portion 602 and the side plate 604.

An operation panel 620 is disposed in one side plate 604 of the entrance 605 and, in this operation panel 610, a destination floor registration button 610*a*, a door opening/closing button 610*b*, an interphone button 610*c* operated in emergency, etc., are arranged.

On the ceiling portion 603, a main lighting system 611 is disposed in a center to illuminate the inside of the cage 601 at normal time, and a blackout lamp 612 which is lit at the time of a blackout as in the conventional case is disposed at a corner adjacent to the operation panel 610.

Further, according to the present invention, blackout lamps 613, 614, 615 are disposed in one side plate 604 of the left and right sides of the cage 601 adjacent to the operation panel 610, in the base 608 in the bottom side of the side plate 604, and in the bottom portion of the operation panel 610.

Figure 45:
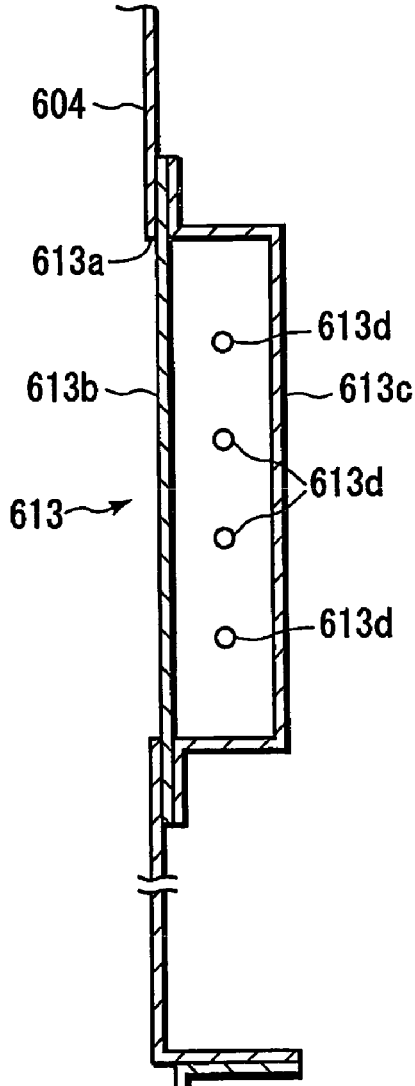
FIG. 45 is a sectional view showing a side face of the cage and a structure of a blackout lamp disposed in a base.
Figure 45:
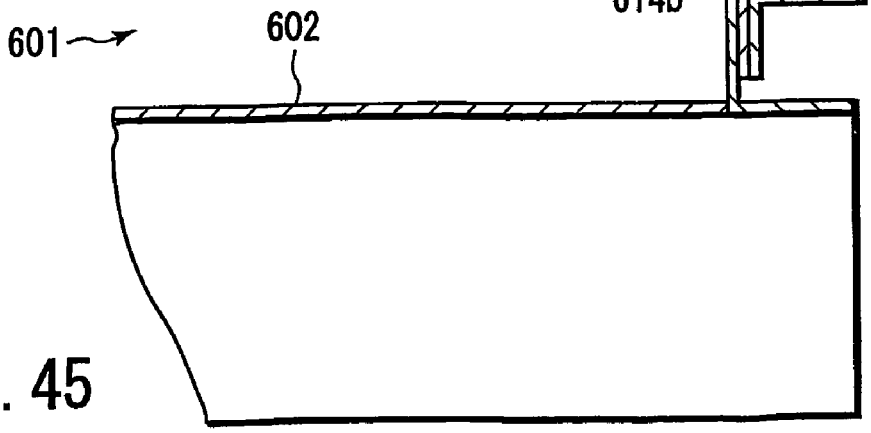
Figure 48:
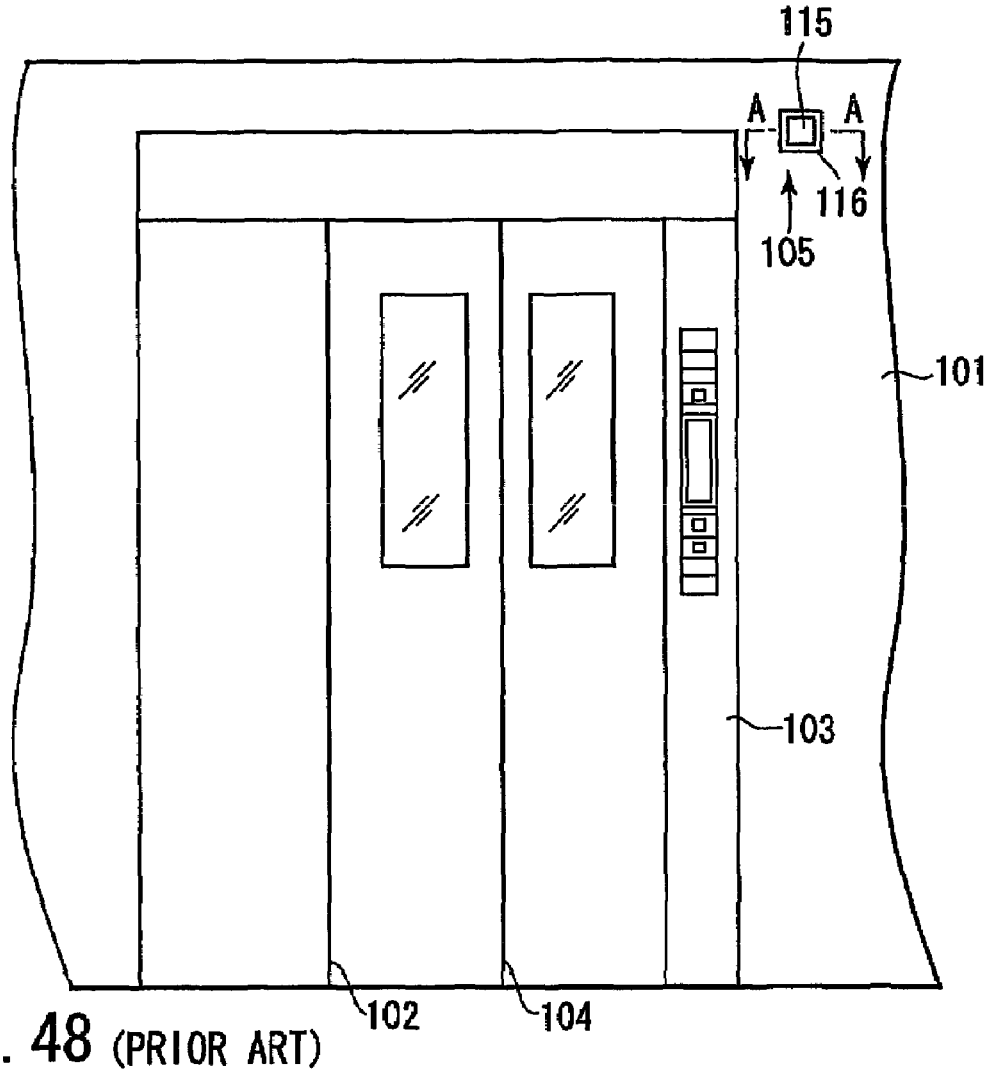
FIG. 48 (PRIOR ART)
FIG. 48 is a front view showing a conventional hall lantern disposed at a landing hall of an elevator.
Figure 49:
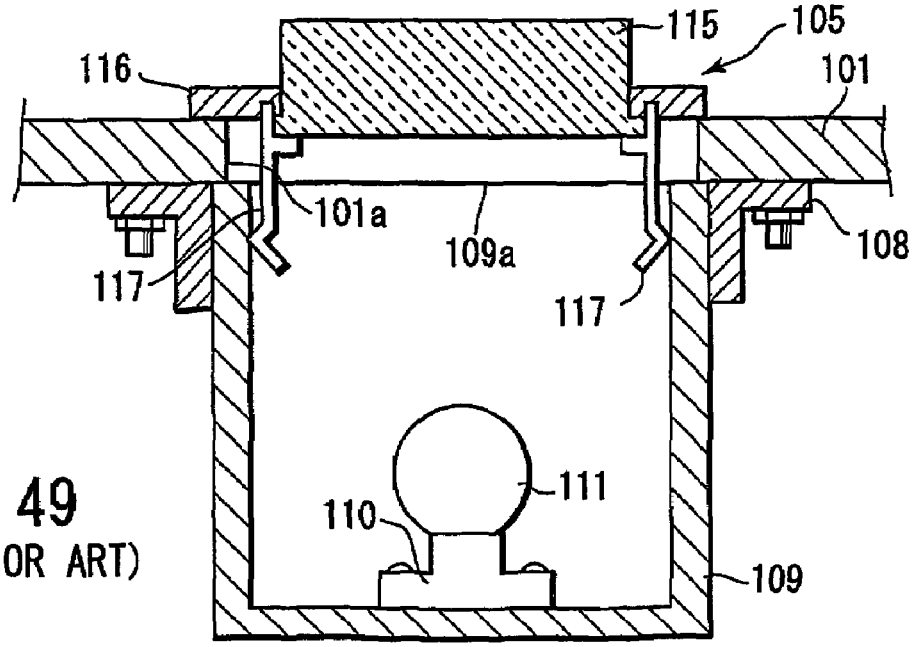
FIG. 49 (PRIOR ART)
FIG. 49 is a sectional view cut along the line A-A of FIG. 48.
Figure 50A:
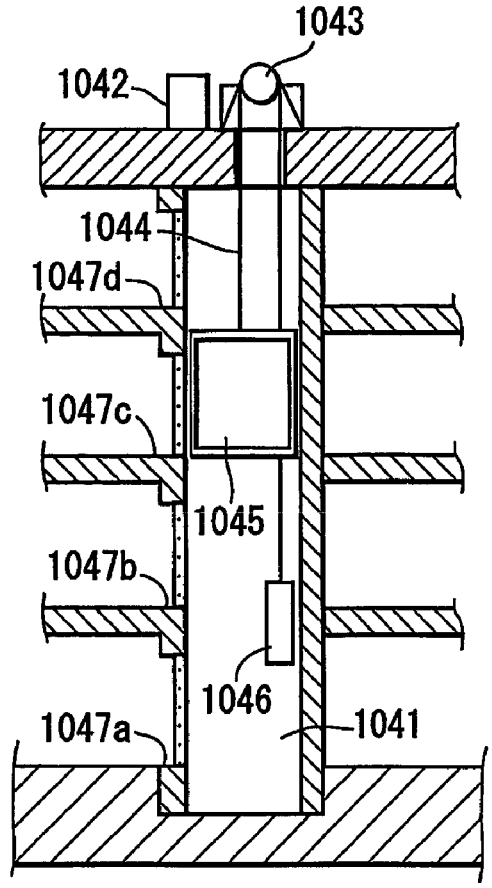
FIG. 50A (PRIOR ART)
FIGS. 50A and 50B are conceptual views showing a conventional elevator threshold.
Figure 50B:
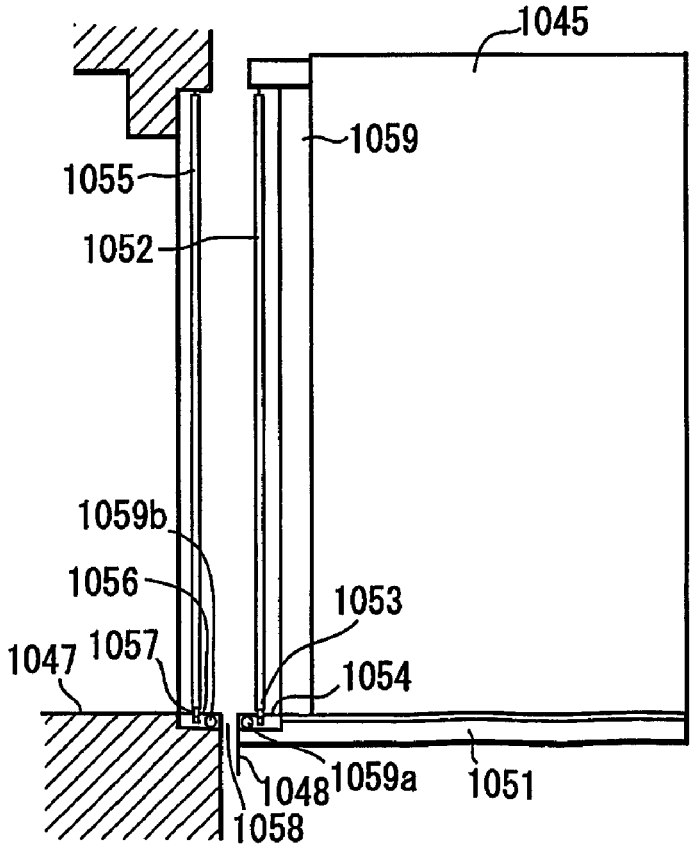
FIG. 50B (PRIOR ART)
Figure 51:
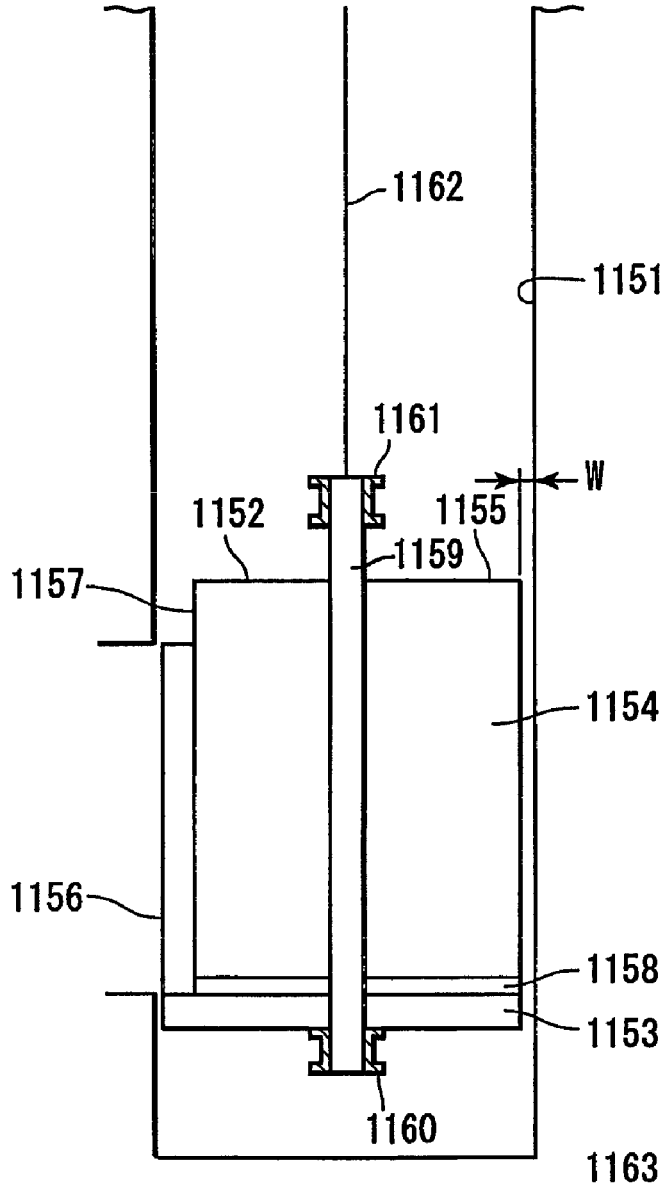
FIG. 51 (PRIOR ART)
FIG. 51 is a view explaining a schematic constitution of an elevator.
Figure 52:
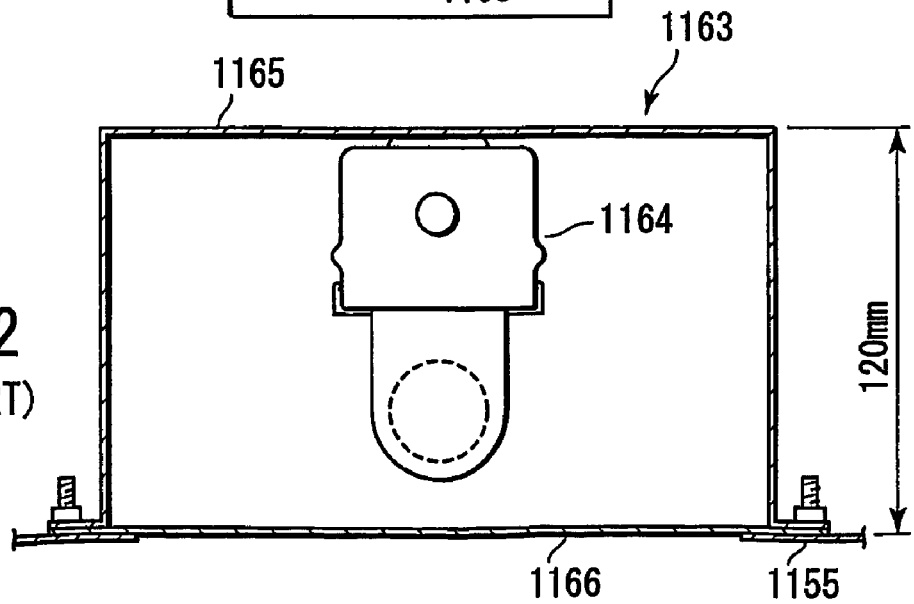
FIG. 52 (PRIOR ART)
FIG. 52 is a sectional view explaining a conventional lighting system.
Figure 53:
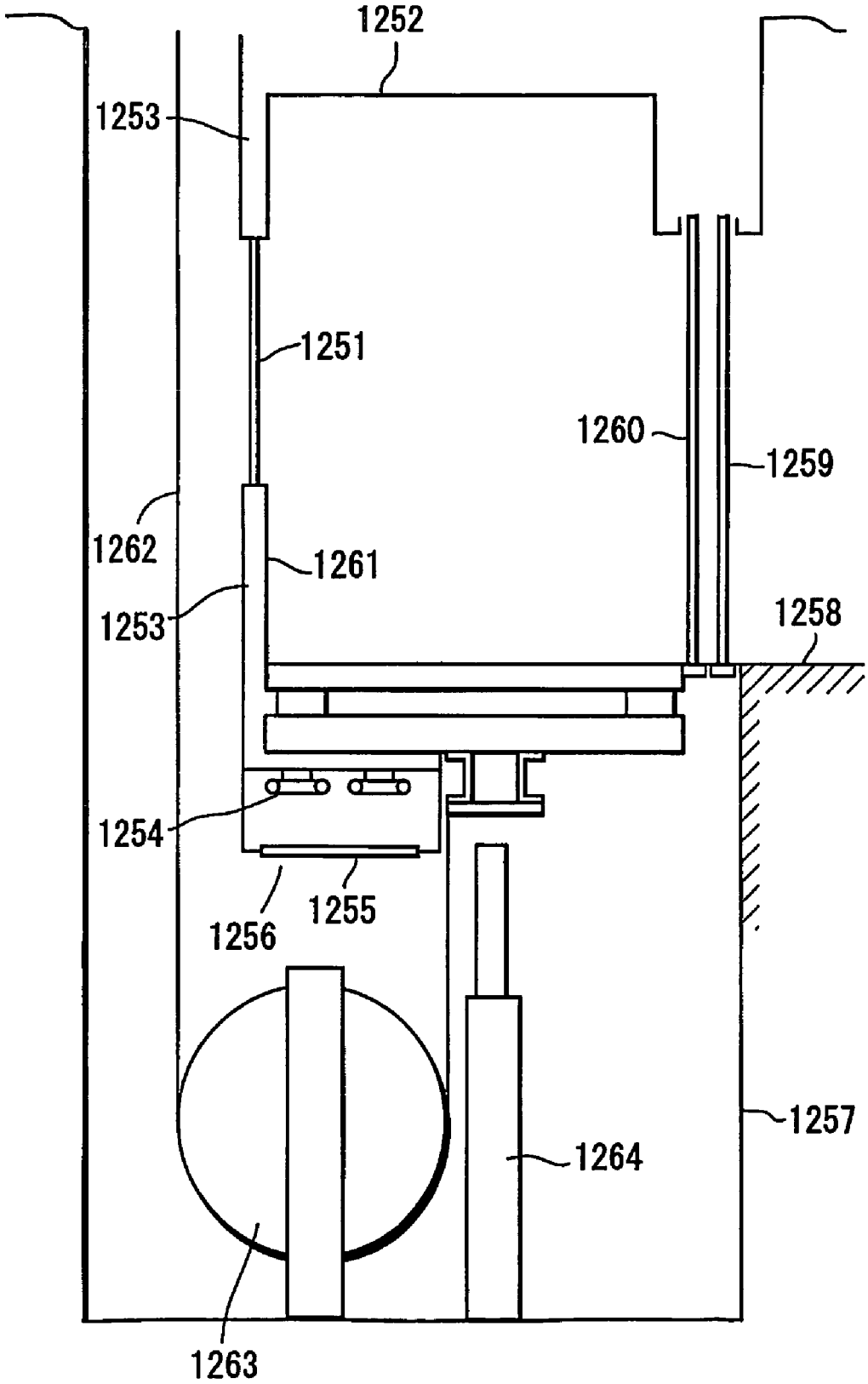
FIG. 53 (PRIOR ART)
FIG. 53 is an elevator constitutional view explaining a conventional car exterior lighting system of an elevator.

FIG. 45 shows a structure of the blackout lamps 613, 614 disposed in the side plate 604 and the base 608. The blackout lamp 613 disposed in the side plate 604 comprises a large opening window 613*a* formed in the side plate 604, a translucent cover 613*b* to cover the opening window 613*a*, a light source case 613*c* attached to the backside of the translucent cover 613*b*, and a plurality of light sources 613*d* disposed in the light source case 613*c*.

The blackout lamp 614 disposed in the base 608 comprises a small opening window 614*a* formed in the base 608, a translucent cover 614*b* to cover the opening window 614*a*, a light source case 614*c* attached to the backside of the translucent cover 614*b*, and a light source 614*d* disposed in the light source case 614*c*.

Figure 46:
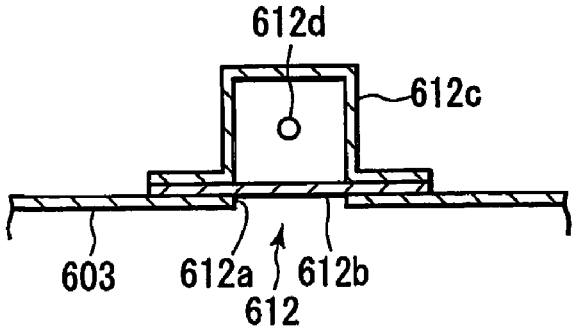
FIG. 46 is a sectional view showing a structure of a blackout lamp disposed on a ceiling portion of the cage.
Figure 47:
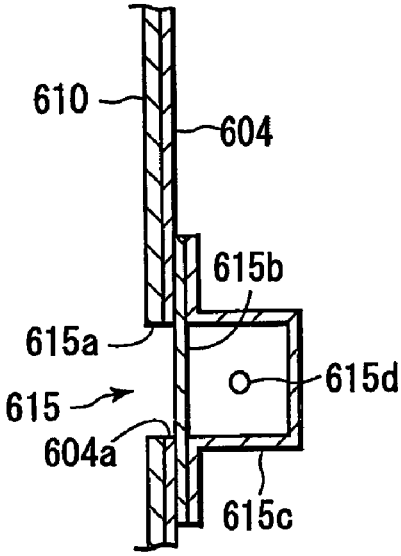
FIG. 47 is a sectional view showing a structure of a blackout lamp disposed in an operation panel of the cage.

Further, FIG. 46 shows a structure of the blackout lamp 615 disposed in the bottom portion of the operation panel 610, and FIG. 47 shows a structure of the blackout lamp 612 disposed on the ceiling portion 603. The blackout lamp 615 disposed in the operation panel 610 comprises opening windows 615*a*, 604*a* formed in the operation panel 610 and the side plate 604 of the backside thereof, a translucent cover 615*b* to cover the opening windows 615*a*, 604*a*, a light source case 615*c* attached to the backside of the translucent cover 615*b*, and a light source 615*d* disposed in the light source case 615*c*.

The blackout lamp 612 disposed in the ceiling portion 603 comprises an opening window 603*a* formed in the ceiling portion 603, a translucent cover 603*b* to cover the opening window 603*a*, a light source case 603*c* attached to the backside of the translucent cover 603*b*, and a light source 613*d* disposed in the light source case 603*c*.

As light sources 612*d*, 613*d*, 614*d*, 615*d* of the blackout lamps 612, 613, 614, 615, for example, cold-cathode fluorescent lamps are used. The cold-cathode fluorescent lamp comprises a translucent discharge container having a diameter of about 1 mm to 6 mm, a pair of cold cathodes sealed to both sides of the discharge container, a fluorescent material coated on an inner surface of the discharge container, and a discharge medium sealed in the discharge container. The cold-cathode fluorescent lamp has characteristics that since the cold cathode emits lights without being heated, a life is not dependent on the number of ON/OFF times of illumination but decided simply by light emission time. Additionally, the cold-cathode fluorescent lamp has a feature that it is immediately lit when a high voltage is applied, and thus there is no time delay until light emission.

As shown in FIG. 44, for example, on the upper portion of the ceiling portion 603 of the cage 601, a blackout detector 620 to detect the occurrence of a blackout and a secondary battery 621 as a battery device are disposed. At normal time, the main lighting system 611 is energized by a commercial power source, and this main lighting system 611 is lit to brightly illuminate the inside of the cage 611 as a whole.

When a blackout occurs to turn OFF the main lighting system 611, the occurrence of the blackout is detected by the blackout detector 620 and, in accordance with the detection, power is supplied from the power source of the secondary battery 621 to the light sources 612*d*, 613*d*, 614*d*, 615*d* of the blackout lamps 612, 613, 614, 615 to be lit.

By the lighting of the blackout lamp 612 of the ceiling portion 603, the inside of the cage 601 is illuminated from the ceiling portion 603 as in the conventional case. According to the embodiment, however, by the lighting of the blackout lamp 614 of the base 608 in addition to the illumination from the ceiling portion 603, a floor surface portion in the cage 601, i.e., a foot portion of a passenger is illuminated. By the lighting of the blackout lamp 613 of the side plate 604, nearly all the areas in the cage 601 including the surface of the operation panel 610 are illuminated. By the lighting of the blackout lamp of the bottom portion of the operation panel 610, an area around the bottom portion of the operation panel 610 is illuminated, and a position of the operation panel 610 is notified.

By the lighting of the blackout lamps 612, 613, 614, 615, the entire portion including the floor surface in the cage 601 is illuminated all over, and thus the passengers in the cage 601 never feel uneasy. The lighting of the blackout lamp 615 of the bottom portion of the operation panel 610 enables the passengers to clearly see the position of the operation panel 610, and the surface of the operation panel 610 is brightly illuminated by the blackout lamp 613. Thus, the interphone button 610*c* or the like can be quickly operated without any bewilderment.

Each of the cold-cathode fluorescent lamps as the light sources 612*d*, 613*d*, 614*d*, 615*d* of the blackout lamps 612, 613, 614, 615 is a thin tube of a diameter of about 1 mm to 6 mm as described above. Thus, the blackout lamps 612, 613, 614, 615 can be constituted compact (thin) to be easily installed in narrow space on the outer peripheral side of the cage 601.

Different from the conventional general fluorescent lamp (hot-cathode fluorescent lamp), the cold-cathode fluorescent lamp has no cathode which becomes high in temperature by energization, and long-life characteristics of 100000 hours. Thus, a replacement time can be greatly extended, and maintenance management or the like is facilitated.

Incidentally, since the translucent cover 613*b* of the blackout lamp 613 of the side plate 604 has a relatively large area, design in the cage 601 can be improved by executing illustrations such as pictures or characters on the translucent cover 613*b*, and lighting the blackout lamp 613 of the side plate 604 at normal time. Moreover, design in the cage 601 can be improved by selectively lighting the other blackout lamps 612, 614, 615 at normal time.

According to the embodiment, the blackout lamps are disposed in the side plate, the base and the operation panel of the cage. However, blackout lamps may be disposed only in one or a few of those.

As the light source of the blackout lamp, in addition to the use of the cold-cathode fluorescent lamp, for example, an LED (light emitting diode) or organic EL (electroluminescence) can be used. In this case, for example, a plurality of LED or organic EL elements can be mounted to a holder or the like of a proper shape to be formed in a unit of a bar shape, a ring shape or a two-dimensional plane, and used. By using one LED or organic EL element, a bar shape, a ring shape or a two-dimensional plane can be formed.

As the light source, only an LED may be used, only organic EL may be used, or proper numbers of LED and organic EL elements may be combined to be used.

The LED or the organic EL of a white color or other colors can be used, and pluralities of color LED and organic EL elements can be mixed. Further, a cold-cathode fluorescent lamp can be used as a light source together with the LED or the organic EL.

Furthermore, needless to say, as means for emitting a light from the LED or the organic. EL, a driving control device which has conventionally been used generally is used.

According to the embodiment, the secondary battery is used as the power source to light the blackout lamp. However, a battery device such as a capacitor can be used.

As described above, according to the present invention, it is possible to effectively illuminate a required portion in the cage when a blackout occurs to soften anxiety of the passengers, and to enable clear recognition of the position of the operation panel and the content of the button.

INDUSTRIAL APPLICABILITY

As descried above, the present invention can be applied to an elevator lighting system.

The invention claimed is:

1. A lighting system of an elevator comprising:

a cage which a user can get on/off;

a cold-cathode fluorescent lamp disposed in the cage to illuminate the inside of the cage, a life of the cold-cathode fluorescent lamp being resistant to switching action of the lighting system;

a heat-retention section disposed in the vicinity of the cold-cathode fluorescent lamp to keep the cold-cathode fluorescent lamp at a predetermined temperature; and a reflection plate which is directly attached to the heat-retention section to reflect a light emitted from the cold-cathode fluorescent lamp toward inside of the cage, wherein the heat-retention section configured to keep the cold-cathode fluorescent lamp at a predetermined temperature of 25° C.

2. The system according to claim 1, wherein the reflection plate reflects an illumination light emitted from the cold-cathode fluorescent lamp in a predetermined direction.

3. A lighting system of an elevator comprising:

a side plate which includes a part of the elevator car; an opening bored in a surface portion of the side plate;

a lamp box which is attached to the opening bored in the side plate and which incorporates a cold-cathode fluorescent lamp and in which an illumination plate is disposed to transmit a light emitted from the cold-cathode fluorescent lamp toward the inside of the car, a life of the cold-cathode fluorescent lamp being resistant to switching action of the lighting system;

a heat-retention section disposed in the vicinity of the cold-cathode fluorescent lamp to keep the cold-cathode fluorescent lamp at a predetermined temperature; and a reflection plate which is directly attached to the heat-retention section to reflect a light emitted from the cold-cathode fluorescent lamp toward inside of the elevator car, wherein the heat-retention section configured to keep the cold-cathode fluorescent lamp at a predetermined temperature of 25° C.

4. A lighting system of elevator according to claim 3, wherein a side plate cover is arranged outside the side plate to prevent wind sound, and the lamp box is attached to be received between the side plate and the side plate cover for the wind sound prevention.

5. A lighting system of an elevator comprising:

an elevator cage;

a cold-cathode fluorescent lamp disposed on a ceiling of the cage, a life of the cold-cathode fluorescent lamp being resistant to switching action of the lighting system;

a stabilizer which makes the cold-cathode fluorescent lamp light;

a heat-retention section disposed in the vicinity of the cold-cathode fluorescent lamp to keep the cold-cathode fluorescent lamp at a predetermined temperature; and a reflection plate which is directly attached to the heat-retention section to reflect a light emitted from the cold-cathode fluorescent lamp toward inside of the elevator cage, wherein the heat-retention section configured to keep the cold-cathode fluorescent lamp at a predetermined temperature of 25° C.

6. The system according to claim 5, wherein the reflection plate reflects an illumination light emitted from the cold-cathode fluorescent lamp in a predetermined direction.

7. The system according to claim 5, wherein the cold-cathode fluorescent lamp, the reflection plate and the stabilizer are integrally disposed.

8. A lighting system of an elevator comprising:

a side plate which includes a part of the elevator car;

a lamp box which is attached to a surface portion of the side plate and which incorporates a cold-cathode fluorescent lamp and in which an illumination plate is disposed to transmit a light emitted from the cold-cathode fluorescent lamp toward the inside of the car, a life of the cold-cathode fluorescent lamp being resistant to switching action of the lighting system;

a heat-retention section disposed in the vicinity of the cold-cathode fluorescent lamp to keep the cold-cathode fluorescent lamp at a predetermined temperature; and a reflection plate which is directly attached to the heat-retention section to reflect a light emitted from the cold-cathode fluorescent lamp toward inside of the elevator car, wherein the heat-retention section configured to keep the cold-cathode fluorescent lamp at a predetermined temperature of 25° C.

9. The system according to claim 8, wherein the lamp box further comprises one of a light emitting diode and organic electroluminescence.

* * * * *